US008672749B2

(12) United States Patent
Walker et al.

(10) Patent No.: US 8,672,749 B2
(45) Date of Patent: Mar. 18, 2014

(54) APPARATUS, SYSTEMS AND METHODS FOR FACILITATING A NEGATIVE CREDIT BALANCE OF A GAMING DEVICE

(71) Applicant: IGT, Las Vegas, NV (US)

(72) Inventors: Jay S. Walker, Stamford, CT (US); James A. Jorasch, New York, NY (US); Robert C. Tedesco, Trumbull, CT (US); Magdalena M. Fincham, Ridgefield, CT (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 13/952,094

(22) Filed: Jul. 26, 2013

(65) Prior Publication Data

US 2013/0310161 A1 Nov. 21, 2013

Related U.S. Application Data

(63) Continuation of application No. 13/546,727, filed on Jul. 11, 2012, now Pat. No. 8,506,389, which is a continuation of application No. 13/168,522, filed on Jun. 24, 2011, now Pat. No. 8,231,459, which is a continuation of application No. 11/538,096, filed on Oct. 3, 2006, now Pat. No. 7,993,198, which is a continuation of application No. 11/530,757, filed on Sep. 11, 2006, and a continuation-in-part of application No. 10/001,089, filed on Nov. 2, 2001, now Pat. No. 7,140,964, and a continuation-in-part of application No. 10/420,066, filed on Apr. 21, 2003, now Pat. No. 8,021,229, and a continuation-in-part of application No. 10/908,957, filed on Jun. 2, 2005, now Pat. No. 8,172,671.

(60) Provisional application No. 60/715,666, filed on Sep. 9, 2005.

(51) Int. Cl.
*A63F 9/24* (2006.01)

(52) U.S. Cl.
USPC ..... 463/25; 463/29

(58) Field of Classification Search
USPC ..... 463/25, 29
See application file for complete search history.

(56) References Cited

U.S. PATENT DOCUMENTS 4,467,424 A 8/1984 Hedges et al.
4,636,951 A 1/1987 Harlick (Continued)

FOREIGN PATENT DOCUMENTS

WO WO2005082094 9/2005
WO WO2006020692 2/2006

(Continued)

OTHER PUBLICATIONS

"2006 Global Gaming, Expo report—part 3" article written by John Grochowski, published Dec. 19, 2006.

(Continued)

*Primary Examiner* — Pierre E Elisca
(74) *Attorney, Agent, or Firm* — Neal, Gerber & Eisenberg LLP

(57) ABSTRACT

Apparatus, systems and methods for a gaming device operable to support a negative credit balance. For example, in some embodiments, a gaming device may be configured to: (i) determine a current credit balance, (ii) determine a wager amount, (iii) determine whether the wager amount would result in a negative balance of credits, (iv) determine if it is permissible to allow a negative balance of credits, and if so (v) adjust a current balance such that is equal to the negative balance, and (vi) display an indication of the negative credit balance.

17 Claims, 15 Drawing Sheets

(56) References Cited

U.S. PATENT DOCUMENTS

| | | | |
|---|---|---|---|
| 4,669,731 | A | 6/1987 | Clarke |
| 4,764,666 | A | 8/1988 | Bergeron |
| 4,880,237 | A | 11/1989 | Kishishita |
| 4,991,848 | A | 2/1991 | Greenwood et al. |
| 5,123,649 | A | 6/1992 | Tiberio |
| 5,178,390 | A | 1/1993 | Okada |
| 5,275,400 | A | 1/1994 | Weingardt et al. |
| 5,287,269 | A | 2/1994 | Dorrough et al. |
| 5,401,023 | A | 3/1995 | Wood |
| 5,401,024 | A | 3/1995 | Simunek |
| 5,429,361 | A | 7/1995 | Raven et al. |
| 5,511,781 | A | 4/1996 | Wood et al. |
| 5,551,692 | A | 9/1996 | Pettit et al. |
| 5,570,885 | A | 11/1996 | Ornstein |
| 5,613,912 | A | 3/1997 | Slater |
| 5,639,088 | A | 6/1997 | Schneider et al. |
| 5,741,183 | A | 4/1998 | Acres et al. |
| 5,743,800 | A | 4/1998 | Huard et al. |
| 5,758,875 | A | 6/1998 | Giacalone, Jr. |
| 5,762,552 | A | 6/1998 | Vuong et al. |
| 5,766,075 | A | 6/1998 | Cook et al. |
| 5,768,382 | A | 6/1998 | Schneier et al. |
| 5,770,533 | A | 6/1998 | Franchi |
| 5,772,509 | A | 6/1998 | Weiss |
| 5,800,268 | A | 9/1998 | Molnick |
| 5,816,917 | A | 10/1998 | Kelmer et al. |
| 5,830,067 | A | 11/1998 | Graves et al. |
| 5,833,538 | A | 11/1998 | Weiss |
| 5,833,540 | A | 11/1998 | Miodunski et al. |
| 5,836,817 | A | 11/1998 | Acres |
| 5,910,048 | A | 6/1999 | Feinberg |
| 5,970,143 | A | 10/1999 | Schneier et al. |
| 5,980,384 | A | 11/1999 | Barrie |
| 6,001,016 | A | 12/1999 | Walker et al. |
| 6,012,983 | A | 1/2000 | Walker et al. |
| 6,024,643 | A | 2/2000 | Begis |
| 6,050,895 | A | 4/2000 | Luciano, Jr. et al. |
| 6,077,163 | A | 6/2000 | Walker et al. |
| 6,126,541 | A | 10/2000 | Fuchs |
| 6,139,430 | A | 10/2000 | Huard et al. |
| 6,146,270 | A | 11/2000 | Huard et al. |
| 6,168,522 | B1 | 1/2001 | Walker et al. |
| 6,190,256 | B1 | 2/2001 | Walker et al. |
| 6,193,606 | B1 | 2/2001 | Walker et al. |
| 6,203,010 | B1 | 3/2001 | Jorasch et al. |
| 6,217,448 | B1 | 4/2001 | Olsen |
| 6,244,957 | B1 | 6/2001 | Walker et al. |
| 6,244,958 | B1 | 6/2001 | Acres |
| 6,267,671 | B1 | 7/2001 | Hogan |
| 6,273,820 | B1 | 8/2001 | Haste, III |
| 6,299,533 | B1 | 10/2001 | Parra et al. |
| 6,306,038 | B1 | 10/2001 | Graves et al. |
| 6,309,300 | B1 | 10/2001 | Glavich |
| 6,315,662 | B1 | 11/2001 | Jorasch et al. |
| 6,318,721 | B1 | 11/2001 | Randall et al. |
| 6,319,125 | B1 | 11/2001 | Acres |
| 6,319,127 | B1 | 11/2001 | Walker et al. |
| 6,331,144 | B1 | 12/2001 | Walker et al. |
| 6,343,989 | B1 | 2/2002 | Wood et al. |
| 6,402,148 | B1 | 6/2002 | Saruwatari |
| 6,409,172 | B1 | 6/2002 | Vancura |
| 6,506,118 | B1 | 1/2003 | Baerlocher et al. |
| 6,508,710 | B1 | 1/2003 | Paravia et al. |
| 6,527,638 | B1 | 3/2003 | Walker et al. |
| 6,599,192 | B1 | 7/2003 | Baerlocher et al. |
| 6,605,001 | B1 | 8/2003 | Tarantino |
| 6,607,438 | B2 | 8/2003 | Baerlocher et al. |
| 6,632,140 | B2 | 10/2003 | Berman |
| 6,709,331 | B2 | 3/2004 | Berman |
| 6,722,983 | B2 | 4/2004 | Kaminkow et al. |
| 6,726,565 | B2 | 4/2004 | Hughs-Baird |
| 6,769,983 | B2 | 8/2004 | Slomiany |
| 6,846,238 | B2 | 1/2005 | Wells |
| 6,854,729 | B2 | 2/2005 | Yamaguchi |
| 6,935,949 | B1 | 8/2005 | Murphy |
| 7,029,395 | B1 | 4/2006 | Baerlocher |
| 7,140,964 | B2 | 11/2006 | Walker et al. |
| 7,329,179 | B2 | 2/2008 | Baerlocher |
| 7,351,146 | B2 | 4/2008 | Kaminkow |
| 2002/0058542 | A1 | 5/2002 | Roethel et al. |
| 2002/0125641 | A1 | 9/2002 | Moody |
| 2002/0128057 | A1 | 9/2002 | Walker et al. |
| 2003/0114217 | A1 | 6/2003 | Walker et al. |
| 2003/0144053 | A1 | 7/2003 | Michaelson |
| 2003/0162582 | A1 | 8/2003 | Gordon |
| 2003/0220138 | A1 | 11/2003 | Walker et al. |
| 2003/0224854 | A1 | 12/2003 | Joao |
| 2004/0014522 | A1 | 1/2004 | Walker et al. |
| 2004/0063492 | A1 | 4/2004 | Baerlocher et al. |
| 2004/0063494 | A1 | 4/2004 | Oram et al. |
| 2004/0102238 | A1 | 5/2004 | Taylor |
| 2004/0176156 | A1 | 9/2004 | Walker et al. |
| 2005/0049039 | A1 | 3/2005 | Webb et al. |
| 2005/0054409 | A1 | 3/2005 | Cannon |
| 2005/0085288 | A1 | 4/2005 | Schugar et al. |
| 2006/0025207 | A1 | 2/2006 | Walker et al. |
| 2006/0025254 | A1 | 2/2006 | Myers |
| 2006/0040730 | A1 | 2/2006 | Walker et al. |
| 2006/0040732 | A1 | 2/2006 | Baerlocher et al. |
| 2006/0128457 | A1 | 6/2006 | Cannon |
| 2006/0172794 | A1 | 8/2006 | Walker et al. |
| 2006/0248025 | A1 | 11/2006 | Walker et al. |
| 2006/0252511 | A1 | 11/2006 | Walker et al. |
| 2006/0252512 | A1 | 11/2006 | Walker et al. |
| 2006/0252513 | A1 | 11/2006 | Walker et al. |
| 2006/0252514 | A1 | 11/2006 | Walker et al. |
| 2006/0252517 | A1 | 11/2006 | Walker et al. |
| 2006/0287072 | A1 | 12/2006 | Walker et al. |
| 2007/0001397 | A1 | 1/2007 | Walker et al. |
| 2007/0001398 | A1 | 1/2007 | Walker et al. |
| 2007/0054726 | A1 | 3/2007 | Muir et al. |
| 2007/0087818 | A1 | 4/2007 | Walker et al. |
| 2007/0155482 | A1 | 7/2007 | Walker et al. |
| 2007/0155483 | A1 | 7/2007 | Walker et al. |
| 2007/0155484 | A1 | 7/2007 | Walker et al. |
| 2007/0254732 | A1 | 11/2007 | Walker et al. |
| 2007/0293306 | A1 | 12/2007 | Nee et al. |
| 2008/0039189 | A1* | 2/2008 | Walker et al. ..... 463/25 |
| 2008/0076531 | A1 | 3/2008 | Baerlocher et al. |
| 2008/0076532 | A1 | 3/2008 | Graham et al. |
| 2008/0076542 | A1 | 3/2008 | Iddings et al. |
| 2008/0096650 | A1 | 4/2008 | Baerlocher |
| 2008/0108425 | A1 | 5/2008 | Oberberger |
| 2008/0108429 | A1 | 5/2008 | Davis et al. |
| 2008/0182655 | A1* | 7/2008 | DeWaal et al. ..... 463/25 |
| 2010/0120486 | A1 | 5/2010 | DeWaal et al. |
| 2011/0256923 | A1* | 10/2011 | Walker et al. ..... 463/25 |

FOREIGN PATENT DOCUMENTS

| | | |
|---|---|---|
| WO | WO2007146205 | 2/2007 |
| WO | WO2007059418 | 5/2007 |

OTHER PUBLICATIONS

Aug. 17, 2010 Office Action for U.S. Appl. No. 11/530,757.

Final Office Action dated Oct. 17, 2008 for U.S. Appl. No. 10/420,066.

Response to Final Office Action and RCE After Supplemental Appeal Brief, dated Jan. 27, 2010 for U.S. Appl. No. 10/420,066.

Davy, K. "Big Ichigeki! Pachi-Slot Taikouryku Universal Museum—Reader Review", Copyright 1995-2001, Game FAQs.

"Simple Slots Instructions", RDFoerter Software, Dec. 28, 2004, (http://wwwrdfoerster.com/Simple%20Slots%20Instructions.htm).

"The Sims Online Mania: Casino Objects", Copyright 2004-2005, (http://tsomania.net/gameguides/casino_objects.php).

Grochowski. John, "Computers Help Players Learn Winning Strategy", Chicago Sun-Times, Jun. 30, 1995, Section: Weekend Plus, Gaming, p. 13, NC.

Pledger, Marcia, "Going for the gold at slot tournaments", Las Vegas Review-Journal, Dec. 24, 1995, p. 5.L.

(56) References Cited

OTHER PUBLICATIONS

Hawley, David, "Those one-armed bandits: Slot-machine tournaments lure throngs to Midwest casinos", The Houston Chronicle, Apr. 9, 1996.
Grochowski, John, "Slot tourney prospers under Indiana rules", Chicago Sun-Times, Apr. 6, 1997, Section: SHO, Casinos, p. 15, NC.
"GameCast Live—PowerPoint Presentations", (http ://www gamecastlivecom/presentation/toronto2_files/frame htm), download date: Jun. 6, 2001.
"Station Announces Formation of GameCast Live, LLC and Release of Remote Play eSlots for In-Room Gaming applications", PR Newswire, Jun. 6, 2001, Financial News Section.

* cited by examiner

500

| OUTCOME 505 | PAYOUT 510 | RESULTING CREDIT BALANCE 520 |
|---|---|---|
| NONWINNING COMBINATION | 0 | 0 |
| CHERRY/ANY/ANY | 2 | 2 |
| ANY/ANY/CHERRY | 2 | 2 |
| CHERRY/CHERRY/ANY | 5 | 5 |
| ANY/CHERRY/CHERRY | 5 | 5 |
| CHERRY/ANY/CHERRY | 5 | 5 |
| CHERRY/CHERRY/CHERRY | 20 | 20 |
| BAR/ORANGE/ORANGE | 10 | 10 |
| ORANGE/ORANGE/BAR | 10 | 10 |
| ORANGE/ORANGE/ORANGE | 20 | 20 |
| BAR/PLUM/PLUM | 14 | 14 |
| PLUM/PLUM/BAR | 14 | 14 |
| PLUM/PLUM/PLUM | 20 | 20 |
| BAR/BELL/BELL | 18 | 18 |
| BELL/BELL/BAR | 18 | 18 |
| BELL/BELL/BELL | 20 | 20 |
| BAR/BAR/BAR | 50 | 50 |
| 7/7/7 | 100 | 100 |
| CURRENT CREDIT BALANCE 515 | | 0 |

FIG. 5

600

| GAMING DEVICE IDENTIFIER: GD-100001 615 | |
|---|---|
| ALLOWABLE NEGATIVE CREDIT BALANCE 605 | CONDITION(S) 610 |
| -1 TO -49 | PLAYER HAS INSERTED TRACKING CARD |
| -50 TO -149 | PLAYER HAS INSERTED TRACKING CARD AND HAS STATUS OF AT LEAST "TIER 1" |
| -150 TO -249 | PLAYER HAS INSERTED TRACKING CARD AND HAS STATUS OF AT LEAST "TIER 2" |
| -250 TO -349 | PLAYER HAS INSERTED TRACKING CARD AND HAS STATUS OF AT LEAST "TIER 3" |
| ANY | PLAYER IS ENGAGED IN TYPE "A" SESSION |

FIG. 6A

650

| SESSION/ CONTRACT IDENTIFIER 655 | ALLOWABLE NEGATIVE BALANCE 660 | CONDITION(S) 665 |
|---|---|---|
| GS-100001 | ANY | (NONE) |
| GS-100002 | -400 | (NONE) |
| GS-100003 | -200 | CURRENT GAME PLAY WITHIN FIRST 100 GAME PLAYS OF SESSION |
| GS-100003 | -300 | CURRENT GAME PLAY WITHIN GAME PLAYS 101 - 200 OF SESSION |
| ⋮ | ⋮ | ⋮ |

FIG. 6B

700

| PLAYER IDENTIFIER: P-000072 705 | | | | |
|---|---|---|---|---|
| SESSION IDENTIFIER 710 | SESSION BEGIN/END 715 | TIME ELAPSED WHILE NEGATIVE 720 | NUMBER OF GAME PLAYS WHILE NEGATIVE 725 | AMOUNT WAGERED WHILE NEGATIVE 730 |
| S-000001 | 8/7/03 5:31 - 6:38 P.M. | 15:27 | 93 | $26.25 |
| S-000002 | 12/12/03 8:01 - 11:52 A.M. | 1:31:02 | 532 | $165.50 |
| S-000003 | 2/7/04 9:11 - 9:31 A.M. | 0:00 | 0 | $0 |
| S-000004 | 2/7/04 2:15 - 4:01 P.M. | 31:44 | 199 | $42.75 |
| ⋮ | ⋮ | ⋮ | ⋮ | ⋮ |

FIG. 7

APPARATUS, SYSTEMS AND METHODS FOR FACILITATING A NEGATIVE CREDIT BALANCE OF A GAMING DEVICE

PRIORITY CLAIM

This application is a continuation application of, claims priority to and the benefit of U.S. patent application Ser. No. 13/546,727, filed on Jul. 11, 2012, which is a continuation application of, claims priority to and the benefit of U.S. patent application Ser. No. 13/168,522, filed on Jun. 24, 2011, now U.S. Pat. No. 8,231,459, issued on Jul. 31, 2012, which is a continuation application of, claims priority to and the benefit of U.S. patent application Ser. No. 11/538,096, filed on Oct. 3, 2006, now U.S. Pat. No. 7,993,198, issued on Aug. 9, 2011, which is a continuation application of, claims priority to and the benefit of U.S. patent application Ser. No. 11/530,757, filed on Sep. 11, 2006, which claims priority to and the benefit of U.S. Provisional Patent Application No. 60/715,666, filed Sep. 9, 2005 and which is a continuation-in-part patent application of, claims priority to and the benefit of U.S. patent application Ser. No. 10/001,089, filed on Nov. 2, 2001, now U.S. Pat. No. 7,140,964, issued on Nov. 28, 2006 and which is a continuation-in-part patent application of, claims priority to and the benefit of U.S. patent application Ser. No. 10/420,066, filed on Apr. 21, 2003, now U.S. Pat. No. 8,021,229, issued on Sep. 20, 2011 and which is a continuation-in-part patent application of, claims priority to and the benefit of U.S. patent application Ser. No. 10/908,957, filed on Jun. 2, 2005, now U.S. Pat. No. 8,172,671, issued on May 8, 2012, the entire contents of which are each incorporated by reference herein.

BACKGROUND INFORMATION

Gaming devices (e.g., reeled slot machines or video poker machines) generate more than $15 billion per year in revenue for casinos in the United States alone. Increased playing duration, average wager and rates of play are key factors contributing to the profitability of the slot floor of a casino—the more patrons play gaming devices, the more profit a casino stands to generate. Accordingly, an ongoing need exists for methods that increase a sense of excitement players may feel in association with gaming devices, such as by introducing new or improved features or methods of play.

BRIEF DESCRIPTION OF THE FIGURES

FIG. 5 is a table illustrating an example data structure of a payout database for use in some embodiments;

FIG. 6A is a table illustrating an example data structure and example data of an allowable negative credit balance database according to some embodiments;

FIG. 6B is a table illustrating an example data structure and example data of an allowable negative credit balance database according to some embodiments;

FIG. 7 is a table illustrating an example data structure of a negative play database for use in some embodiments of the present invention;

DETAILED DESCRIPTION OF EMBODIMENTS

Figure 1:
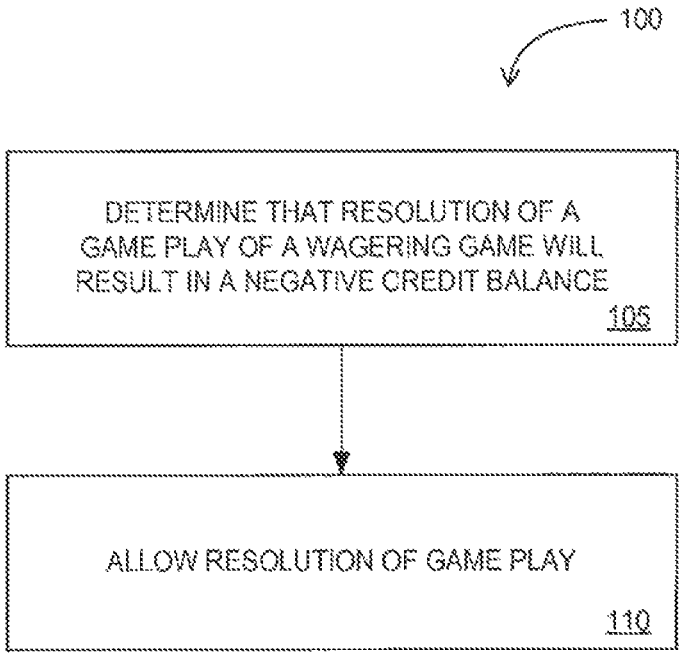
FIG. 1 is a flowchart illustrating an example process consistent with at least one embodiment.

In accordance with one or more embodiments, a gaming device for playing a wagering game comprises (i) a controller operable to facilitate a wagering game in which a unit of wager is wagered in exchange for a chance to win a prize during a game play of the wagering game, (ii) a credit balance adjustable by the controller based on a number of units of wager that have been wagered for a game play of the game and based on a number of units of wager that have been won as a result of a game play of the game, (iii) a display for displaying the credit balance, the display operable to display an indication of a credit balance that is less than zero, and (iv) a computer-readable medium having instructions stored thereon. The instructions may comprise instructions for instructing the controller (i) to track via the credit balance a player's progress through at least one game play of the wagering game by (a) deducting from the credit balance an appropriate number of units of wager upon an initiation of a game play, irrespective of whether a resulting credit balance is less than zero and (b) adding to the credit balance an appropriate number of units of wager if the game play resolves to an outcome that comprises a winning outcome. The instructions may further comprise instructions for instructing the controller to display the current credit balance to the player. In one embodiment, the gaming device comprises a gaming device operable to dispense a monetary token to a player.

In one embodiment, the computer readable medium further comprises instructions for instructing the controller to determine that the current credit balance is a negative credit balance and activate an indicator of the negative credit balance, the indicator being distinct from the display of a number of credits comprising the credit balance.

In accordance with one embodiment, an apparatus comprises (i) a processor operable to facilitate a wagering game; and (ii) a computer-readable medium operable to communicate with the processor, the computer readable medium operable to communicate with the processor. The computer readable medium may comprise instructions adapted to be executed by the processor to: (i) determine a first monetary amount provided as funds available for wagering on at least one game play of the wagering game; and (ii) set, based on the determination of the first monetary amount, to a second monetary amount that is different from the first monetary amount a balance of credits available for wagering on the at least one game play, thereby set an initial credit balance. In accordance with one embodiment, the second monetary amount is an amount not greater than zero. In accordance with one embodiment, the computer readable medium further comprises instructions to be executed by the processor to: (i) determine a player's progress through the at least one game play; and (ii) determine a prize for the player based on the progress. In one embodiment, the at least one game play comprises a session including a plurality of game plays and the initial credit balance comprises an initial session credit balance and the instructions adapted to be executed by the processor to determine the player's progress through the at least one game play comprise instructions adapted to be executed by the processor to: (i) determine an end of the session; and (ii) determine an amount of credits available for wagering at the end of the session, thereby determine a final session credit balance. In accordance with one embodiment, the computer readable medium further comprises instructions adapted to be executed by the processor to: (i) determine a difference between the initial session credit balance and the final session credit balance; and (ii) the instructions adapted to be executed by the processor to determine the prize comprise instructions adapted to be executed by the processor to determine a prize based on the difference between the initial session credit balance and the final session credit balance. In one embodiment, the first monetary amount is an amount transferred from a balance of funds associated with a player. In one embodiment, the apparatus further comprises a memory and the balance of funds is a balance stored within the memory. In one embodiment, the memory is the computer readable medium. In one embodiment, the computer readable medium further comprises instructions adapted to be executed by the processor to: (i) determine a value of a parameter of a session being purchased in exchange for the first amount; and (ii) determine the second amount based on the value of the parameter.

In accordance with one embodiment, an apparatus comprises (i) a processor operable to facilitate a wagering game; and (ii) a computer readable medium operable to communicate with the processor, the computer readable medium operable to communicate with the processor. The computer readable medium may comprise instructions adapted to be executed by the processor to: (i) track a first number of units of wager available for wagering on the wagering game; (ii) track a second number of units of wager available for wagering on the wagering game; (iii) determine a request to cashout the first number of units of wager, and (iv) determine, based on the first number and the second number, a number of units available to be cashed out, thereby determining an amount available for cashout. In one embodiment, the processor comprises a processor of a first device and the computer readable medium comprises a computer readable medium of a second device. In one embodiment, the first number of units comprises a number of units of wager loaned to a player playing the wagering game. In one embodiment, the computer readable medium comprising instructions adapted to be executed by the processor to determine an amount available for cashout comprises instructions adapted to be executed by the processor to subtract the first number from the second number. In one embodiment, the computer readable medium further comprises instructions to be executed by the processor to: (i) determine whether the determined amount available for cashout comprises an amount greater than zero; and (ii) only permitting the cashout of the amount if the determine amount is greater than zero.

In accordance with one embodiment, a method provides for determining for a wagering game available on a gaming device a balance of credits available for wagering; and determining, based on the balance, at least one of a probability of winning a particular payout and a magnitude of the payout. In one embodiment, the method further provides for determining a plurality of predetermined ranges of possible balances; and (ii) determining which one of the plurality of possible balances the balance of credits fits into. In one embodiment, a first range of possible balances corresponds to at least one of a first probability of winning a particular payout and a first magnitude of the payout, a second range of possible balances corresponds to at least one of a second probability of wining the payout and a second magnitude of the second payout, and determining at least one of a probability of winning the particular payout and the magnitude of the payout comprises determining which of the first range and the second range the determined balance of credits fits into. In one embodiment, the balance of credits is a negative number and determining the magnitude of the payout comprises determining a payout that, when added to the negative number, will result in a predetermined balance of credits. In one embodiment, the predetermined balance of credits is equal to zero credits. In one embodiment, the balance is less than zero.

In accordance with one embodiment, a method provides for (i) determining a first gaming device balance, the first gaming device balance resulting from an input of a monetary amount to a gaming device having a wagering game available thereon, wherein a gaming device balance comprises an amount of funds available for play of the gaming device; (ii) determining a purchase of a session of the wagering game for a session price; (iii) determining an initial session balance based on the purchase, wherein a session balance comprises a balance of units of wager available for wagering on game plays of the game during the session; and (iv) deducting the session price from the first gaming device balance, thereby determining a second gaming device balance. In one embodiment, the method further provides for (i) determining an end of the session; (ii) determining a final session balance, the final session balance comprising the initial session balance less wagers placed prior to the end of the session plus payouts won prior to the end of the session; and (iii) if the final session balance is a positive number, adding a monetary amount based on the final session balance to the second gaming device balance, thereby determining a third gaming device balance. In one embodiment, the first gaming device balance, the second gaming device balance and the third gaming device balance each comprise a balance that may be cashed out by a player of the gaming device while the session balance comprises a balance that may not be cashed out by the player. In one embodiment, the session price is equal to a first monetary amount and the initial session balance is equal to a second monetary amount that is not equal to the first monetary amount. In one embodiment, the first monetary amount is zero. In one embodiment, the method further provides for (i) determining, during the session, an initiation of a game play of the game; and (ii) deducting at least one unit of wager from the initial session balance, thereby determining a session balance that is a negative number. In one embodiment, the initiation of the game play of the game does not affect the second gaming device balance.

In accordance with one embodiment, an apparatus comprises (i) a processor operable to facilitate a wagering game on a gaming device; and (ii) a computer readable medium storing a program. The program may comprise instructions for directing the processor to display a payout table, the payout table indicating a plurality of outcomes obtainable via the wagering game, wherein the payout table indicates, for at least one outcome: (i) at least one indicia comprising the outcome; (ii) a number of credits comprising the prize corresponding to the outcome; and (iii) a credit balance that will result upon obtainment of the outcome. In one embodiment, the computer readable medium stores further instructions for directing the processor to: (i) determine an adjustment of a current credit balance; and (ii) adjust, upon determining the adjustment of the current credit balance, the payout table. In one embodiment, the instructions for directing the processor to adjust the payout table comprise instructions for directing the processor to determine an outcome of the payout table and adjust, based on the adjustment of the current credit balance, the corresponding credit balance that will result upon obtainment of the outcome. In one embodiment, the number of credits comprises a number of credits to be deducted from a current credit balance upon obtainment of the outcome. In one embodiment, the computer readable medium stores further instructions for directing the processor to determine that a current credit balance is an amount less than zero and output an indication of how the current credit balance may be increased to an amount not less than zero. In one embodiment, the instructions for directing the processor to output an indication comprise instructions for directing the processor to output an offer to a player, the offer defining a number of credits to be added to the current credit balance upon acceptance of the offer by the player. In one embodiment, the instructions for directing the processor to output an indication comprise instructions for directing the processor to output an indication of at least one of an outcome or a payout corresponding to the outcome, an obtainment of which outcome would result in an adjustment of the current credit balance to an amount that is not less than zero.

In accordance with one embodiment, a method provides for (i) determining a monetary input provided by a player for playing a wagering game; (ii) setting a credit balance to an amount of credits based on the monetary input, thereby determining an initial credit balance: (iii) tracking a player's progress through the game by means of the credit balance, wherein wagers placed by the player during play of the game are deducted from the credit balance and payouts won by the player during play of the game are added to the credit balance; (iv) determining a request from the player to cash out; (v) determining a final credit balance at the time of the request; (vi) determining a difference between the final credit balance and the initial credit balance; and (vii) allowing a cashout of the difference only if the final credit balance is greater than the initial credit balance. In one embodiment, allowing a cashout of the difference comprises authorizing a dispensing of a monetary amount from a gaming device, the monetary amount corresponding to the difference. In one embodiment, authorizing a dispensing of the monetary amount from the gaming device comprises authorizing a printing of a cashless gaming receipt from a printer associated with the gaming device, the cashless gaming receipt being redeemable for the monetary amount.

In accordance with one embodiment, an apparatus comprises a processor operable to facilitate a wagering game on a gaming device and a computer readable medium accessible by the processor. The computer readable medium may store a program comprising instructions for directing the processor to: (i) operate the gaming device in a transactional mode, the transactional mode comprising a mode in which a payment is required per game play of the wagering game; and (ii) operate the gaming device in a session mode, the session mode comprising a mode in which a single payment is received for a plurality of game plays of the wagering game, the payment guaranteeing a minimum duration of play of the wagering game. In one embodiment, the program comprises further instructions for directing the processor to: (i) allow, when the gaming device is operating in the session mode, play of the wagering game irrespective of whether a credit balance is less than zero.

In one embodiment, a method provides for determining a conclusion of a session, determining whether a current credit balance is negative, and if so, resetting the current balance to zero.

In accordance with one embodiment, a method may provide for determining a conclusion of a session, determining whether a current credit balance is less than a threshold amount, and if so, resetting the current balance to zero. In one embodiment, the threshold amount is zero.

In accordance with one embodiment, a method provides for determining a number of coins wagered by a player, wherein a credit balance upon wagering is equal to or less than zero, and outputting an indication of the number. This may be characterized as outputting an indication of the player's total amount bet with the "House's money."

In accordance with one embodiment, a method provides for determining a number of coins wagered by a player, wherein a credit balance upon wagering is equal to or less than a threshold credit balance, and outputting an indication of the number. In one embodiment, the threshold credit balance is zero.

Referring now to FIG. 1, illustrated therein is a flow chart of an example process 100 that is consistent with one or more embodiments. In accordance with at least one embodiment, process 100 provides for determining that a resolution of a game play of a wagering game will result in a negative credit balance (step 105) and allowing the resolution of the game play (step 110). In other words, the resolution of the game play is allowed even though the resolution will result in a negative credit balance. The game play may comprise, for example, a game play of a wagering game on a gaming device that is operable to dispense a monetary token. A monetary token may comprise, in at least one embodiment, a form of currency such as a coin or bill, a casino token (i.e., a token redeemable for cash at one or more specified casinos) or a paper voucher (e.g., a cashless gaming receipt).

Following are various example definitions for some terms used throughout the present description and particularly with respect to process 100. These example definitions are followed by (i) a description of some example embodiments which may be encompassed by the process 100; (ii) a description of hardware which may be used to implement, track and/or manage a negative credit balance in accordance with one or more embodiments described herein; (iii) a description of databases which may be used to implement, track and/or manage a negative credit balance in accordance with one or more embodiments described herein; (iv) a description of screen shots which may be used to output information related to a negative credit balance in accordance with one or more embodiments described herein; and (v) a description of additional processes which may be used to implement, track and/or manage a negative credit balance in accordance with one or more embodiments.

A game play, in at least one embodiment, may comprise a single play or round of a wagering game at a gaming device, the game play resulting in a singular, corresponding outcome (e.g., a player pulls the handle of a slot machine and the reels resolve to "Bar-Lemon-Plum"). In some embodiments, a game play may comprise a bonus round. It should be noted that the term "round" does not imply a plurality of participants (e.g., as in a round of a card game) nor does it imply a relationship with a plurality of rounds (e.g., as in a game the outcome of which is determined based on events during a plurality of rounds of the game). It should further be noted that, as appropriate, the term "handle pull", "spin" or "hand" is used interchangeably with the term "game play" or "round." For example, in describing an example embodiment involving a reeled slot machine, the term "spin" or "handle pull" may be used while describing an example embodiment involving a video poker game, the term "hand" may be used.

A game or wagering game, in at least one embodiment, may comprise a wagering activity conducted in accordance with a particular set of rules via which a prize or benefit may be won in exchange for consideration.

An outcome, in at least one embodiment, may comprise a result of a game play, which may be indicated by a payout (i.e., a prize or benefit to be provided as a result of the game play) and/or one or more indicia representative of the result. For example, an outcome may comprise the set of indicia (or payout corresponding thereto) that may be displayed along a payline of a reeled slot machine. In another example, an outcome may comprise a roulette number that is a result of a roulette spin. In yet another example, a set of five cards may comprise an outcome of a video poker game. In yet another variation, a plurality of sets of cards, each set comprising a number of cards (e.g., five cards), may comprise an outcome for a game play of a video poker game. In some embodiments, more than one set of indicia may represent the same result or outcome.

A type of game, in at least one embodiment, may comprise a category of games that share one or more characteristics.

A credit balance, in at least one embodiment, comprises a balance of credits available for wagering. A credit balance, in at least one embodiment, is a mechanism for tracking a player's progress through a single or multiple game plays of a wagering game by means of a number of units of wager. The unit of wager may be arbitrarily defined or may correspond to a value of currency (e.g., one unit of wager, or credit, is equal to a single 25¢ coin). Such a mechanism may be implemented via software and/or hardware. For example, a program may include instructions for tracking the player's progress by (i) deducting, for each game play of a game, an appropriate number of credits or units of wager from the credit balance and (ii) adding, for each game play of the game, an appropriate number of credits or units of wager to the credit balance for each winning outcome achieved by the player. An example of hardware that may be used to implement a credit balance may comprise a display (e.g., a touchscreen or LED display) that indicates a credit balance to a player and the adjustments thereto as a result of game play.

A negative credit balance, in at least one embodiment, may comprise a balance of credits or other units of wager that is less than zero. For example, if it is permissible to allow a negative credit balance, a player with a balance of seven credits may place a 10-credit wager and receive a non-winning outcome, thereby resulting in a balance of −3 credits. In other embodiments, a negative balance of credits may comprise a positive amount of a secondary type of credits. For example, a player may have a positive balance of credits of a primary type (e.g., 12 "standard" game credits), as well as a positive balance of credits of a secondary type (e.g., 17 "loaned" game credits). In one such example, credits of the secondary type may offset, negate or reduce the value of credits of the primary type. For example, if the player has earned 12 standard credits but owes 17 loaned credits, the player's net credit balance may be −5. Thus, in some embodiments, a negative credit balance may comprise a net credit balance that is determined to be negative after comparing two or more balances of credits that may affect one another (e.g., comparing a balance of primary type of credits with a balance of secondary type of credits). In some embodiments, a primary type of credits may comprise credits for which the player has provided consideration (e.g., the player inserts $20 into a gaming device and in exchange receives an amount of electronic credits added to the credit meter balance of the gaming device). In some embodiments, a secondary type of credits comprises electronic credits which are provided to a player and available for wagering to a player but for which credits the player has not provided consideration prior to the credits being provided to the player (e.g., a casino "loans" electronic credits to a player or otherwise allows the player to play with credits for which the player has not paid). In some embodiments, zero may comprise a negative credit balance (e.g., credit balances of zero and any negative numbers may be treated similarly with respect to various processes or methods described herein). Other embodiments comprising negative credit balances will be described in more detail further herein.

Negative credits, in at least one embodiment, may refer to (i) credits of a balance that is currently less than zero (e.g., if a credit balance is −5, a player can be thought to posses five negative credits), (ii) a positive amount of credits that negatively affect (negate, offset, reduce the value of) another type of credits (e.g., "loaned" credits reduce the value of "standard" credits), and/or (iii) non-cashable or otherwise illiquid credits (e.g., that have been loaned to a player, which the player may or may not be obligated to repay). Various terms may be associated with such credits so as to illustrate their nature. For example, such credits may be termed negative credits, loaned credits, financed credits, borrowed credits, mortgaged credits, advanced credits, subtractive credits, credits to be subtracted, "whammy" credits, penalty credits, illiquid credits, "free" credits or game plays (e.g., if such credits are provided to a player and the player needn't repay them), or any other substitute or otherwise appropriate term. Further, in some instances, such credits may be thought of as "debits" or reductions against a total balance or amount payable to a player. In some embodiments, negative credits may comprise credits against which any payouts won by a player will be applied, until all the negative credits are repaid. For example, if a player is associated with a balance of negative five credits ("−5") and wins a payout of eight credits ("+8"), the first five of these won credits may be applied to the negative five credits, so as to repay the negative five credits or offset the negative credits, resulting in a balance of three credits ("+3") as a result of the win. In one embodiment, a player may not be allowed to cash out negative credits.

A payout, in at least one embodiment, may refer to a benefit provided to a player as the result of an outcome (e.g., at the end of a bonus round, a player is paid 120 credits). For example, in some embodiments, a payout comprises a number of credits added to a balance represented by an electronic credit meter (e.g., a winning outcome of "Lemon-Lemon-Lemon" pays five credits). In some embodiments wherein a current credit balance is negative, adding credits to such a balance may have the effect of reducing the negative number (e.g., if a player has a balance of −23 credits and the player wins 11 credits, the current balance becomes −12). Thus, in some embodiments, a payout may comprise the forgiveness of a loan. A payout need not necessarily be provided to a player at the time an outcome corresponding to the payout is determined and/or by the gaming device that determines the outcome.

A resolution of a game play, in at least one embodiment, may refer to determining an outcome for the game play (e.g., determining a random number and determining the outcome that corresponds to the random number) and/or outputting an indication of the outcome (e.g., displaying indicia along a payline of a slot machine display or displaying card indicia via a screen of a video poker machine).

Allowing a resolution of a game play may include, in at least one embodiment, (i) allowing a payout corresponding to an outcome for the game play to be added to a current credit balance; (ii) allowing an output of an indication of an outcome for the game play; and/or (iii) allowing a wager amount for the game play to be deducted from a current credit balance.

In accordance with at least one embodiment, a credit balance may be allowed to become negative during execution of a session. A session, in at least one embodiment, may refer to a gambling event with a beginning and end that may encompass a number of game plays. For example, a gaming session may comprise a consecutive number of game plays executed by a player using one or more gaming devices. The end of a session may be determined voluntarily (in which the player elects to stop play) or involuntarily (in which the gaming device terminates play). In one embodiment, a session begins when a player inserts a player tracking card and ends when the player cashes out. In some embodiments, a player may pay a fixed price for a game session comprising a number of game plays (e.g., a $20 up-front payment entitles the player to a predetermined amount of game play). Apparatus and methods which, among other things, permit and enable various ways of providing flat-rate game sessions or "contract play," and which are appropriate for use in accordance with the present invention are disclosed in: U.S. Pat. No. 6,077,163, filed Jun. 23, 1997, entitled "GAMING DEVICE FOR A FLAT RATE PLAY SESSION AND A METHOD OF OPERATING SAME"; U.S. patent application Ser. No. 10/001,089, filed Nov. 2, 2001, entitled "GAME MACHINE FOR A FLAT RATE PLAY SESSION AND METHOD OF OPERATING SAME"; U.S. patent application Ser. No. 10/420,066, filed Apr. 21, 2003, entitled "METHOD AND APPARATUS FOR EMPLOYING FLAT RATE PLAY"; U.S. patent application Ser. No. 10/636,520, filed Aug. 7, 2003, entitled "SYSTEM AND METHOD FOR COMMUNICATING GAME SESSION INFORMATION"; U.S. Provisional Application No. 60/600,211, filed Aug. 10, 2004, entitled "SYSTEMS, METHODS AND APPARATUS FOR ADMINISTERING GAMING CONTRACTS"; and U.S. Provisional Application No. 60/637,338, filed Dec. 17, 2004, entitled "GAMING DEVICE OFFERING A FLAT RATE PLAY SESSION AND METHODS THEREOF"; the entirety of each are incorporated herein by reference for all purposes.

For example, as described herein and in the related patents and patent applications incorporated by reference above, a player may purchase a session, by the purchase of which a player is guaranteed a number of game plays (or duration of time of play) for a set retail price. For example, a player may pay $20.00 for 500 game plays of a video poker or slot machine game. In such embodiments, the credit balance may be allowed to become negative during resolution of the game plays of the session.

It should be noted that, in accordance with some embodiments and as described further herein and in the patents and patent applications incorporated by reference herein, whether a credit balance becomes negative (or the maximum negative magnitude of a credit balance) may be based on one or more terms or parameters of a session purchased by a player. Thus, for example, process 100 may include a step of determining whether to allow the credit balance to become negative. Such a determination may be based on one or more factors, such as a parameter of a session currently in process and/or information associated with a player.

Applicants envision a variety of circumstances under which it may be practical and/or beneficial for a credit balance to become negative. For example, a deduction of a wager amount from a credit balance may result in a negative credit balance (i.e., if the wager amount is greater than the current credit balance). In another example, an obtainment of an outcome that corresponds to a deduction of a number of credits from a credit balance (i.e., a "whammy" outcome) rather than an addition of credits to the credit balance may result in a negative credit balance. In yet another example, an initiation of or participation in a session may result in a negative credit balance.

It should further be noted that, in accordance with at least one embodiment, an initial credit balance for a session may be set at zero or another number of credits that is not equivalent to a monetary amount input by a player as payment for the session. For example, a player may pay $20.00 for a session and, rather than adding $20.00 worth of credits to a credit balance for the session, the credit balance may be set to zero or another amount not equivalent to $20.00. Applicants have recognized that setting an initial credit balance to zero or another amount that is less than a price paid by a player for a session results in significantly lower cost of the session to the casino or other entity selling the session and may even result in a profit per session for the casino or other entity. For example, Applicants have recognized that for a seventy-five (75) hand Double Double Bonus™ Poker game session (i.e., a session that guarantees the player 75 hands of the game) that is sold for a retail price of $20.00, a casino can make $4.21 per session if the initial session balance is set to zero and allowed to become negative during play of the session. This should be contrasted with a loss of $1.94 for the casino if the initial credit balance for the session were to be set to an amount of credits equivalent to the $20.00 retail price for the session.

Returning now to FIG. 1, in at least one embodiment step 105 may comprise determining a current credit balance (i.e., a credit balance prior to the resolution), determining a wager amount for the game play and determining that a deduction of the wager amount from the current balance will result in a credit balance that is less than zero credits. In another embodiment, step 105 may comprise determining an outcome for the game play, determining a current credit balance, the current credit balance comprising a credit balance prior to the resolution, determining that the outcome corresponds to a deduction of a number of credits from the current credit balance and determining that the number of credits is greater than the current credit balance.

In at least one embodiment, process 100 may further comprise determining whether to allow the resolution of the game play. Determining whether to allow the resolution of the game play may comprise, for example, determining whether a gaming device on which the wagering game is being conducted is currently operating in a mode that supports management of a negative credit balance.

In at least one embodiment, step 105 may comprise determining a wager amount for a game play of a wagering game on a gaming device, the gaming device operable to dispense a monetary token. In such an embodiment, step 110 may comprise allowing the deduction of the wager amount from a current credit balance even if the deduction results in a negative credit balance. In one embodiment, allowing the deduction of the wager amount from the credit balance may comprise authorizing an outcome to be determined for the game play. Authorizing the outcome to be determined may comprise, for example, authorizing a random number to be determined for the game play, wherein the outcome is determined based on the random number.

In at least one embodiment, allowing the deduction of the wager amount from the credit balance may comprise authorizing a payout, if any, that corresponds to the outcome to be added to the credit balance.

In one embodiment, process 100 may comprises determining a threshold negative balance; and only allowing the deduction if the negative credit balance that will result from the deduction is greater than the threshold negative balance. In such an embodiment, process 100 may further comprise determining that the negative balance that will result from the deduction is not greater than the threshold amount and outputting a message indicating a denial of the wager amount.

In at least one embodiment, process 100 may further include steps of determining the current credit balance, the current credit balance comprising a credit balance prior to the deduction, determining that the deduction of the wager amount from the current credit balance will result in a negative credit balance and determining, based on at least one factor, whether to allow the deduction. The at least one factor may comprise, for example: (i) data associated with a player who is associated with the wager amount; (ii) at least one session play parameter; (iii) an indication from a device (e.g., a controller, a casino personnel device, a kiosk, etc.); (iv) a time; (v) a level of utilization of one or more wagering games; (vi) a level of utilization of one or more gaming devices; (vii) a rate of play associated with a gaming device; (viii) a current mode a gaming device is operating in; (ix) a purchase of a session; and (x) one or more parameters of a purchased session.

The data associated with the player may comprise, for example, at least one of (i) data stored in a database; (ii) data stored in a local memory of a gaming device; (iii) data associated with a player tracking number associated with the player; (iv) an indication of whether the player is a registered guest at a particular hotel; (v) a status associated with the player, the status relating to wagering activities of the player; (vi) an indication of an availability of financial account information associated with the player; (vii) an indication of an availability of contact information for the player; and (viii) an indication of a session purchased by the player.

The at least one session parameter may comprise, for example, a parameter of a session purchased by a player associated with the wager amount. In other examples, the at least one session parameter may comprise at least one of: (i) a retail price of the session; (ii) a cost of the session to a casino; (iii) a maximum negative balance defined by the session; (iv) a fee provided for an allowance of the negative credit balance; (v) a duration of the session (e.g., maximum duration); (vi) a duration of the session remaining; (vii) a duration of the session during which the credit balance has been negative; (viii) a profit associated with the session; and (iv) a credit line associated with the player.

In at least one embodiment, determining whether to allow the deduction of a wager from a credit balance may comprise accessing a database to determine data based on which the determination is made. For example, a database such as that depicted in FIG. 6A, FIG. 6B and/or FIG. 7 may be accessed. In one embodiment, such a database may comprise a database storing data indicative of sessions available for purchase.

In at least one embodiment, process 100 may further comprise outputting an indication of the negative credit balance. Outputting an indication of the negative credit balance may comprise, for example, at least one of: (i) displaying a numeral representing a number of credits of the credit balance, wherein the numeral is preceded by a hyphen to indicate that the number of credits is less than zero: (ii) displaying a numeral representing a number of credits of the credit balance, wherein the numeral is preceded by 'negative' as written text to indicate that the number of credits is less than zero; (iii) displaying a number of credits as a numeral in parenthesis; (iv) displaying a number of credits by using a red color (e.g., as opposed to green or another color); (v) displaying an indication of a plurality of balances, wherein at least one of the balances offsets and is greater than another of the balances; (vi) displaying at least one of an icon, symbol or graphic as representative of the negative credit balance; and (vii) outputting auxiliary information associated with the negative credit balance, the auxiliary information comprising information distinct from a representation of the number of credits of the credit balance.

In at least one embodiment, process 100 may further comprise incrementing a value stored in a database, the value representing at least one of: (i) an amount of time elapsed while the credit balance is not greater than a predetermined amount; (ii) a number of game plays of a game played while the credit balance is not greater than a predetermined amount; and (iii) a sum of wagers placed while the credit balance is not greater than a predetermined amount. Table 700 of FIG. 7 (described in detail below) illustrates one example of a database in which such information may be stored.

It should be noted that, in some embodiments, the processes involving a negative credit balance may be applied to a credit balance that is below some other threshold amount other than zero. For example, in some embodiments a determination of whether resolution of a game play would result in a negative credit balance may comprise a determination of whether a resolution of the game play would result in a credit balance less than a threshold amount, wherein the threshold amount is greater than zero. Accordingly, it is contemplated that the embodiments described herein involving a negative credit balance may be equally applicable, as is practicable, to a credit balance that is less than such a threshold amount greater than zero.

It should be noted that process 100, as any process described herein, may be performed by any device or combination of devices described herein, as desired and practical. For example, in one embodiment both step 105 and step 110 of process 100 may be performed by a controller (e.g., controller 205 of FIG. 2, described below), in another embodiment both steps may be performed by a gaming device (e.g., a gaming device 210 of FIG. 2) while in yet another embodiment at least one of the steps may be partially or wholly performed by a device other than a device partially or wholly performing another of the steps of process 100. For example, in one particular embodiment both step 105 and step 110 may be performed by controller 205 while another of the possible steps described with respect to process 100 (e.g., displaying an outcome) may be performed by a gaming device 210. Of course, any other device or combination of devices (e.g., a casino personnel device or wireless portable gaming unit) may be used to performed at least a portion of a step of the process. For example, a wireless portable gaming unit may display an outcome in accordance with process 100.

Figure 2:
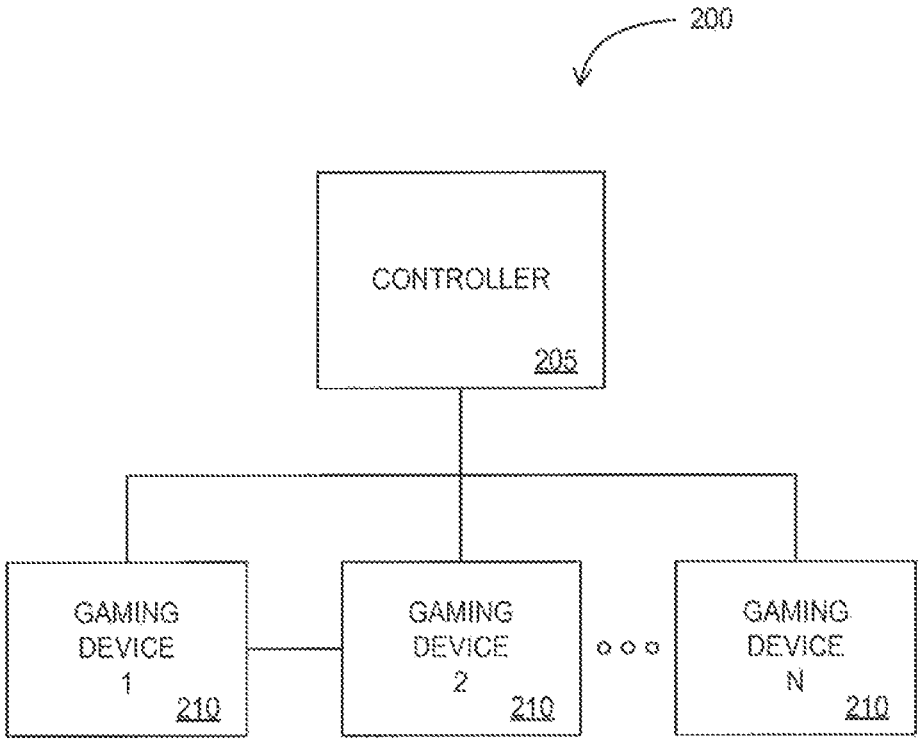
FIG. 2 is a block diagram illustrating an example network environment according to at least one embodiment.

Referring now to FIG. 2, an example embodiment 200 of a system in accordance with one or more embodiments is depicted in block diagram form. Embodiment 200 is referred to as system 200 herein. The present invention can be configured to work as a system 200 in a network environment including a controller 205 (e.g., a slot server of a casino) that is in communication, via a communications network, with one or more gaming devices 210 (e.g., slot machines, video poker machines, video blackjack machines, pachinko machines, video lottery terminals, etc.). The controller 205 may communicate with any and all of the gaming devices 210 directly or indirectly, via a wired or wireless medium such as the Internet, LAN, WAN or Ethernet, Token Ring, or via any appropriate communications means or combination of communications means. Each of the gaming devices 210 may comprise computers, such as those based on the Intel® Pentium® processor, that are adapted to communicate with the controller 205. Any number, type and/or number of types of gaming devices 210 may be in communication with the controller 205.

The controller 205 may comprise, in at least some embodiments, an electronic device (e.g., a computer) that is operable to communicate with one or more gaming devices 210. In some embodiments, controller 205 may function as a computer server and may control or direct at least some processes of gaming devices. Alternately or additionally, the controller 205 may contain or otherwise be configured to read data from and/or write data to one or more databases of one or more of the gaming devices 210. Such data may comprise, for example, probability data, payout data, player data, and so on. In some embodiments, outcomes may be "centrally-determined" by controller 205 or another device that is distinct from the gaming devices 210. Such centrally-determined outcomes may then be promulgated to one or more gaming devices 210, such that they may be received by players. In one embodiment, controller 205 may in turn be in communication with another electronic device (not shown) that is distinct from a gaming device 210, which electronic device may be operable to (i) direct the controller 205 to perform certain functions and/or (ii) read data from and/or write data to the controller 205. For example, the controller 205 may comprise a slot server or Data Collection Unit (DCU) that controls and/or communicates with a bank of gaming devices, which server or DCU is in turn in communication with a casino server that is in communication with a plurality of controllers. In another embodiment, the controller 205 may be operable to communicate with the one or more gaming devices 210 via another electronic device (e.g., a DCU), such as a server computer operable to communicate with a plurality of gaming devices. For example, in one embodiment, the controller 205 may be operable to communicate with a plurality of computing devices (not shown), each computing device operable to communicate with a respective plurality of gaming devices.

Communication between the gaming devices 210 and the controller 205 and/or among the gaming devices 210 may be direct or indirect, such as over the Internet through a Web site maintained by computer on a remote server or over an on-line data network including commercial on-line service providers, bulletin board systems and the like. In yet other embodiments, the gaming devices 210 may communicate with one another and/or the controller 205 over RF, cable TV, satellite links and the like.

Some, but not all, possible communication networks that may comprise the network or be otherwise part of the system 200 include: a local area network (LAN), a wide area network (WAN), the Internet, a telephone line, a cable line, a radio channel, an optical communications line, and a satellite communications link. Possible communications protocols that may be part of the system include: Ethernet (or IEEE 802.3), SAP, ATP, Bluetooth™, and TCP/IP. Communication may be encrypted to ensure privacy and prevent fraud in any of a variety of ways well known in the art.

A variety of communications protocols may be part of the system 200 or another system operable to facilitate the embodiments described herein, including but not limited to: Ethernet (or IEEE 802.3), SAP, SAS™, SuperSAS™, ATP, Bluetooth™, and TCP/IP. Further, in some embodiments, various communications protocols endorsed by the Gaming Standards Association of Fremont, Calif., may be utilized, such as (i) the Gaming Device Standard (GDS), which may facilitate communication between a gaming device and various component devices and/or peripheral devices (e.g., printers, bill acceptors, etc.), (ii) the Best of Breed (BOB) standard, which may facilitate communication between a gaming device and various servers related to play of one or more gaming devices (e.g., servers that assist in providing accounting, player tracking, content management, ticket-in/ticket-out and progressive jackpot functionality), and/or (iii) the System-to-System (S2S) standard, which may facilitate communication between game-related servers and/or casino property management servers (e.g., a hotel server comprising one or more databases that store information about booking and reservations). Communication may be encrypted to ensure privacy and prevent fraud in any of a variety of ways well known in the art.

In some embodiments, a controller 205 may not be necessary and/or preferred. For example, one or more embodiments may be practiced on a stand-alone gaming device 210 and/or a gaming device 210 in communication only with one or more other gaming devices 210 (i.e. without a controller 205). In such embodiments, any functions described as performed by the controller 205 or data described as stored on the controller 205 may instead be performed by or stored on one or more gaming devices 210.

In one or more embodiments, system 200 may include additional devices, such as one or more casino personnel devices, one or more additional servers (e.g., a hotel reservation server, a player data server, a loaned credits management server, a purchases sessions management server and/or an inventory management server). In accordance with one or more embodiments, one or more point-of-sale terminals associated with one or more merchants may also be included in system 200.

In some embodiments, various casino employees may be equipped with or otherwise utilize one or more casino personnel devices, such as personal digital assistants (PDAs) or other computing devices (e.g., personal computer terminals). A casino personnel device may comprise various input devices (e.g., a keypad, a touch-sensitive display screen, a card reader, an infrared bar code scanner, etc.), various output devices (e.g., an LCD screen), a processor, a memory and/or a communications port, as described herein with respect to other devices. In some embodiments, a casino personnel device may communicate with a gaming device, server, kiosk, peripheral device, and/or an inventory/reservation system of a casino-maintained property (e.g., a hotel). Thus, a casino personnel device may be configurable to, among other things, (i) read from and/or write to one or more databases of the present invention, (ii) assist in payments made to players (e.g., a representative "scans" a cashless gaming receipt and determines a value associated with the receipt, and if the receipt is valid, provides payment equal to the value), (iii) assist in payment made by players (e.g., a casino representative may receive a payment from a player for a session purchased by a player); (iv) assist in authorizing a negative credit balance; and/or (iii) execute or assist in the execution of various other processes described herein. For example, a casino employee may utilize a casino personnel device to authorize a gaming device to allow play of the gaming device even though such play would result in a negative credit balance. In one or more embodiments, a casino personnel device may be operable to read data from and/or write data to one or more of the databases described herein. A memory of a casino personnel device may store a program for executing processes described herein, or portions thereof.

In some embodiments, various merchants (e.g., shops, restaurants, etc.) may utilize point-of-sale (POS) computer terminals to facilitate various processes of the present invention. For example, in some embodiments, a player may win, earn or otherwise qualify to play a gaming device in a negative credit balance mode by making purchases at a merchant or otherwise interacting with a merchant. In another example, a player may register at a merchant to participate in a session which allows a negative credit balance at a gaming device.

In some embodiments, POS terminals may be configured to read from and/or write to one or more databases of the present invention. Such POS terminals may thus comprise various hardware and software described herein with respect to other devices, and may communicate with (i) a casino server, (ii) a gaming device, (iii) an inventory/reservation system (e.g., a computer terminal at a theatre communicates with an inventory database to determine a number of unsold seats for a certain event), and so on.

In some embodiments, various component devices (e.g., any or all of the benefit output devices, output devices, input devices and/or input output devices described herein) may be embodied as peripheral devices. For example, such devices may not necessarily be components of a gaming device, though they may be configured in such a manner so as to communicate with one or more gaming device processors or any other devices described herein. For example, a peripheral device such as a large display device may be associated with a plurality of gaming devices, and thus may not necessarily be considered a component of any one gaming device. Further, in some embodiments, certain peripheral devices such as card readers may be interchangeable between gaming devices, and thus may be considered a component of a first gaming device while connected thereto, removed from the first gaming device, connected to a second gaming device, and so on. In other embodiments, various peripheral devices may never be considered a component of a particular gaming device. For example, in some embodiments, a peripheral device such as a USB-based portable memory device may store (i) one or more databases described herein, and/or (ii) a program for executing one or more process steps described herein. Such a peripheral device may then be utilized by casino personnel for upgrading/retrofitting existing gaming devices as described herein.

In some embodiments, system 200 may include one or more wireless portable gaming units operable to facilitate wagering in a casino. Such a wireless portable gaming unit may or may not be dedicated to gambling or casino-related functions. For example, a wireless portable gaming unit may be operable to receive data from a gaming device 210, controller 205 and/or a device located at a table game. Such a wireless portable gaming device may be utilized, for example, by a player to remotely play a gaming device or table game or otherwise participate or enjoy a gaming activity (e.g., view outcomes obtained at a gaming device or table game and/or place wagers on such outcomes). In another example, such a wireless portable gaming unit may be utilized by a player to receive and/or transmit information to a gaming device 210, controller 205, another player and/or another entity (e.g., receive and/or respond to promotional messages or offers from a casino or other entity).

The components of system 200 may cooperate to authorize, track and/or implement a negative credit balance at a gaming device or wireless portable gaming unit, in accordance with the methods described herein and encompassed by the present description.

Figure 3:
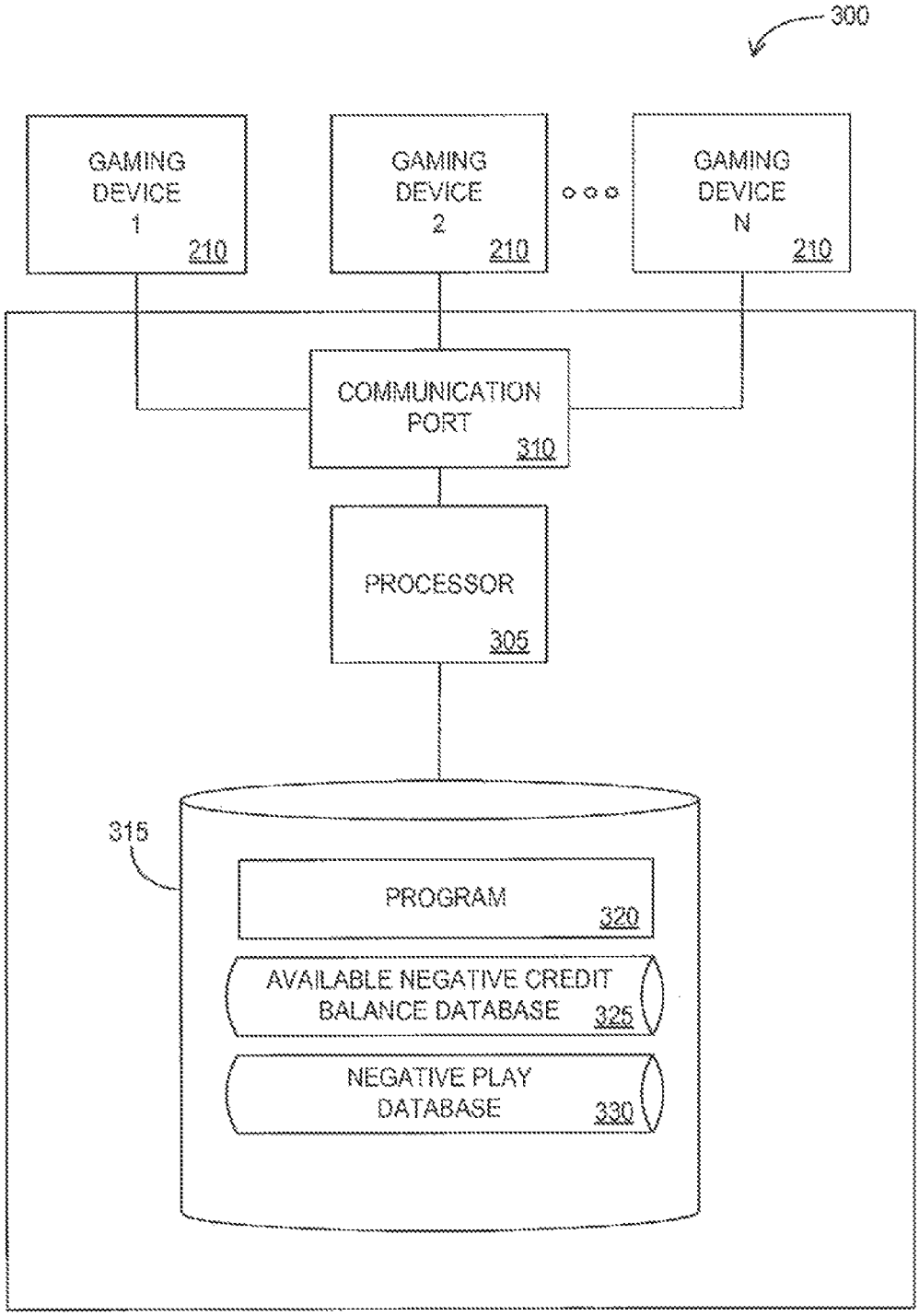
FIG. 3 is a block diagram illustrating an example server according to at least one embodiment.

Referring now to FIG. 3, illustrated therein is an embodiment 300 of a controller operable to communicate with one or more gaming devices 210. Although three gaming devices 210 are illustrated, any number may be used. The embodiment 300 may be, for example, an embodiment of the controller 205. Embodiment 300 is referred to as controller 300 herein.

The controller 300 may be implemented as a system controller, a dedicated hardware circuit, an appropriately programmed general-purpose computer, or any other equivalent electronic, mechanical or electro-mechanical device. The controller 300 may comprise, for example, one or more server computers operable to communicate with one or more client devices, such as one or more gaming devices, one or more kiosks, one or more peripheral devices, one or more wireless portable gaming units and/or one or more casino personnel devices. In some embodiments, the controller 300 may be operative to manage the system 200 (or portions of one or both systems) and to execute some or all of the methods described herein.

In operation, the controller 300 may function under the control of a casino, another merchant, or other entity that may also control use of the gaming devices 210. For example, the controller 300 may be a slot server in a casino. In some embodiments, the controller 300 and a slot server may be different devices. In some embodiments, the controller 300 may comprise a plurality of computers operating together. In some embodiments, the controller 300 and a gaming device may be the same device.

The controller 300 comprises a processor 305, such as one or more Intel® Pentium® processors. The processor 305 is in communication with a communication port 310 (e.g., for communicating with one or more other devices, such as one or more gaming devices 210) and a memory 315. The memory 315 may comprise an appropriate combination of magnetic, optical and/or semiconductor memory, and may include, for example, Random Access Memory (RAM), Read-Only Memory (ROM), a compact disc and/or a hard disk. The processor 305 and the memory 315 may each be, for example: (i) located entirely within a single computer or other device; or (ii) connected to each other by a remote communication medium, such as a serial port cable, telephone line or radio frequency transceiver. In one embodiment, the controller 300 may comprise one or more devices that are connected to a remote server computer for maintaining databases.

The memory 315 stores a program 320 for controlling the processor 305. The processor 305 performs instructions of the program 320, and thereby operates in accordance with the present invention, and particularly in accordance with the methods described in detail herein. The program 320 may be stored in a compressed, uncompiled and/or encrypted format. The program 320 furthermore includes program elements that may be necessary, such as an operating system, a database management system and "device drivers" for allowing the processor 305 to interface with computer peripheral devices. Appropriate program elements are known to those skilled in the art, and need not be described in detail herein. The program 320 may include computer program code that allows the controller 300 to employ the communication port 310 to communicate with a gaming device in order to, for example:

(i) track gambling or other activity performed at the gaming device;

(ii) track gaming or other activities of individual players;

(iii) instruct a gaming device to perform one or more functions (e.g., allow a negative credit balance, output a message to a player, etc.);

(iv) receive or otherwise determine an input from a casino employee regarding a negative credit balance;

(v) authorize a negative credit balance at a gaming device;

(vi) transmit an indication of loaned credits to a gaming device;

(vii) determine whether a negative credit balance should be allowed;

(viii) receive or otherwise determine and store player data (e.g., data associated with a player which may be used to determine whether a negative credit balance should be allowed for the player);

(ix) receive or otherwise determine a request for loaned credit or a negative credit balance (e.g., from a player or gaming device 210); and/or (x) receive or otherwise determine information from a gaming device regarding a negative credit balance.

Regarding (x), controller 300 may be operable to receive or determine, for example, a status of a credit balance (e.g., an indication of whether a credit balance is negative); a current value of a credit balance, information related to a session in which a negative balance is allowed, a duration of time (e.g., in terms of units of time or number of game plays of a game) for which a credit balance has been negative, etc.

It should be noted that any or all of the functions described above as being performed by controller 300 in some embodiments may in some embodiments be performed (or partially performed) by another device (e.g., a gaming device 210), in conjunction or in lieu of being performed by controller 300.

According to an embodiment, the instructions of the program 320 may be read into a main memory from another computer-readable medium, such from a ROM to RAM. Execution of sequences of the instructions in program 320 causes processor 305 to perform the process steps described herein. In alternate embodiments, hard-wired circuitry may be used in place of, or in combination with, software instructions for implementation of the processes of the present invention. Thus, embodiments of the present invention are not limited to any specific combination of hardware and software.

The memory 315 also stores (i) an available negative credit balance database 325; and (iii) a negative play database 330. Each of the databases 325 and 330 is described in more detail below. Of course, other databases may be stored (e.g., a negative credit balance database that stores information relating to a negative balance associated with a particular player, a particular session and/or a particular gaming device).

In some embodiments, data may be stored in a memory structure other than a database. For example, a hierarchical file structure may be used.

In some embodiments (e.g., in an embodiment in which controller 300 manages downloadable games playable on one or more gaming devices), the memory 310 may store additional databases relevant to such embodiments. Examples of such additional databases include, but are not limited to, (i) a gaming device database that stores information related to one or more gaming devices with which the controller 300 is operable to communicate, (ii) a game database that stores information regarding one or more games playable on and/or downloadable to one or more gaming devices, and (iii) a scheduling and/or configuration database useful for determining which games are to be made available on which gaming devices.

Similarly, in one embodiment controller 300 may be operable to configure a gaming device remotely, update software stored on a gaming device and/or to download software or software components to a gaming device. For example, controller 300 may be operable to apply a hot fix to software stored on a gaming device, modify a payout and/or probability table stored on a gaming device and/or transmit a new version of software and/or a software component to a gaming device. Controller 300 may be programmed to perform any or all of the above functions based on, for example, an occurrence of an event (e.g., a scheduled event), receiving an indication from a qualified casino employee and/or other person (e.g., a regulator) and/or receiving a request from a player.

Although the databases 325 and 330 are described as being stored in a memory of controller 300, in other embodiments either or both of these databases may be partially or wholly stored, in lieu of or in addition to being stored in a memory of controller 300, in a memory of one or more other devices. Such one or more other devices may comprise, for example, one or more peripheral devices, one or more gaming devices, a slot server (if different from the controller 300), another device, or a combination thereof. Further, some or all of the data described as being stored in the memory 315 may be partially or wholly stored (in addition to or in lieu of being stored in the memory 315) in a memory of one or more other devices. Such one or more other devices may comprise, for example, one or more peripheral devices, one or more gaming devices, a slot server (if different from controller 300), another device, or a combination thereof.

Various databases that may be useful in one or more embodiments will be described below. Example structures and sample contents of the (i) an available negative credit balance database 325; and (ii) a negative play database 330 are shown in FIGS. 6A-6B and 7, respectively. The specific data and fields illustrated in these drawings represent only some embodiments of the records stored in the databases described herein. The data and fields of these databases can be readily modified, for example, to include more or fewer data fields. A single database also may be employed. Note that in the databases, a different reference numeral is employed to identify each field of each database. However, in at least one embodiment, fields that are similarly named (e.g., player identifier fields) may store similar or the same data in a similar or in the same data format.

Figure 4:
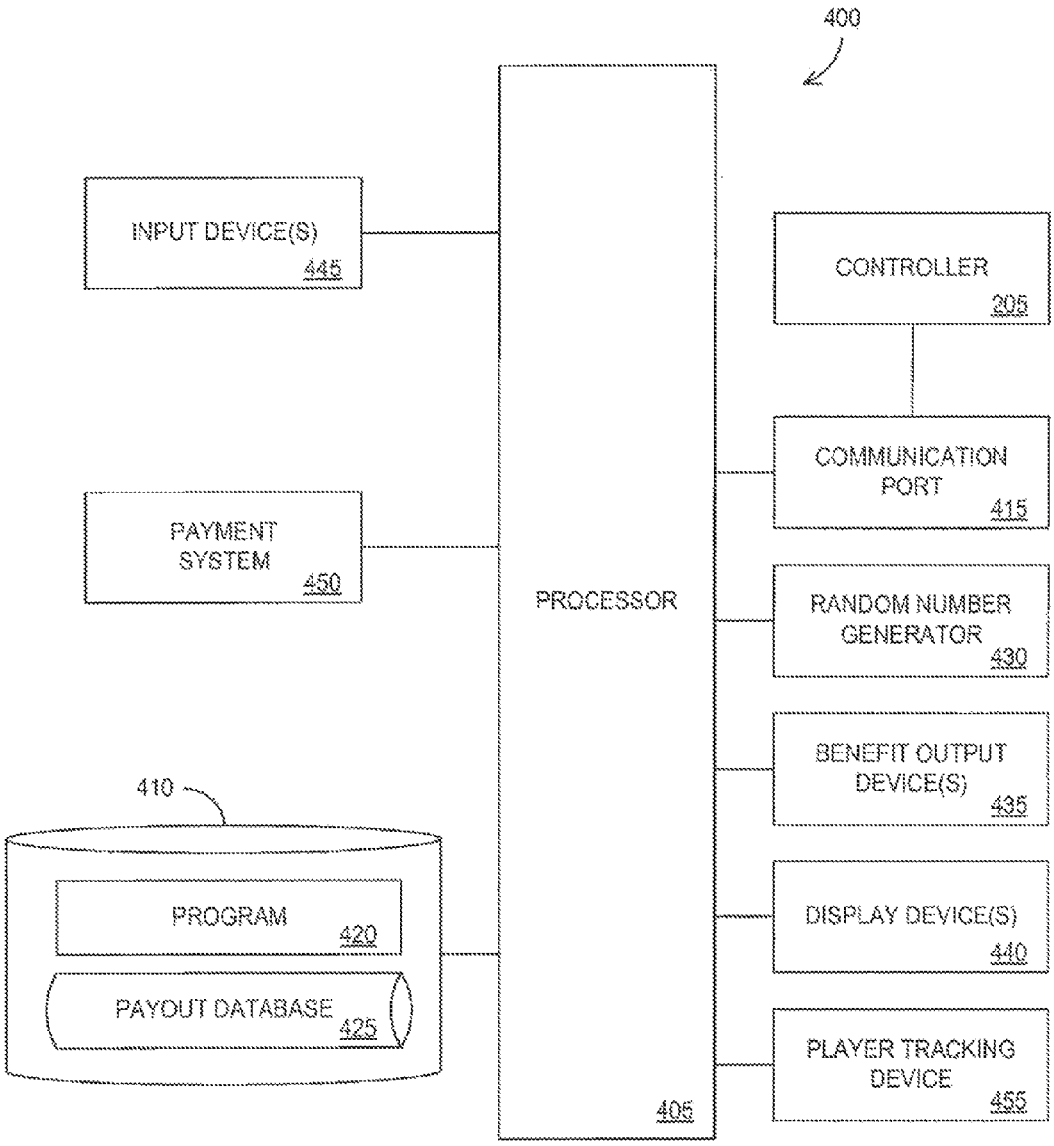
FIG. 4 is a block diagram illustrating a gaming device according to at least one embodiment.

Referring now to FIG. 4, illustrated therein is a block diagram of an embodiment 400 of a gaming device (e.g., a gaming device 210). The embodiment 400 is referred to herein as gaming device 400. The gaming device 400 may be implemented as a system controller, a dedicated hardware circuit, an appropriately programmed general-purpose computer, or any other equivalent electronic, mechanical or electro-mechanical device. The gaming device 400 may comprise, for example, a slot machine, a video poker terminal, a video blackjack terminal, a video keno terminal, a video lottery terminal, a pachinko machine or a device associated with a table-top game. In various embodiments, a gaming device may comprise, for example, a personal computer (e.g., which communicates with an online casino Web site), a telephone (e.g., to communicate with an automated sports book that provides gaming services), or a portable handheld gaming device (e.g., a personal digital assistant or Nintendo™ GameBoy™). In some embodiments, the gaming device 400 may comprise a device operable to facilitate a table game (e.g., a device operable to monitor a blackjack game, such as size of a player's wager, cards received and/or decisions made). In some embodiments, a portable user device (e.g., a wireless portable gaming unit, such as described with respect to FIG. 2, a PDA or cell phone) may be used in place of, or in addition to, some or all of the gaming device 400 components depicted in FIG. 4.

Further, a gaming device 400 may comprise a personal computer or other device operable to communicate with an online casino and facilitate game play at the online casino. In one or more embodiments, the gaming device 400 may comprise a computing device operable to execute software that simulates play of a reeled slot machine game, video poker game, video blackjack game, video keno game, video roulette game, or lottery game.

The example gaming device 400 comprises a processor 405, such as one or more Intel® Pentium® processors. The processor 405 is in communication with a memory 410 and a communication port 415 (e.g., for communicating with one or more other devices, such as with controller 205). The memory 410 may comprise an appropriate combination of magnetic, optical and/or semiconductor memory, and may include, for example. Random Access Memory (RAM), Read-Only Memory (ROM), a compact disc and/or a hard disk. The memory 410 may comprise or include any type of computer-readable medium. The processor 405 and the memory 410 may each be, for example: (i) located entirely within a single computer or other device; or (ii) connected to each other by a remote communication medium, such as a serial port cable, telephone line or radio frequency transceiver. In one embodiment, the gaming device 400 may comprise one or more devices that are connected to a remote server computer for maintaining databases.

The memory 400 stores a program 420 for controlling the processor 405. The processor 405 performs instructions of the program 420, and thereby operates in accordance with the present invention, and particularly in accordance with the methods described in detail herein. The program 420, as well as any other program for controlling a processor described herein, may be stored in a compressed, uncompiled and/or encrypted format. The description of program 420 applies equally to all programs for directing a processor described herein. The program 420 furthermore includes program elements that may be necessary, such as an operating system, a database management system and "device drivers" for allowing the processor 405 to interface with computer peripheral devices. Appropriate program elements are known to those skilled in the art, and need not be described in detail herein.

According to an embodiment, the instructions of the program 420 may be read into a main memory from another computer-readable medium, such from a ROM to RAM. Execution of sequences of the instructions in program 420 may cause processor 405 to perform one or more process steps described herein. In alternate embodiments, hard-wired circuitry may be used in place of, or in combination with, software instructions for implementation of the processes of the present invention. Thus, embodiments described herein are not limited to any specific combination of hardware and software.

The memory 410 may also store one or more databases. For example, memory 410 may store one or more of a probability database (not shown) and a payout database 425.

The fields of a probability database may specify, for example: (i) a random number (or range of random numbers) that may be generated by a random number generator; and (ii) an outcome that indicates the one or more indicia comprising the outcome that corresponds to the random number of a particular record. A gaming device 400 may utilize a probability database to determine, for example, what outcome corresponds to a random number generated by a random number generator and to display the determined outcome. The outcomes may comprise the three symbols to be displayed along the payline of a three-reel slot machine. Other arrangements of probability databases are possible. For example, the book "Winning At Slot Machines" by Jim Regan (Carol Publishing Group Edition, 1997) illustrates examples of payout and probability tables and how they may be derived. The entirety of this book is incorporated by reference herein for all purposes.

It should be noted that, in accordance with some embodiments, a probability of obtaining an outcome may be adjusted based on data associated with a negative credit balance, as is described in detail herein. For example, the more negative (i.e., the more below zero or another threshold amount) a credit balance is, the greater the probability of obtaining a particular outcome may become. For example, the probability of an outcome corresponding to a relatively high payout (e.g., a Royal Flush in a video poker game) may be adjusted such that it is more likely that the player obtain the outcome. Accordingly, in some embodiments one or more values of a probability database may be adjusted during play of a wagering game based on data associated with a negative credit balance. For example, a range of random numbers associated with an outcome may be either increased or decreased, depending on the desired effect on the probability of obtaining the outcome.

An example of a payout database 425 is described below with respect to FIG. 5.

In one or more embodiments, as described, data may be stored in a memory of another device (e.g., a database of controller 205 or a database of another server device). In one or more embodiments, gaming device 400 may be operable to access the data thereof or have information associated with the data stored therein downloaded to the gaming device as necessary and/or appropriate. For example, gaming device 400 may access a memory of another device to determine whether a credit balance is allowed to become negative (i.e., whether play of the gaming device is to be allowed even though allowing the continued play of the gaming device would result in a negative credit balance). Such a determination may be made, for example, based on data associated with the player, a session and/or one or more gaming devices.

Note that, although the payout database is described as being stored in a gaming device 400, in other embodiments some or all of this database may be partially or wholly stored (in addition to or in lieu of being stored in the memory 410 of the gaming device 400) in another device. Further, some or all of the data described as being stored in the payout database may be partially or wholly stored (in addition to or in lieu of being stored in the memory 410 of the gaming device 400) in a memory of one or more other devices.

The processor 405 is also operable to communicate with a random number generator 430, which may be a component of gaming device 400. The random number generator 430 (as well as any other random number generator described herein), in accordance with at least one embodiment, may generate data representing random or pseudo-random values (referred to as "random numbers" herein). The random number generator may generate a random number every predetermined unit of time (e.g., every second) or in response to an initiation of a game on the gaming device. In the former embodiment, the generated random numbers may be used as they are generated (e.g., the random number generated at substantially the time of game initiation is used for that game) and/or stored for future use.

A random number generator, as used herein, may be embodied as a processor separate from but working in cooperation with processor 405. Alternatively, a random number generator may be embodied as an algorithm, program component, or software stored in the memory of a gaming device or other device and used to generate a random number.

Note that, although the generation or obtainment of a random number is described herein as involving a random number generator of a gaming device, other methods of determining a random number may be employed. For example, a gaming device owner or operator may obtain sets of random numbers that have been generated by another entity. HotBits™, for example, is a service that provides random numbers that have been generated by timing successive pairs of radioactive decays detected by a Geiger-Muller tube interfaced to a computer. A blower mechanism that uses physical balls with numbers thereon may be used to determine a random number by randomly selecting one of the balls and determining the number thereof.

The processor 405 is also operable to communicate with a benefit output device 435, which may be a component of gaming device 400. The benefit output device 435 may comprise one or more devices for outputting a benefit to a player of the gaming device 400. For example, in one embodiment the gaming device 400 may provide coins and/or tokens as a benefit. In such an embodiment the benefit output device 435 may comprise a hopper and hopper controller, for dispensing coins and/or tokens into a coin tray of the gaming device 400.

In another example, the gaming device 400 may provide a receipt or other document on which there is printed an indication of a benefit (e.g., a cashless gaming receipt that has printed thereon a monetary value, which is redeemable for cash in the amount of the monetary value). In such an embodiment the benefit output device 435 may comprise a printing and document dispensing mechanism.

In yet another example, the gaming device 400 may provide electronic credits as a benefit (which, e.g., may be subsequently converted to coins and/or tokens and dispensed from a hopper into a coin tray). In such an embodiment the benefit output device 435 may comprise a credit balance meter and/or a processor that tracks and manages the amount of electronic credits that is indicated on a display of a credit balance. A credit balance display is described in detail below. The processor may be the processor 405 or another processor.

In yet another example, the gaming device 400 may credit a monetary amount to a financial account associated with a player as a benefit provided to a player. The financial account may be, for example, a credit card account, a debit account, a charge account, a checking account, and/or a casino account. In such an embodiment the benefit output device 435 may comprise a device for communicating with a server on which the financial account is maintained.

Note that, in one or more embodiments, the gaming device 400 may include more than one benefit output device 435 even though only one benefit output device is illustrated in FIG. 4. For example, the gaming device 400 may include both a hopper and hopper controller combination and a credit meter balance. Such a gaming device may be operable to provide more than one type of benefit to a player of the gaming device. A single benefit output device 400 may be operable to output more than one type of benefit. For example, a benefit output device 435 may be operable to increase the balance of credits in a credit meter and communicate with a remote device in order to increase the balance of a financial account associated with a player.

In some embodiments, a balance of credits may only be allowed to be cashed out or output to a player if it is above a certain threshold amount (e.g., above zero or an initial session balance). Such embodiments are described in detail herein. In such embodiments, a benefit output device may be disabled (or, alternately, may only be enabled or authorized to output a benefit) by a processor if the credit balance is not less than a predetermined amount (e.g., is not less than zero or an initial session balance).

The processor 405 is also operable to communicate with a display device 440, which may be a component of gaming device 400. The display device 440 may comprise, for example, one or more display screens or areas for outputting information related to game play on the gaming device, such as a cathode ray tube (CRT) monitor, liquid crystal display (LCD) screen, or light emitting diode (LED) screen.

In one or more embodiments, a gaming device 400 may comprise more than one display device 440. For example, a gaming device 400 may comprise an LCD display for displaying electronic reels and a display device that comprises a viewing window behind which are located mechanical reels and which displays the rotation of the mechanical reels during game play.

In one embodiment, a display device 440 may be operable to display a message to a player. For example, a message comprising an offer for a product or service offered by a casino or other merchant may be output.

The processor 405 may also be in communication with one or more other devices besides the display device 440, for outputting information (e.g., to a player or another device). Such other one or more output devices may also be components of gaming device 400. Such other one or more output devices may comprise, for example, an audio speaker (e.g., for outputting a message to a player, in addition to or in lieu of such a message being output via a display device 440), an infra-red transmitter, a radio transmitter, an electric motor, a printer (e.g., such as for printing cashless gaming vouchers), a coupon or product dispenser, an infra-red port (e.g., for communicating with a second gaming device or a portable device of a player), a Braille computer monitor, and a coin or bill dispenser. For gaming devices, common output devices include a cathode ray tube (CRT) monitor on a video poker machine, a bell on a gaming device (e.g., rings when a player wins), an LED display of a player's credit balance on a gaming device, an LCD display of a personal digital assistant (PDA) for displaying keno numbers.

The display device 440 may comprise, for example, one or more distinct display areas and/or one or more distinct display devices. For example, one of the display areas may display outcomes of games played on the gaming device (e.g., electronic reels of a gaming device). Another of the display areas may display rules for playing a game of the gaming device. Yet another of the display areas may display the benefits obtainable by playing a game of the gaming device (e.g., in the form of a payout table). Yet another of the display areas may display messages to the player. Yet another of the display areas may display session information to a player. In one or more embodiments, the gaming device 400 may include more than one display device, one or more other output devices, or a combination thereof (e.g., two display devices and two audio speakers). In one or more embodiments, the display device 435 may be operable to display a plurality of screens of information, which a player may navigate through as desired.

In one embodiment, the display device 440 is operable to output an indication of a credit meter balance. For example, the display device may comprise a display area of a credit meter peripheral device. In another example, the display device may comprise a touchscreen or other display on which game information (e.g., outcomes) is displayed in one area or screen while credit balance information is displayed in another area or screen.

As described, embodiments of the present invention encompass a negative credit balance. Accordingly, a display operable to output an indication of a credit balance may be adjusted or modified from that of a conventional display or meter such that it is operable to display an indication of a negative credit balance. For example, the display may be widened or otherwise re-sized to provide for the ability to display a hyphen, word or other indicator to indicate that the credit balance is negative and thus not be confused with a positive credit balance. Similarly, a process or instructions for tracking a credit balance may be modified to provide the ability to recognize and track a negative credit balance.

The processor 405 is also in communication with an input device 445, which is a device that is capable of receiving an input (e.g., from a player or another device) and which may be a component of gaming device 400. An input device may communicate with or be part of another device (e.g. a server, a gaming device, etc.). Some examples of input devices include: a bar-code scanner, a magnetic stripe reader, a computer keyboard or keypad, a button (e.g., mechanical, electromechanical or "soft", as in a portion of a touch-screen), a handle, a keypad, a touch-screen, a microphone, an infrared sensor, a voice recognition module, a coin or bill acceptor, a sonic ranger, a computer port, a video camera, a motion detector, a digital camera, a network card, a universal serial bus (USB) port, a GPS receiver, a radio frequency identification (RFID) receiver, an RF receiver, a thermometer, a pressure sensor, an infrared port (e.g., for receiving communications from with a second gaming device or a another device such as a smart card or PDA of a player), and a weight scale. For gaming devices, common input devices include a button or touch screen on a video poker machine, a lever or handle connected to the gaming device, a magnetic stripe reader to read a player tracking card inserted into a gaming device, a touch screen for input of player selections during game play, and a coin and bill acceptor. Input device 440 may comprise any of the above-described input device or any combination thereof (i.e., input device 440 may comprise more than one input device).

In some embodiments, a gaming device 400 may comprise components capable of facilitating both input and output functions (i.e., input/output devices). In one example, a touch-sensitive display screen comprises an input/output device (e.g., the device outputs graphics and receives selections from players). In another example, a processor may communicate with a "ticket-in/ticket-out" device configured to dispense and receive cash-out tickets. Such a device may also assist in (e.g., provide data so as to facilitate) various accounting functions (e.g., ticket validation and redemption). For example, any or all of a gaming device, kiosk and casino personnel device maintained at a cashier cage may (i) comprise such a benefit input/output device, and/or (ii) communicate with a central server that manages the accounting associated with such ticket-in/ticket-out transactions (e.g., so as to track the issuance, redemption and expiration of such tickets). One example of ticket-in/ticket-out technology that may be adapted or utilized to implement embodiments described herein is the EZ Pay™ system, is manufactured by International Gaming Technology, headquartered in Reno, Nev.

Of course, as would be understood by one of ordinary skill in the art, a gaming device 400 may comprise various combinations of any or all of the component devices described herein. For example, in one or more embodiments, the gaming device may include more than one display device, one or more other output devices, several input devices, and so on (e.g., two display screens, two audio speakers, a headset, a ticket-in/ticket-out device and several buttons).

The processor 405 is also in communication with a payment system 450, which may be a component of gaming device 400. The payment system 450 is a device capable of accepting payment from a player (e.g., a bet or initiation of a balance) and/or providing payment to a player (e.g., a payout). Payment is not limited to currency, but may also include other types of consideration, including products, services, and alternate currencies. Payment system 450 may be considered to be an example of an input device 240A in some embodiments.

Exemplary methods of accepting payment by the payment system 450 include (i) receiving hard currency (i.e., coins or bills), and accordingly the payment system 450 may comprise a coin or bill acceptor; (ii) receiving an alternate currency (e.g., a paper cashless gaming voucher, a coupon, a non-negotiable token), and accordingly the payment system 450 may comprise a bar code reader or other sensing means; (iii) receiving a payment identifier (e.g., a credit card number, a debit card number, a player tracking card number) and debiting the account identified by the payment identifier; and (iv) determining that a player has performed a value-added activity.

Processor 405 may also be in communication with a player tracking device 455, which may be a component of gaming device 400. Player tracking device 455 may, in some embodiments, be considered an example of an input device 440. Player tracking device 455 may, in one or more embodiments, comprise a reader device operable to read information from and/or write information to a card such as a smart card and/or a player tracking card, such that (i) players may be identified, and (ii) various data associated with players may then be determined. For example, previous wagering, coin-in and/or cash-out behaviors previously engaged in by the player may be determined based on information associated with the player identifier. In another example, previous strategies employed in a video poker game may be similarly determined. In yet another example, an indication of a session previously purchased and/or currently active as associated with a player may be determined. In yet another example, data associated with a negative credit balance as it relates to a player may be determined (e.g., how many times a player has played a wagering game while a credit balance associated with play of the game has been negative, a magnitude of a negative credit balance currently and/or previously associated with the player, an average duration of time during a session that a player has played while a credit balance associated with the session has been negative, etc.). Similarly, a number of cashable credits available to the player may be determined, a number of promotional credits that may not be redeemed for cash but that are associated with the player may be determined, a code or other indication of a benefit to be provided to the player may be determined, a number of accumulated loyalty points associated with the player may be determined, a number of accumulated game elements such as symbols, cards or hands associated with the player may be determined, a status or ranking of a player may be determined, whether a player qualifies to be allowed to play while a credit balance is negative may be determined, a maximum allowable negative credit balance to allow for the player may be determined, etc.

In one example, a card reader device comprising a player tracking device 455 may determine an identifier associated with a player (e.g., by reading a player tracking card comprising an encoded version of the identifier), such that the gaming device may then access data (e.g., of a player database, a session database) associated with the player. In another example, a smart card reader device may determine data associated with a player directly by accessing a memory of an inserted smart card.

As described in more detail below, a player database may be used, for example, to store player wager data (e.g., such that players wagering over a given threshold in a given amount of time may be rewarded for their patronage, qualify for certain features, be allowed to play a game with a negative credit balance, and so on). The player database may also contain other information that may be useful in, for example, promoting and managing player behaviors (e.g., information about the player's gaming preferences, lodging arrangements, and the like). Further, the player database may store data regarding a given player's standing in a game session and/or a bonus game and/or a current state or magnitude of a credit balance. Such player data may be stored in a relational database and retrieved or otherwise accessed by the processor after receiving a "key" data point from the player, such as a unique identifier read from the player's player tracking card or cashout ticket.

In one embodiment, the player tracking device 455 may comprise (i) a card reader (e.g., a port into which player tracking cards may be inserted), (ii) various input devices (e.g., a keypad, a touch-screen), (iii) various output devices (e.g., a small, full-color display screen), and/or (iv) combinations thereof (e.g., a touch-sensitive display screen that accommodates both input and output functions). Various commercially available devices may be suitable for such an application, such as the NextGen™ interactive player tracking panel manufactured by IGT or the iVIEW display screen manufactured by Bally® Gaming and Systems.

As known in the art, "smart cards" may incorporate (i) a memory, and (ii) means for accessing such a memory. For example, in one embodiment, the memory may store data related to aspects of the present invention. In one embodiment, data may be written to the smart card as a player plays one or more gaming devices (e.g., such that various data may be updated on a continuous, periodic or event-triggered bases). Accordingly, in one or more embodiments one or more devices operable to carry out various processes of the present invention (e.g., a gaming device 400 or controller 205) may have associated therewith a smart card reader device, such that data may be read from the smart card pursuant to the execution of such processes. An example of a smart card system that may be used to implement one or more embodiments of the present invention is the s-Choice™ Smart Card Casino Management System from Smart Card Integrators, Inc.™.

Of course, other non-card-based methods of identifying players are contemplated. For example, a unique identification code may be associated with the player. The player may then be identified upon entering the code. For example, the code may be stored (e.g., within a database maintained within a gaming device 210 or controller 205) such that the player may enter the code using an input device of a gaming device, and accordingly allow the player to be uniquely identified. In other embodiments, player biometrics may serve as identification means (e.g., a player is identified via a thumbprint or retinal scan of the player). In further embodiments, a barcode of a cashless gaming ticket may encode a player identifier.

Thus, as described, various data associated with a player may be tracked and stored (e.g., in an appropriate record of a centrally-maintained database), such that it may be accessed as desired (e.g., when determining whether the player qualifies as a problem gambler). Further, various statistics may be measured in association with a player (e.g., coin-in statistics, win/loss statistics, buy-in amount for a session) and similarly accessed.

Various systems for facilitating such monitoring of player behavior and activity are contemplated. For example, a two-wire system such as one offered by International Gaming Systems (IGT) may be used. Similarly, a protocol such as the IGT SAS™ protocol or the IGT SuperSAS™ protocol may be used. The SAS™ protocol and the SuperSAS™ protocol each allows for communication between gaming machines and slot accounting systems and provides a secure method of communicating all necessary data supplied by the gaming device to the online monitoring system. One aspect of the SAS™ protocol and the SuperSAS™ protocol that may be beneficial in implementing aspects of the present invention is the authentication function which allows operators and regulators to remotely interrogate gaming devices for important memory verification information, for both game programs, and peripheral devices. In another example, a one-wire system such as the OASIS™ System offered by Aristocrat Technologies™ or the SDS slot-floor monitoring system offered by Bally Gaming and Systems™ may be used. Each of the systems described above is an integrated information system that continually monitors slot machines and customer gaming activity. Thus, for example, any one of these systems may be used to monitor a player's gaming activity in order to determine player outcomes, buy-in amounts, coin-in statistics, win/loss statistics and/or any other data deemed relevant.

In one embodiment, a player may operate a plurality of gaming devices. For example, a player may simultaneously play two side-by-side gaming devices, a player may play one gaming device (e.g. a gaming device) and then continue his gaming session at another gaming device (e.g. a video poker machine), and a player may remotely operate a gaming device, possibly by using a telephone, PDA or other device (i) to transmit commands (directly or indirectly) to the gaming device, such as wager amounts and commands to select certain cards; and/or (ii) to receive output (directly or indirectly) from the gaming device.

In one embodiment, a gaming device may allow a player to play a game of skill rather than a game of chance. Such an embodiment may be more appealing to certain players or may be permitted in areas where it is illegal to gamble on games of chance.

In one embodiment, gaming device 400 may be operable to facilitate downloadable games such that games available for play on gaming device 400 may be stored on a server device (e.g., controller 205 or another dedicated device) and downloaded to the gaming device 400. In one embodiment, software components of the gaming device 400 may be remotely modified and/or updated by another device (e.g., controller 205 or another device). For example, a payout or probability table stored in the memory of gaming device 400 may be altered, modified or updated remotely, hot fixes may be applied to software stored by the gaming device 400 and/or new versions of software may be downloaded to the gaming device 400. Similarly, the gaming device 400 may be programmed to retrieve any or all such updates from another device, as appropriate and preferred. Any of the above (e.g., downloading of a game, updating of software, modification of a payout or probability table) may occur, for example, based upon an occurrence of an event (e.g., a scheduled event), an indication being received from qualified casino personnel or other personnel (e.g., a regulator), and/or upon a request from a player. In one embodiment, gaming device 400 may comprise a thin client device controlled be a server device (e.g., controller 205 or another dedicated device).

In one or more embodiments, aspects of the present invention, such as determining whether to allow a negative credit balance and authorizing a negative credit balance, may be practiced by replacing and/or augmenting one or more components (e.g., hardware and/or software components) of an existing gaming device. Thus, in one or more embodiments, the invention may be applied as a retrofit or upgrade to existing gaming devices currently available for play within various casinos.

For example, a memory (e.g., computer chip) of the gaming device may be replaced or added, the replacement or additional memory storing a program for instructing the processor of the gaming device to operate in accordance with one or more embodiments. In another example, data output via the gaming device (e.g., graphical and/or textual data displayed on the gaming device) may be replaced or added, the replacement or additional data indicating to a player information relevant to one or more aspects of the present invention.

In a specific example, a gaming device may comprise various electronic components mounted to one or more printed circuit boards (PCBs). Such components may include various hardware described herein, such as a communications port and various controllers of peripheral devices (e.g., a display controller), as well as a memory for storing programming instructions (software) and a processor for carrying out such instructions. Forms of memory that may be found in a gaming device include electronically erasable programmable read-only memory (EEPROM), erasable programmable read-only memory (EPROM) and flash memory. Thus, in one or more embodiments of the present invention, an EPROM storing software with instructions for carrying out aspects of the present invention (as well as instructions for carrying out other functions traditionally performed by the gaming device) may replace an EPROM previously installed in a gaming device or may be reprogrammed in accordance with one or more embodiments described herein, such that the gaming device may be configured to operate in accordance with various processes described herein.

For example, a "negative credit balance" module may be made available for purchase to various casino operators. The module, which may comprise various hardware and software (e.g., an EEPROM storing software instructions), may be installed in an existing gaming device (e.g., a video-reel slot machine, a video poker machine, etc.), such that when the module is installed, players of the device may elect (i) to play the gaming device in a manner that does not incorporate embodiments described herein, or (ii) to play the gaming device in a manner that incorporates embodiments described herein (e.g., be able to manage a negative credit balance). Thus, players who are familiar with operating a gaming device may elect to pay for them in a different or similar manner as they are accustomed to.

Similarly, in addition to or in lieu of a player being able to select a mode of operation of the gaming device, in some embodiments a casino operator may be able to do so. For example, a casino operator may be able to select whether the gaming device is to operate in a conventional mode or in a "negative credit balance" mode.

Accordingly, a gaming device may be configured to allow a player, casino operator or other entity to select one of at least two "modes" of the gaming device, and to enable the selected mode. If a "standard" mode is selected, the gaming device may be configured to operate in a manner similar to how it operated before the installation of the module (e.g., the gaming device operates in a conventional manner, such that embodiments described herein may not be utilized). If a "negative credit balance" mode is selected, the gaming device may then be operable to execute game play in accordance with one or more embodiments described herein.

In one example of allowing an entity to select one or more modes, a touch-sensitive display screen may be configured to output a prompt to select a mode of operation. Such a prompt may be output in occurrence to various trigger conditions (e.g., coins, bills or tickets are inserted; a credit balance increases from zero to some other number, a player presses a "play" button; a motion, weight, infrared or other sensor detects the presence of a player; the gaming device being turned on, initiated, re-configured and/or rebooted, etc.). Accordingly, an entity may select a mode of operation (e.g., by pressing an appropriately labeled icon of a touch-sensitive display screen), and upon receiving the entity's selection, the gaming device may be configured to operate in the selected mode.

In another embodiment, a gaming device may be operable to automatically determine whether it should switch modes from a standard mode to a "negative credit balance" mode. A gaming device may perform such a determination, for example, by evaluating data received from a player and/or another device and/or by querying another device. For example, a gaming device may be programmed to determine (e.g., upon receiving a player identifier and based upon the player identifier) whether the player currently playing the gaming device qualifies for a negative credit balance mode.

In one embodiment, a gaming device may be operable to output an indication that it is currently in "negative credit balance" mode (e.g., to inform a player that the current play of the gaming device may result in a negative credit balance). For example, the gaming device may turn on a light, change graphics, output a sound, etc.

In other embodiments, as described herein, a peripheral device may be useful for implementing one or more embodiments of the present invention into the operation of a conventional gaming device. For example, in order to avoid or minimize the necessity of modifying or replacing a program already stored in a memory of a conventional gaming device, an external or internal module that comprises a peripheral device may be inserted in, connected to or otherwise associated with the gaming device. Such a peripheral device may be operable to, for example, monitor and/or transmit information about a player's gambling activity at the gaming device to another device (e.g., controller 205). The peripheral device may monitor and/or transmit such information to enable a determination of whether a player qualifies to operate the gaming device in a negative credit balance mode.

In one embodiment, a peripheral device may comprise a display device operable to output an indication of a negative credit balance.

In still further embodiments, rather than configure existing gaming devices to execute embodiments described herein by installing or connecting new hardware and/or software, software may be downloaded into an existing memory of one or more gaming devices. U.S. Pat. No. 6,805,634 to Wells et al. teaches methods for downloading data to gaming devices in such a manner. The entirety of U.S. Pat. No. 6,805,634 is incorporated by reference herein for all purposes. Thus, in some embodiments, an existing gaming device may be reprogrammed to accommodate new functionality of the present invention without the need, or by minimizing the need, to remove and replace hardware within the gaming device.

Turning now to a description of databases that may be used to implement one or more embodiments, example embodiments of the databases 325, 330 and 415 are described in detail below and example structures are depicted with sample entries in the accompanying figures. As will be understood by those skilled in the art, the schematic illustrations and accompanying descriptions of the sample databases presented herein are exemplary arrangements for stored representations of information. Any number of other arrangements may be employed besides those suggested by the tables shown. For example, even though three separate databases are illustrated, the invention could be practiced effectively using one, two, four, five or more functionally equivalent databases. Similarly, the illustrated entries of the databases represent exemplary information only; those skilled in the art will understand that the number and content of the entries can be different from those illustrated herein. Further, despite the depiction of the databases as tables, an object-based model could be used to store and manipulate the data types of the present invention and likewise, object methods or behaviors can be used to implement the processes of the present invention. Further still, a memory scheme alternate to a database scheme may be used to store and access data. For example, a hierarchical file structure scheme may be used.

It should also be noted that some or all of the data or types of data illustrated in FIGS. 5, 6A-6B and 7 may be stored and managed in individual ones of the gaming devices 210 and may be used therein to manage, control and/or monitor events at the one or more gaming devices.

Referring now to FIG. 5, illustrated therein is a table 500 of an example payout database 415, in accordance with one embodiment. The table 500 is referred to as payout database 500 herein. The payout database 500 includes a plurality of records or entries, each defining a payout corresponding to a possible outcome of a wagering game. For each record or entry, the payout database 500 specifies, (i) an outcome 505, which indicates the one or more indicia comprising a given outcome; (ii) a payout 510 that corresponds to each respective outcome; (iii) a current credit balance 515 that reflects the credit balance at a given time; and (iii) a resulting credit balance 520 that will result upon obtainment of the corresponding outcome (i.e., the credit balance that will result by adding the payout corresponding to the outcome and the current credit balance at the time the outcome is obtained).

For purposes of illustrating a simple example, the current credit balance is zero and thus the resulting credit balance for each outcome is equal to the payout amount. However, it should be understood that the resulting credit balance is adjusted upon an adjustment of the current credit balance. It should further be understood that the current credit balance may be adjusted, for example, in response to (i) an input of a monetary amount by a player to the gaming device; (ii) a placement of a wager by the player; and/or (iii) a win of a payout by the player. For example, if a current credit balance changes from "0" to "−5" credits (e.g., due to a placement of a five credit wager by a player playing the gaming device 400), the resulting credit balance that corresponds to the outcome "cherry-any-any" would be adjusted from "2" to "−3" to reflect that if the outcome "cherry-any-any" were to be obtained by a player at a time at which the current credit balance is equal to "−5 credits", the resulting balance would be "−3" credits (since [(−5)+2=(−3)]).

The data of the payout database 500 may be output to a player of gaming device 400 via a display (e.g., via a payout schedule output to a player via a display of the gaming device 400). Outputting the resulting credit balance as it corresponds to each possible outcome may be helpful to players, to aid them in understanding how a win of a particular payout will affect the current credit balance. Applicants have recognized that it may be confusing or distracting to some players to perform a summation of a current credit balance with a payout, particularly if the current credit balance is negative. Outputting a payout schedule based on data such as the data in payout database 500 may circumvent any confusion a player may otherwise experience in such a circumstance.

Of course, a payout database that does not include either the current credit balance field 515 or the resulting credit balance field 520 may also be used by a gaming device.

A gaming device 400 may utilize a payout database to determine whether a payout should be output to a player as a result of an outcome obtained for a game. For example, after determining the outcome to output on the gaming device, the gaming device may access the payout database to determine whether the outcome for output is one of the outcomes stored as corresponding to a payout. If it is, the gaming device may provide the corresponding payout to the player via a benefit output device described herein. Other arrangements of payout databases are possible. For example, the book "Winning At Slot Machines" by Jim Regan (Carol Publishing Group Edition, 1997), previously incorporated by reference, illustrates many examples of payout and probability tables and how they may be derived.

In one or more embodiments, a payout associated with an outcome may be adjusted based on data associated with a negative credit balance. For example, a payout corresponding to a particular outcome may be increased if a credit balance is more than a predetermined amount below zero or another threshold credit balance. Accordingly, in some embodiments a value in the payout database may be adjusted based on data associated with a negative credit balance.

In some embodiments, an adjustment to a value of a payout database based on data associated with a credit balance may comprise an adjustment to a value other than a payout. For example, as described in detail above, a value of a resulting credit balance that may be achieved upon obtaining a particular outcome may be adjusted based on a value of a current credit balance.

Referring now to FIG. 6A, illustrated therein is a table 600 of an example allowable negative credit balance database 325, in accordance with at least one embodiment. Table 600 is referred to as allowable negative credit balance database 325 herein. Allowable negative credit balance database 325 stores a plurality of records or entries, each record or entry defining a condition which, if met, allows a player to play a gaming device even when a credit balance of a gaming device is negative. Each record or entry further defines a maximum negative credit balance corresponding to each condition.

As described herein, in one embodiment a determination of whether to allow a negative credit balance may be based on a consideration of one or more factors. In some embodiments, such a factor may be information associated with a player. Database 600 illustrates one embodiment of how information associated with a player may be affect a determination of whether to allow a negative credit balance and, further, a maximum negative credit balance to allow.

In accordance with some embodiments, a gaming device may be operable to support a negative credit balance but may only allow a negative credit balance (or only allow a negative credit balance up to a maximum amount) if a particular condition is satisfied. Thus, table 600 includes, for each record or entry (i) an allowable negative credit balance 605, which may define a maximum or range of negative credits that correspond to a particular condition; and (ii) a condition(s) corresponding to each allowable negative credit balance.

The table 600 also specifies a gaming device identifier 615 that identifies (e.g., uniquely) the gaming device to which the condition(s) and allowable negative credit balances apply. Of course, rather than a gaming device, the conditions and allowable credit balances may be categorized (if at all) based on another factor, such as a particular game, type of game, player, session, etc. However, consistent with the embodiment of FIG. 6A, each of the conditions defined in the allowable negative credit balance database 600 corresponds to a particular gaming device 615. Thus, a controller 205 may store an allowable negative credit balance database 600 for each gaming device operable to support a negative credit balance under certain conditions. Alternately, each gaming device operable to support a negative credit balance under certain conditions may store such a database.

As described, the example conditions illustrated in the allowable negative credit balance database 600 comprise conditions related to a player. For example, as the first record indicates, the determination may be based on whether a player has inserted a player tracking card. As the remaining records illustrate, a further determination of a magnitude of the maximum negative credit balance to allow may be based on a status, ranking or tier of a player. In the embodiment of FIG. 6A, the higher the status, ranking or tier of the player, the higher the maximum allowable negative credit balance may be. Such a status, ranking or tier may be stored in a player database in association with a player identifier. Such a status, ranking or tier may be based on, for example, wagering activities of a player (e.g., average wager, average amount wagered per casino visit, theoretical win, historical win, gaming devices or types of gaming devices preferred, games or types of games preferred, betting patterns or strategies, credit line available, frequency of visits to a casino, etc.). In some embodiments, such a status, ranking or tier may be based on other information. For example, a player's status as a registered casino hotel guest, financial situation, average restaurant bill and/or demographic information may be taken into account.

Referring now to FIG. 6B, illustrated therein is a table 650, an example of an allowable negative credit balance database 425 in accordance with another embodiment. Table 650 is referred to herein as allowable negative credit balance database 650. Database 650 illustrates that, in accordance with some embodiments, a determination of whether to allow a negative credit balance may be based on a factor distinct from information associated with a player. Such a factor, as illustrated in the example data of database 650, may be information associated with a session. Thus, the example conditions illustrated in FIG. 6B are conditions relating to session.

The database 650 includes a number of example records or entries, each defining a condition which, if satisfied, would result in a negative credit balance being satisfied. For each record or entry, there is specified (i) a session identifier 655 that (e.g., uniquely) identifies a session; (ii) an allowable negative credit balance 660 that specifies a negative credit balance maximum or range that is allowable for the session if the corresponding condition(s) are satisfied; and (iii) condition(s), if any, that must be satisfied in order for the corresponding negative credit balance to be allowed. It should be noted that it is envisioned that for some sessions any negative credit balance will be allowed (i.e., there is no maximum or minimum negative credit balance) and that no conditions need be satisfied prior to allowance of the negative credit balance.

In some embodiments, as described herein, more than one factor may be taken into account when determining whether to allow a negative credit balance. Thus, in one example, both information associated with a player and information associated with a session may be taken into account to determine whether to allow a negative credit balance. Thus, in such an example, both the database 600 and the database 650 may be accessed to determine whether to allow a negative credit balance (or, alternately, the data illustrated as stored in the individual databases may be combined into a single database).

Of course, in other embodiments a gaming device may be operable to support a negative credit balance irrespective of any condition being satisfied or if a single required condition is satisfied (e.g., if the gaming device is currently operating in "Negative Credit Mode", if the gaming device is currently executing a session purchased by a player, etc.). Accordingly, in some embodiments there may be no need for an allowable negative credit balance database such as that depicted in FIG. 6A or 6B. For example, a gaming device may be programmed to determine whether to allow a negative credit balance via a query (e.g., "session play? if yes, allow negative credit balance") that takes into account a status of the gaming device without accessing a database of stored information.

In some embodiments a maximum negative credit balance may not be stored or applied. In other words, a negative credit balance may be allowed (e.g., if one or more conditions are satisfied), but no maximum negative credit balance may govern the allowance of the negative credit balance.

Referring now to FIG. 7, illustrated therein is a table 700 of an example negative play database 330. Table 700 is referred to herein as negative play database 700. Negative play database 700 includes a number of records or entries, each record or entry defining negative credit balance information related to a particular session engaged in by a particular player. For each record or entry, the database 700 specifies (i) a session identifier that identifies (e.g., uniquely) a session purchased and engaged in by the player identified in field 705; (ii) a session begin/end 715 that indicates a time at which the corresponding session began and the time at which the corresponding session ended; (iii) a time elapsed while negative 720 that indicates a duration of time during which a credit balance was negative during the corresponding session (iv) a number of game plays while negative 725 that indicates a number of game plays that were executed (whether consecutive or not) during the corresponding session while the credit balance was negative; and (v) an amount wagered while negative 730 that indicates a sum of wagers placed while the credit balance of the corresponding session was negative.

Information such as that illustrated in negative play database 700 may be used, for example, to determine (i) whether to allow a negative credit balance; (ii) a status, ranking or tier of a player; (iii) a retail price for a session; (iv) a maximum allowable negative credit balance to allow for a player and/or session; or (v) any combination thereof.

Following is a description of FIGS. 8-12. Each of these figures illustrates various example information that may be output to a player of a gaming device (e.g., via a display of the gaming device), to output information related to a negative credit balance.

Figure 8:
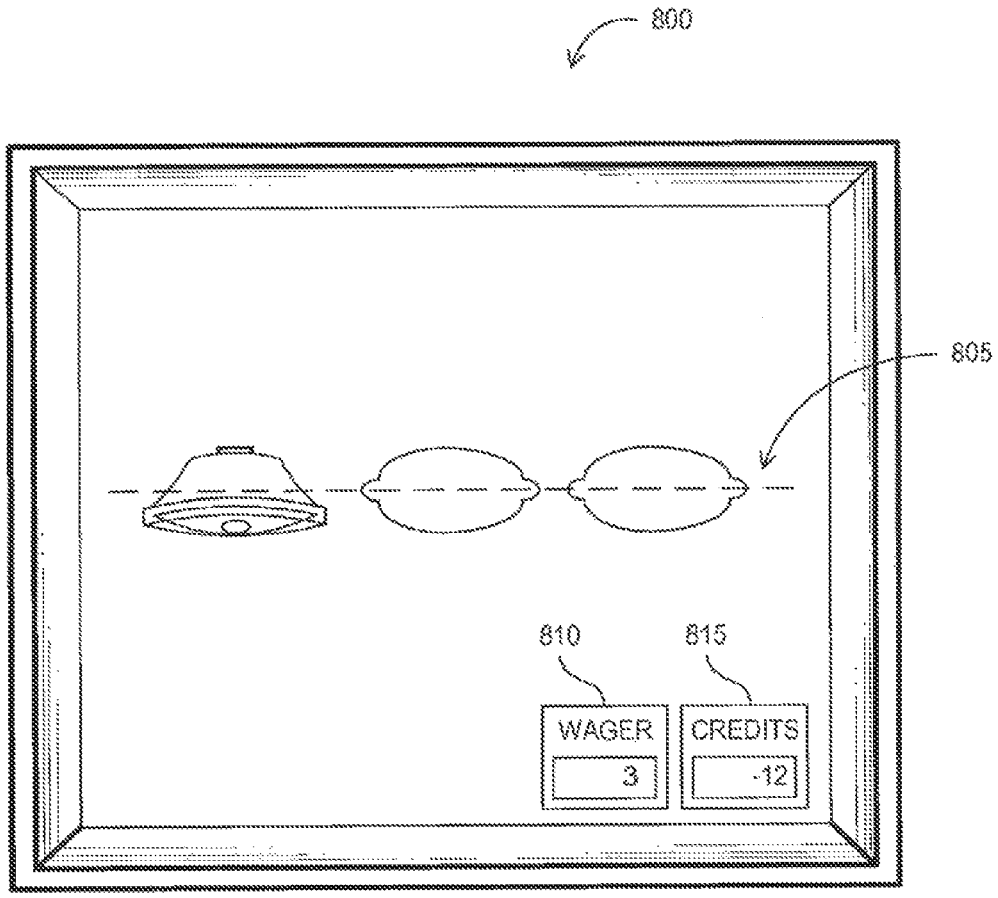
FIG. 8 is an illustration of an exemplary gaming device display screen output.

Referring now to FIG. 8, illustrated therein is a screen 800. Screen 800 depicts example of information relating to a negative credit balance that may be output to a player (e.g., via a display device 440), in accordance with one embodiment. In conventional gaming devices it is common to display an indication of an available balance of credits and a wager amount in an area of a screen used to display outcome information. For example, in a video slot machine, it is not uncommon to display an outcome via a video screen and, along the bottom of the screen, output an indication of a wager amount and an available number of credits with which a player may place additional wagers. Thus, Applicants envision that a similar portion of such a screen may be utilized to output an indication of a credit balance even when the credit balance is negative. Thus, area 805 of screen 800 depicts an outcome along a payline of a video slot machine, area 810 depicts an amount of a wager currently being placed, and area 815 depicts a negative credit balance, thus conveying to a player that even though the player currently has less than zero credits, the player can still continue to place wagers and the amount of those wagers will continue to be deducted from the credit balance. It should be noted that, should the player win a payout, the number of credits corresponding to the payout will be added to the credit balance and, if the number of credits corresponding to the payout is sufficiently large, the resulting credit balance will no longer be negative.

Figure 9:
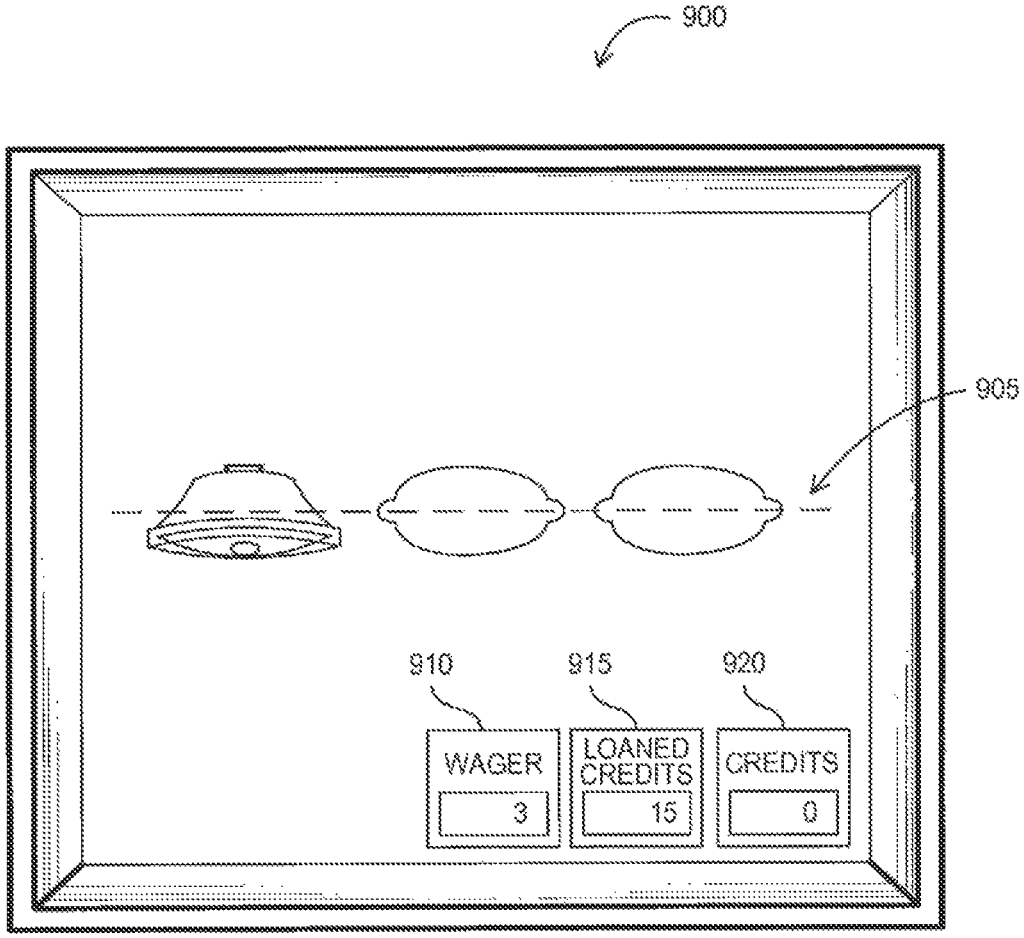
FIG. 9 is an illustration of an exemplary gaming device display screen output.

Referring now to FIG. 9, illustrated therein is a screen 900. Screen 900 also depicts example information relating to a negative credit balance that may be output to a player, in accordance with an embodiment. As described herein, an alternate method of tracking a negative credit balance is to track two distinct credit balances, one of which offsets the other at time of cashout. Thus, in one example of such an embodiment, once a player's credit balance reaches zero, additional credits may be loaned to the player to allow the player to continue playing the gaming device. At time of cashout, such loaned credits may be deducted from conventional credits to determine a number of credits available for cashout. Additionally, if a player having a balance of loaned credits wins a payout of credits, such won credits may be applied against the loaned credits prior to being added to the cashable credits. Such embodiments are described in more detail herein.

Screen 900 may be utilized in at least some embodiments utilizing loaned credits, to convey a number of credits loaned to a player. Screen 900 depicts (i) an area 905 of a video slot machine in which an indication of an outcome is displayed along a payline, (ii) an area 910 in which an amount currently being wagered is displayed, (iii) an area 915 in which an amount of loaned credits is displayed, and (iv) an area 920 in which an amount of cashable credits is displayed.

It should be noted that although each of FIGS. 8 and 9 depict a negative credit balance information in an area of a screen also used to output an outcome (e.g., an outcome of a slot machine game), the invention is not so limited. For example, (i) a separate screen or menu of a display device may be utilized to display such information, (ii) a different location of a screen for outputting an outcome may be used; and/or (iii) a display of a peripheral or accessory device (e.g., a credit meter module) may be used.

Figure 10:
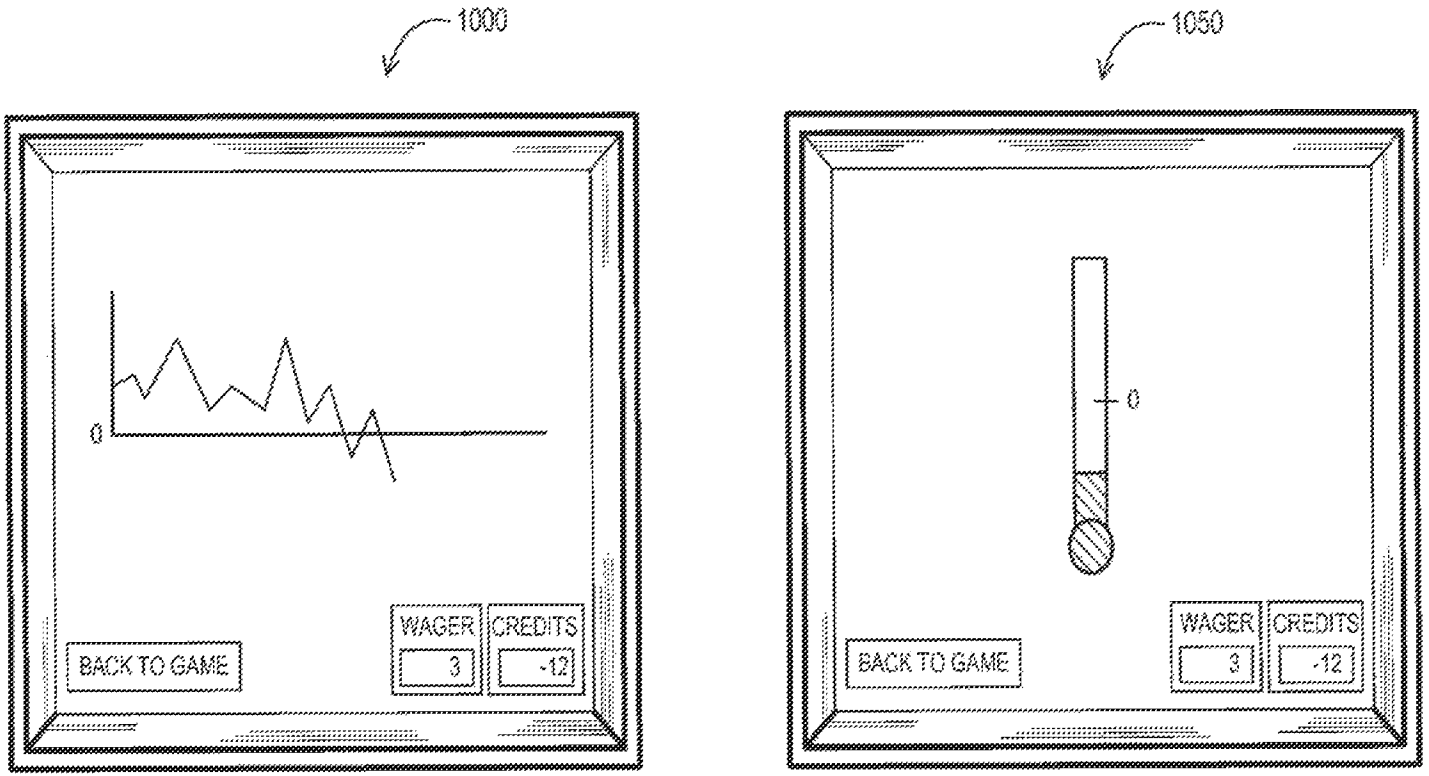
FIG. 10 is an illustration of an exemplary gaming device display screen output.

Referring now to FIG. 10, illustrated therein is a screen 1000 and a screen 1050, either or both of which may be used to output an indication of a negative credit balance in an alternate form. For example, a screen such as screen 1000 and/or screen 1050 may be available for access to a player via a menu of options of a gaming device. The player may access such a screen to view an indication of a negative credit balance (whether a current negative credit balance or history of a credit balance, including when it was negative).

For example, screen 1000 depicts a history of a credit balance (e.g., for a particular session) in graph form, thus visualizing for a player a trend of the credit balance over the duration of the session. It should be noted that screen 1000 also includes an indication of a current credit balance and an indication of a current wager amount.

Screen 1050, on the other hand, depicts a current credit balance in two different forms: as a numeral indicating the number of negative credits available and as a thermometer having a currently negative reading.

Figure 11:
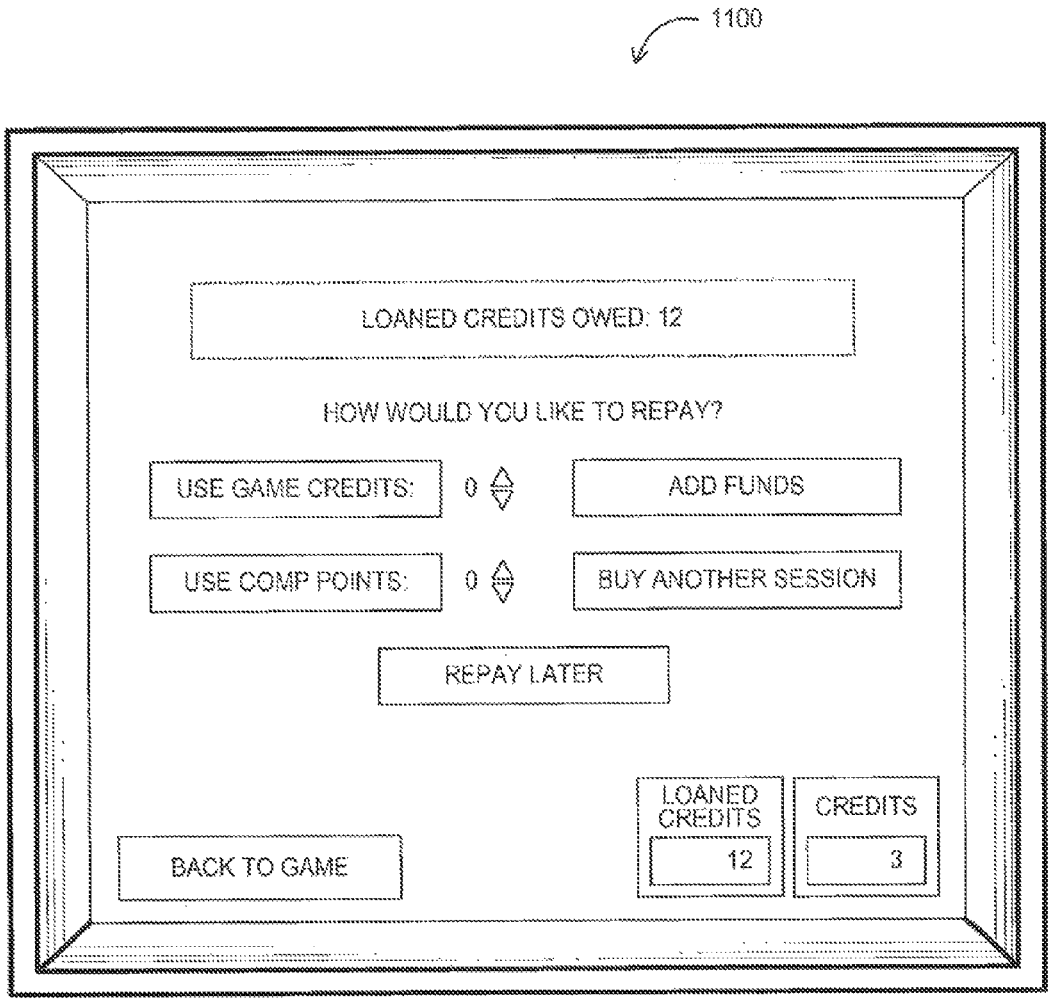
FIG. 11 is an illustration of an exemplary gaming device display screen output.

Referring now to FIG. 11, illustrated therein is a screen 1100 that may be output to a player during a reconciliation process during which a player repays loaned credits. In some embodiments, a gaming device may be configured to output one or more display or menu screens designed to facilitate a reconciliation process for loaned credits. For example, as illustrated in FIG. 11, in one embodiment, a player may utilize a touch-screen to select any or all of a method of repayment (e.g., "game credits" or "comp points"), an amount to be repaid in association with a method, and so on. It should of course be appreciated that the functionality exhibited by such a singular screen may be spread throughout a plurality of such screens (e.g., players are stepped through a series of screens), and that further such screens may be necessary to complete a reconciliation process (e.g., after selecting an "add funds" option, a separate screen displays an indication of funds added as a player inserts cash, coins, and so on).

Figure 12:
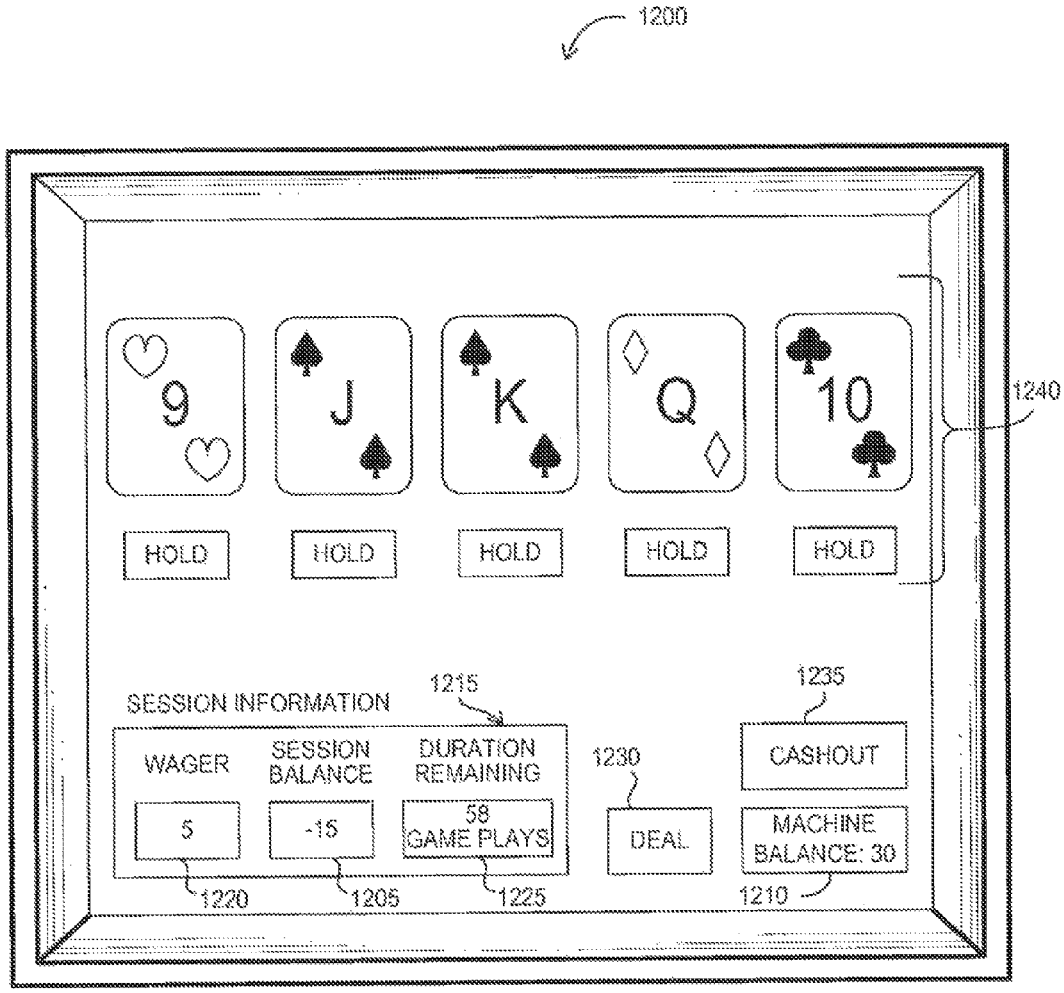
FIG. 12 is an illustration of an exemplary gaming device display screen output.
Figure 13:
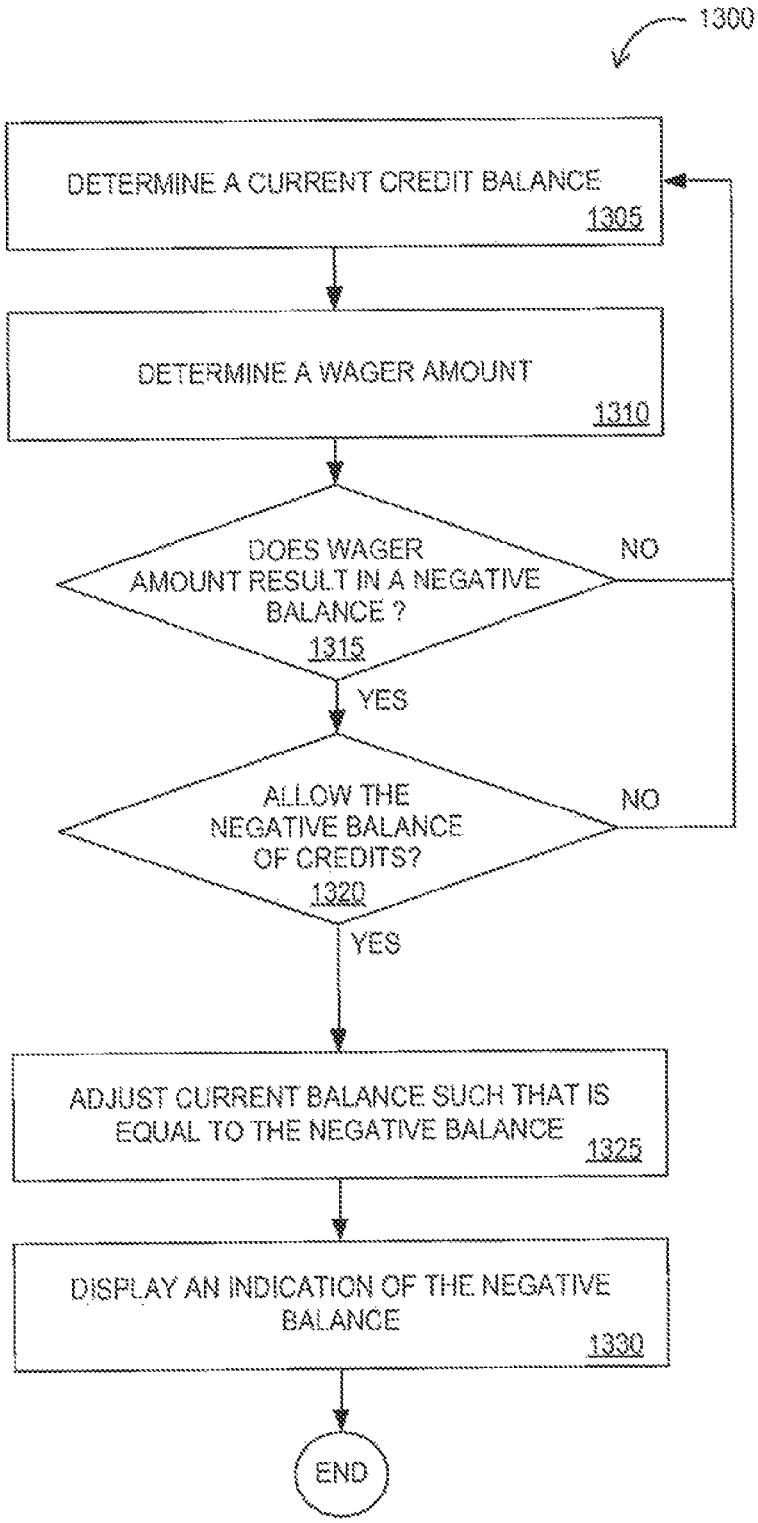
FIG. 13 is a flow chart illustrating a process for adjusting a balance such that it results in a negative balance according to some embodiments of the present invention.

Referring now to FIG. 12, illustrated therein is a screen 1200 illustrating two separate balances: a session balance 1205 and a machine balance 1210. The machine balance 1210 indicates a number of credits available to the player for play of the gaming device in general while the session balance 1205, as part of session information 1215, indicates a number of credits available to the player for play of a session. In some embodiments, only the session balance may be allowed to become negative (e.g., during the execution of the game plays of the session).

In some embodiments, as described, a gaming device may be operable to offer game sessions for a fixed price. For example, a player may insert funds, purchase a first flat-rate game session, complete the session, purchase a second flat-rate game session, and so on.

Accordingly, in some embodiments, a gaming device may separately store an (i) amount of credits associated with a session or game, as well as (ii) an amount of credits stored on a machine which may be applied to a plurality of such games. For example, a player may deposit $50 of currency into a gaming device. The player may then purchase a one-hour gaming session for a flat price of $20, thus reducing the "machine balance" to $30. The player may then be given an amount of session or game credits for play during the hour-long session (e.g., $20 may buy 80 credits of 25¢ in value, or may buy some separate value of game credits, such that a prize may be determined at the end of the session based on the game credits accumulated). Thus, in some embodiments, a balance of session/game credits may be negative (e.g., during a session or game, a balance of credits is a negative number), though a balance of machine credits may still be positive (e.g., the player still has $30 with which to purchase further game play).

Screen 1200 also includes, as part of session information 1215, (i) a wager amount 1220 of a wager currently being placed during a session; and (ii) a duration remaining 1225 that indicates a remaining duration of the session (which may be indicated in terms of time, number of game plays, or based on any other factor desirable).

Other general information output in screen 1200 includes a deal button 1230 and a cashout button 1235. It should be noted that, in some embodiments, upon an actuation of the cashout button (which, in some embodiments, may be utilized to end a session), the session balance may be added to the machine balance to determine the number of credits available for cashout. In some embodiments, the session balance 1205 may only be added to the machine balance 1210 if the session balance is positive. If the session balance 1205 is negative, it may be treated as effectively being zero and thus not affecting the machine balance 1210 for purposes of cashout.

It should be noted that screen 1200 is illustrated in the context of a video poker game and thus an indication 1240 of five cards is included, which includes an indication of a hold button corresponding to each such card. Of course, similar session balance and machine balance information may be utilized in any games besides video poker, such as reeled slot games, video blackjack, video keno, etc.

Following is a description of an example process 1300 which, as all processes described herein, may be performed by, for example, (i) a gaming device, (ii) a controller, (iii) devices operatively connected to gaming devices and/or controllers (e.g., retrofitted hardware devices, other devices such as kiosks or casino personnel devices, etc.), and (iv) any combination thereof.

Process 1300 begins with step 1305, in which a current credit balance associated with a gaming device is determined. As described, in some embodiments, a memory may store such a balance of credits. Thus, in some embodiments, step 1305 may comprise accessing a memory to determine a current balance of credits. As described, such a memory storing a balance of credits may be maintained by one or more of a variety of devices described herein, including but not limited to a gaming device, a controller, a peripheral device, a smart card, and so on.

In some embodiments, determining a current credit balance may comprise determining a net credit balance (e.g., "net balance," "net current balance," "total balance," "total current balance," and so on), which may be determined by comparing credit balances of a first and second type. In some embodiments, such credit balances of different types may also then be stored in memory (a first memory stores credit balances of both types, balances are stored in separate memories, and so on).

In one such example, as described, a secondary type of credits may offset, negate reduce or otherwise impact (negatively or positively) the value of a first type of credits. For example, as described, in some embodiments, "loaned" credits are subtracted from "standard" credits. For example, a player may have a balance of credits of a primary type (e.g., 12 standard game credits), as well as a balance of credits of a secondary type (e.g., 17 loaned game credits). However, the credits of the secondary type may reduce the value of credits of the primary type at a one-to-one ratio (though other ratios are contemplated). For example, the player has earned 12 standard credits but owes 17 loaned credits, the player's net balance may be −5. It should be noted that, throughout the present specification, various terms may be associated with such a secondary type of credits so as to illustrate their nature. For example, as previously defined, various terms such as negative credits, loaned credits, financed credits, borrowed credits, mortgaged credits, advanced credits, subtractive credits, credits to be subtracted, "whammy" credits, penalty credits or any other substitute or otherwise appropriate terms may be used. Further, in some instances, such credits may be thought of as "debits" or reductions against a total balance.

It should be noted that, in one embodiment, a credit that may be categorized as a "loaned" credit may be a credit that is provided to a player without the player having to first provide consideration therefore and which credit the player may be required to repay via a primary credit the player may win as a result of a game play of a gaming device. However, in at least one embodiment, the player is not required to repay such a loaned credit via other means. Thus, for example, if a player is loaned ten (10) credits without first having to provide consideration therefore, any credits the player may win as a result of an outcome of a gaming device while wagering with such loaned credits may be used to repay the loaned credits. However, should the player end a session without having won enough credits to repay the entirety of the loaned ten (10) credits, in at least one embodiment the player is not required to provide any consideration as a means of repayment of any remainder of the loaned ten credits that has not yet been repaid via the player's winnings.

In some embodiments, such credits may be accumulated or otherwise received in a variety of manners. For example, in one embodiment, as described further herein, if by result of a wager, a positive balance of a first type of credits (e.g., standard game credits) would be reduced to a negative amount, rather than display such a balance as a negative balance of the first type (e.g., a negative balance of standard game credits, such as −7), a separate meter may indicate a positive amount of credits of a secondary type (e.g., 7 loaned credits are accumulated). In other examples, such credits may be accumulated (i) based on the occurrence of one or more particular game results (e.g., reels of a slot game resolve to "−10 −10 −10", such that 10 credits are subtracted from a primary balance or added to a secondary balance), (ii) through a player's failure (or success) in complying with a particular predetermined rule governing play (e.g., a player fails to maintain a certain rate of play, such as 10 spins per minute, and therefore is penalized one credit), (iii) based on the play associated with another player and/or gaming device (e.g., if a first player receives 10 credits, a second player loses 10 credits), and so on. In various embodiments, negative credits may comprise (i) credits of a balance that is currently less than zero, or (ii) a positive amount of credits that negatively affect (negates, offsets, reduces the value of) another type of credits (e.g., "loaned" credits reduce the value of "standard" credits).

Thus, it is contemplated that the step of determining a credit balance may be preformed in a variety of manners. For example, in some embodiments, a gaming device may utilize credits of only one particular type (though a balance associated therewith may be negative or positive), and accordingly, step 1305 may comprise accessing a memory to determine a current balance. In other embodiments, a gaming device may utilize credits of more than one particular type, and determining a current balance in step 1305 may then comprise comparing a plurality of credit balances that may have an effect on one another, so as to determine a net balance.

Further, the step of determining a credit balance, as well as various other steps of process 1300, may occur at different times, such as periodically, continually, or in response to a triggering event. For example, in some embodiments, a gaming device may be programmed such that one or more steps may be executed in associating with each game play executed (e.g., for each game play, a gaming device performs steps 1305-1315, 1305-1320, or 1305-1330).

In step 1310, a wager amount is determined. For example, a wager amount may be determined after receiving an input from a player. For example, a player may actuate one or more input devices so as to indicate a wager amount, which may be associated with one or more game plays. For example, a player may indicate a wager amount by actuating one or more physical buttons or by pressing an area of a touch-sensitive display screen. In one example, a player may actuate a single input device that indicates a wager amount (e.g., a physical button labeled "10 credits"). In another example, a player may increment or decrement a desired wager amount using one or more input devices (e.g., a player presses an area of a touch-sensitive display screen three times, increasing a wager amount to be associated with an upcoming game play by three credits). Of course, various other player selections or inputs made by a player may affect such a wager amount. For example, a player may indicate a number of paylines of a slot machine game that should be active (e.g., four paylines), or a player may indicate a number of hands of video poker to receive (e.g., 50 hands), and thereby a wager amount per payline or hand may be multiplied by the number of paylines or hands to determine a total wager amount associated with a particular game play.

In some embodiments, a wager amount may not be determined until a player actuates an input signaling that the player desires to execute a game play. For example, a player may actuate a "spin" button, and accordingly, a wager amount may be determined based on previous inputs the player may have entered (e.g., before pressing the spin button, the player selected a wager amount of three credits, the selected amount being stored in RAM). In another example, a player may actuate a single input device that signals a wager amount and a desire to execute a game play (e.g., a player presses a "Bet Three Credits" button, upon which such a gaming device would normally be configured to execute a game play). Accordingly, in some embodiments, such a gaming device may be programmed such that a game play may not be executed if the wager amount would result in a negative credit balance and such a credit balance is not permissible, as is described herein.

In some embodiments, a wager amount associated with a particular game play may be based on an input received prior to (e.g., several game plays in advance of) a particular game play. For example, in some embodiments, a gaming device may be configured to execute a plurality of game plays in a substantially automated manner (e.g., without receiving player input with respect to the execution of each game play). Such apparatus and methods are taught in Applicant's commonly-owned, co-pending U.S. patent application Ser. No. 10/331,438, filed Dec. 27, 2002, entitled "METHOD AND APPARATUS FOR AUTOMATICALLY OPERATING A GAME MACHINE," the entirety of which is incorporated herein by reference for all purposes. For example, a gaming device may be configured to automatically execute 100 game plays, each at a wager amount of three credits. Accordingly, for each of the game plays one through 100, one or more process steps described herein may automatically be performed (e.g., for each game play, a current balance is determined, a wager amount is determined, a determination is made as to whether the wager amount would result in a negative balance, and so on).

In step 1315, it is determined whether a wager amount would result in a negative balance. Such a determination may be based on, for example, the wager amount determined in step 1305 and a current balance determined in step 1310. For example, it may be determined whether placing the wager amount (e.g., deducting the wager amount from the current balance of credits) would result in a negative balance (e.g., a balance of credits that is less than zero).

For example, in some embodiments, a current balance determined in step 1305 may comprise a positive balance of credits (e.g., 7 credits). Accordingly, in one such embodiment, determining whether a wager amount will result in a negative balance may comprise determining whether a positive amount of credits (e.g., including or not including zero) will result in any negative amount of credits (e.g., any number less than zero). For example, if a current balance of credits is seven credits, it may be determined that any wager amount of eight or more credits results in a negative balance. If it is determined that a negative credit balance will result from a wager, the process 100 proceeds to step 1320. Otherwise, process 100 returns to step 1305.

In some embodiments, however, rather than determine whether any negative balance will result from a wager, step 1315 may instead comprise determining whether a specific negative balance will result from a wager amount. For example, step 1315 may comprise determining, based on a wager amount determined in step 1310 and a current balance determined in step 1305, whether a balance will result that is (i) a specific negative number (e.g., −200), (ii) a negative number that is less than a threshold negative number (e.g., any number less than −50 credits), (iii) a negative number between a range of negative numbers (e.g., between −101 and −200 credits), (iv) a negative number that is greater than a particular threshold number of credits less than a current balance (e.g., if a negative number that results from a wager is more than 50 coins less than a current balance), and so on. Thus, it should be noted that, in some embodiments, a current balance determined in step 1305 may comprise a negative balance, such that step 1315 may comprise determining whether a wager amount may result in a specific negative number (e.g., a number that is more negative than a current balance), a negative that is less than a threshold negative number, (e.g., a current balance is −96 and a threshold is set at −100, such that if a player intends to wager more than five coins play may be prohibited), and so on.

In step 1320 it is determined whether to allow the negative balance of credits. If it is determined that the negative balance of credits is not to be allowed, process 1300 returns to step 1305. Otherwise, process 1300 continues to step 1325. In some embodiments, if it is determined that the negative balance of credits is not to be allowed, a message indicating this may be output prior to the return to step 1305.

Determining whether to allow the negative credit balance may be based on one or more of a variety of factors. A description of some example factors on which such a determination may be made follows (the factors being categorized into example categories for illustrative purposes only).

Player Data: In some embodiments, a determination of whether to allow a negative credit balance may be based data associated with one or more players, such that a determination of whether or not to allow a negative credit balance may consider a player currently utilizing a gaming device. For example, in some embodiments, such a determination may be made based on data stored in a database such as a player database. A player of a gaming device may be identified in any of a variety of manners as described previously, such as by detecting the insertion of a player tracking card, receiving a player identifier in some other manner (e.g., via biometric means and/or receiving a PIN code), and so on, such that data measured or tracked in association with a player may then be stored as a record of an appropriate database.

Various player data may be considered when determining whether or not it is permissible to allow a negative balance, including but not limited to (i) whether the player is a hotel guest of a hotel associated with a casino; (ii) a status ranking associated with a player, which may be based on the player's historic play with a casino (e.g., turning to FIG. 7A, "Chet Williamson" is a "Tier 4" player, and thus his balance is allowed to go negative to any point, whereas "Bob Jones," being only a "Tier 1" player, may not be permitted a negative balance greater than −100 credits); (iii) whether or not the player has provided financial account information to the casino (e.g., has the player provided a credit card); (iv) whether the player has provided appropriate contact information (e.g., so long as a valid player tracking card is inserted, a negative balance may be permitted) and so on. It should be noted that any other types of data which may be tracked or measured in association with a player may be considered in a similar regard (e.g., a player's historic theoretical win, how much time a player has spent playing one or more casino games, and so on). Further factors which may be considered are described in Applicant's commonly-owned, co-pending U.S. application Ser. No. 10/852,388, filed May 24, 2004, entitled "METHOD AND APPARATUS FOR PROVIDING ELECTRONIC CREDITS AT A GAMING DEVICE WITH- OUT FIRST REQUIRING PAYMENT THEREFOR," the entirety of which is incorporated herein by reference for all purposes.

Of course, combinations of such factors may be considered when making such determinations. For example, a player's balance may be allowed to go negative only if he is a hotel guest and has provided a valid credit card. Further, it should also be appreciated that a consideration of such data may impact not only a determination of whether or not to permit a negative credit balance at all, but may also impact a determination of a maximum allowable magnitude of a negative credit balance (e.g., whether or not to permit a negative credit balance lower than a certain threshold, within a certain range, and so on).

Thus, in some embodiments, turning to an exemplary data structure of an allowable negative balance database depicted by FIG. 6A, a database may be accessed in step 1320 to determine whether or not a negative credit balance is allowed based on various conditions. For example, as shown by FIG. 6A, any negative balance up to −49 credits may be allowed in conjunction with a particular gaming device (e.g., a gaming device identified as GD-100001), so long as a player tracking card has been inserted. In another example, a negative balance between −50 and −149 may be allowed only if a player has inserted a tracking card and is at least a "Tier 1" member of a casino rewards program.

It should be appreciated that such player data may be stored in one or more databases, which may be maintained by one or more devices (e.g., gaming devices, servers, smart cards, etc.). In one embodiment, such data may be encoded onto a player tracking card or cashless gaming ticket (e.g., such that when the ticket is read by a gaming device, the gaming device is programmed to interpret the encoded data and configure itself so as to allow a negative balance as indicated by the data).

Thus, such information associated with a player may be considered when determining whether or not to allow a negative credit balance. Such data may be useful when such a determination is made during routine transactional play of a gaming device, as opposed to situations wherein players may pre-pay for a session of a plurality of game plays (as described). For example, if player has not pre-paid for a session, and the player is allowed to generate a negative credit balance (e.g., thereby placing wagers without first providing payment), then it may be advantageous for a casino to collect and utilize player data such that payment may be provided (e.g., credits loaned to a player are charged to a hotel bill or credit card, and so forth).

Session Play Parameters: In some embodiments, a determination of whether to allow a negative credit balance (or a negative credit balance of a particular magnitude) may be based on one or more parameters or terms of a session associated with the negative credit balance. As described, a gaming device may be configured to receive a fixed price for a session comprising a number of game plays (e.g., a $20 "contract" entitling the player to a predetermined amount of game play, such as a number of handle pulls or a length of time). In some embodiments, it may be determined in step 1320 that it is permissible to allow a negative credit balance (e.g., any negative credit balance, a credit balance beneath a particular threshold, a particular negative credit balance, and so on) if a player has paid (or, for example, has previously agreed to pay but has not yet provided payment) a fixed price for a session. For example, a fixed price charged to a player for such a session may be calculated so as to ensure profitability for a casino once a session concludes (and a player has been paid any winnings), and built into such a calculation may be an analysis of the statistical effects of allowing a negative credit balance. For example, based on repeated mathematical simulation, it may be conclusive that a casino can profitably offer, for a gaming device with given probabilities and payouts, a $20 flat-rate session comprising 200 spins of a 25¢-per-spin slot game, wherein a player starts with a balance of 80 credits, and is allowed to accumulate a negative balance without penalty (e.g., the player pays no more than the $20 fixed price regardless of "how negative" his balance is at the end of the session).

However, pursuant to maintaining the profitability of such sessions, a gaming device may be programmed with various rules for determining whether or not it is permissible to allow a negative credit balance (e.g., any negative credit balance, a particular negative credit balance, and so on) given various parameters of a session in which a player is engaged. It may be determined (e.g., by a gaming device) that a player is engaged in a session in a variety of manners, including but not limited to (i) accessing a database of a gaming device, controller or other device to determine if a gaming device and/or player is currently engaged in a session; (ii) detecting the insertion of a player tracking card or other type of card indicating that a session is active; (iii) receiving a signal from a separate device indicating that a session is active, such as a controller, and so on. As stated, the above-referenced commonly-owned patents and applications related to sessions gaming contracts provide further appropriate description.

For example, in some embodiments, a determination of whether or not it is permissible to allow a negative credit balance (e.g., any negative credit balance, a particular negative credit balance, any negative balance for a particular period of time, and so on) may be based on any or all of the following various parameters of a session in which a player may be engaged:

(i) a price or other cost associated with a providing gaming session or contract (e.g., if a fixed price of $20 or more for a session has been received, a negative credit balance of up to −300 credits may be allowed, whereas a larger negative balance may be allowed if a larger flat payment has been received; if an incremental session or contract fee of 10 per 25¢ wagered is received, a negative credit balance of up to −200 credits may be allowed, whereas a larger negative balance may be allowed if a larger incremental payment has been received; and so on);

(ii) a duration of session, whether measured in units of time or units of game play (e.g., during a one-hour session, a player's balance may go as far negative as −100: during a 700-spin session, a player's balance may go as far negative as −150; and so on);

(iii) a duration remaining in a session, whether measured in units of time or units of game play (e.g., for the first 50 hands of a 200-hand video poker session, a player may be allowed to go as far negative as −100, though for the next 50 hands the player may be allowed to go as far negative as −150);

(iv) a duration of a session spent with a negative credit balance (e.g., a player who has not spent any time "in the negative" may be allowed a greater negative balance than a player who has spent more time "in the negative");

(v) attributes associated with game play executed by a player during a session (e.g., a video poker player who has demonstrated more skill in executing strategically optimal hold/discard decisions may be allowed a greater negative balance);

(vi) an average profit associated with offering a session, methods of calculation for which are described in Applicant's co-pending U.S. Provisional Application. No. 60/679,138, filed May 9, 2005, entitled "SYSTEMS, METHODS AND APPARATUS FOR FACILITATING A FLAT RATE PLAY SESSION ON A GAMING DEVICE," the entirety of which is incorporated herein by reference for all purposes (e.g., if an average profit associated with a session is $6.75, a player may be allowed a negative balance of up to −60 credits, whereas if an average profit associated with a session is $12.75, a player may be allowed a negative balance of up to −120 credits); and/or (vii) a credit line extended to a player (e.g., a player with a credit line of $1,000 may be allowed any negative balance equal to or less than −500 credits on a $1 denomination slot machine).

Thus, such session parameters may be considered when determining in step 1320 whether or not it is permissible to allow a negative credit balance. For example, in some embodiments, a gaming device may be programmed such that if a player is engaged in a session, rules governing the allowance of a negative balance may be enforced based on the type of session that is active (e.g., different sessions or contracts provided to players that are characterized by similar parameters may be thought of as sessions of the same type). For example, in some embodiments, a database such as an allowable negative balance database depicted by FIG. 6B may correlate an identifier of a type of session to (i) an allowable negative credit balance, and/or (ii) one or more conditions that may apply to the allowance of the negative credit balance. For example, turning to FIG. 6B, if a player is engaged in gaming session GS-100001, the player may have no restriction on how far negative his balance may go. If a player is engaged in gaming session GS-100002, the player may be allowed a negative balance of up to −400 credits, for the duration of the session (e.g., thus, a determination to allow a negative credit balance may be based on whether or not a player is engaged in a session). If a player is engaged in gaming session GS-100003, the player may be allowed a negative balance of up to −200 for the first 100 spins and a negative balance of up to −300 for the second 200 spins of the session. It should be appreciated that such conditions may be imposed in consideration of any of the above-described session parameters (e.g., a player may be allowed a first negative balance so long as he continues to play video poker according to optimal strategy, but if the player fails to play according to optimal strategy, he may be allowed a second negative balance instead).

Other considerations. A determination of whether or not to allow a negative credit balance (e.g., any negative credit balance, a particular negative credit balance, and so on) may consider various other factors.

For example, in one embodiment, a gaming device may receive a signal from a separate device indicating to allow a negative credit balance (e.g., in association with a particular game play). For example, a gaming device may receive such a signal from a controller, a casino personnel device (e.g., a PDA-like device operated by a casino employee), and so on. In other embodiments, a determination of whether or not to allow a negative credit balance may be based on (i) time/date considerations (e.g., larger negative balances are allowed at certain times of day and/or days of week), (ii) a level of utilization of one or more casino games (e.g., if a large percentage of gaming devices are currently occupied or utilized, as detected by the insertion of player tracking cards, larger negative credit balances may be permitted), (iii) a rate of play associated with a game device (e.g., larger negative balances are allowed if a player averages at least a certain number of game plays per unit time), (iv) miscellaneous operator or manufacturer-specific rules concerning negative balances (e.g., a system of the present invention may comprise functionally for a casino manager to continually or periodically alter boundaries or rules regarding negative balances as he sees fit), and so on.

Thus, in some embodiments, it may be determined that it is permissible to allow a negative credit balance. For example, a gaming device and/or controller may allow a negative credit balance beneath a certain threshold so long as one or more pre-established conditions are satisfied (e.g., as indicated by a database such as an allowable negative balance database depicted by either FIG. 6A or FIG. 6B). Accordingly, in some embodiments, if it is determined that a negative balance is to be allowed, process 1300 may proceed to step 1325 (described below).

In other embodiments, it may be determined that a negative credit balance is not to be allowed. In such embodiments, a gaming device may be programmed to perform various functions in response to such a determination. For example, if a player requests a wager that would result in a negative balance, and the negative balance is not to be allowed, a gaming device may be configured to (i) output a message explaining the disallowance (e.g., "Sorry, you don't have that many credits"); (ii) recommend an alternate wager amount (e.g., "You may only wager up to 73 credits"); (iii) output an offer to a player to allow the wager and resulting negative credit balance, so long as the player agrees to perform a certain activity or accept an altered game parameter. For example, if a negative credit balance resulting from a wager is first determined unallowable, a player may still place the wager if he agrees to accept an altered game rule such as a disadvantageous change to a probability or payout in association with a future game play, purchase goods or services from or otherwise fulfill an obligation with a third party, partake in a survey or perform some other value-added activity, and so on. Such methods are described in Applicant's commonly-owned U.S. application Ser. No. 10/341,450, filed Jan. 10, 2003, entitled "SYSTEM AND METHOD FOR PLAYING A GAME INCLUDING A MORTGAGING OPTION," and U.S. application Ser. No. 10/121,243 filed Apr. 11, 2002, entitled "METHODS AND SYSTEMS FOR FACILITATING PLAY AT A GAMING DEVICE BY MEANS OF THIRD PARTY OFFERS"; the entirety of both are incorporated herein by reference for all purposes.

In some embodiments, a player may be engaged in a session (e.g., a player has pre-paid for an hour of game play), in which a player may continue to execute game play until the player has depleted a credit balance to a certain balance amount, which may be a negative balance amount. For example, a player may purchase for $40 the right to execute as many game plays as desired within an hour, so long as the player's balance does not fall beneath −200 credits, at which point the session may terminate (e.g., the player may no longer be allowed to execute game play). Accordingly, in some embodiments, process 1300 may comprise determining whether or not to allow a negative balance, and if it the negative credit balance is not to be allowed, terminating a session or otherwise preventing further play of a gaming device (e.g., for a predetermined period of time, until further payment is provided by a player, and so on).

If it is determined in step 1320 that a negative credit balance is to be allowed, a current balance is adjusted in step 1325 such that it is equal to the negative credit balance.

For example, in some embodiments, step 1325 may comprise adjusting a positive balance such that it is equal to the negative balance (e.g., a player with 10 credits places a 20-credit wager, and therefore reduces his balance to −10 credits). In other embodiments, step 1325 may comprise adjusting a first negative balance such that it is equal to a second negative balance (e.g., a player has −78 credits, places a one-credit wager, and therefore receives a balance of −79 credits).

In further embodiments, step 1325 may comprise adjusting a plurality of balances. For example, in one or more embodiments, step 1325 may comprise adjusting a first and a second balance, such that when the first and second balances are summed, the net result is equal to the desired negative balance. For example, as described, a player may possess a balance of standard game credits as well as a balance of loaned game credits, such that the balance of loaned game credits must be subtracted (e.g., at a one-to-one ratio, at some other ratio) from the balance of standard game credits in order to determine a true net balance. Thus, in one example, if a player has a balance of five standard game credits and places a wager of 10 credits, the player's balance of standard game credits may be reduced to zero, and the player's balance of loaned game credits may be increased to five. Thus, it should be noted that, in one embodiment wherein a gaming device may comprise such a plurality of balances of different types (e.g., debits or loan credits which are deducted from standard credits at a one-to-one ratio), only one such balance may be positive at any one time (e.g., it may be impossible or impermissible for a player to possess both loaned credits and standard credits at the same time). However, in other embodiments (as will be described further herein), it may be possible for a gaming device to simultaneously maintain a positive balance of standard credits as well as a positive balance of debits or loaned credits, so long as a reconciliation process is performed in advance of a cashout (e.g., debits are subtracted from credits before a cashout is allowed).

As described previously, in some embodiments, adjusting a balance of credits may comprise adjusting a value stored in memory of a gaming device, server or other device. For example, stored within memory of a gaming device may be a value indicating a current credit balance. Such a value may either be negative or positive, such that if it is determined in step 1320 that a negative balance is to be allowed, in step 1325 a gaming device processor may send an instruction such that the value in memory is adjusted to reflect the negative amount (e.g., a database record representing a current credit balance is changed from 11 to −1 as the result of a wager).

Further, as described, in some embodiments, a plurality of credit balances may be associated with a gaming device. Accordingly, in some embodiments, step 1325 may comprise adjusting a plurality of values stored in memory (e.g., of a gaming device and/or controller), each value associated with a type of credits (e.g., a standard game credits value is reduced and a loaned game credits value is increased). For example, if a first balance type may affect a second balance type (e.g., a first balance type reduces the value of a second balance type), each of the values may be adjusted such that a desired net result is reached (e.g., if a net credit balance of −5 is desired, a value indicating a balance of standard credits equals zero and a value indicating a balance of loaned credits equals five).

As will be described, in some embodiments, step 1330 may then comprise displaying an indication of a negative credit balance indicated by one or more of such stored values.

In accordance with some embodiments, step 1330 may comprise displaying an indication of a negative credit balance. A particular negative credit balance may be determined in a variety of manners. For example, a particular negative credit balance may be determined at step 1315. In one embodiment, a gaming device may receive a signal from another device (e.g., a controller) indicating a negative credit balance to display. Alternately or additionally, a negative credit balance to be displayed may be determined by accessing one or more values stored in memory (e.g., of a controller, gaming device, and so on) indicating one or more current balances and/or negative balance amounts to be displayed; it should be noted that in some embodiments, before indicating a negative balance, a net balance of two types of credits must be first be determined, and accordingly, step 1330 may comprise comparing balances of a first and second type to determine a net credit balance (e.g., a specific negative balance).

Various methods of displaying an indication of a negative balance of credits are contemplated. For example, as is known in the art, an output device may present a numeric indication of a balance of credits. For example, a display screen and/or LED meter may be utilized to display a numeric indication of a credit balance, such as "−103." Thus, it is contemplated that displaying a negative credit balance may comprise displaying it as a numeral, perhaps utilizing a hyphen (commonly understood when placed in front of a numeral as a "negative symbol") in conjunction therewith. An illustration of an exemplary gaming device display screen output, as shown in FIG. 8, depicts such an embodiment. Of course, various adjustments or alterations in design may be made to such output devices to accommodate such presentation (e.g., a conventional LED meter may be made wider so as to accommodate a negative symbol, and so on). Further, various other characters or text may be utilized in place of or in conjunction with a numeral to indicate a negative balance. For example, in one embodiment, a gaming device may output a negative balance as written text (e.g., "Your balance is negative six credits"). In another example, a negative number may appear as a numeral in parenthesis (e.g., "(53)"), a convention commonly employed in accounting practices. In yet another example, a credit balance when negative may appear in a red color, whereas a credit balance when zero may appear in a black color and a credit balance when positive may appear in a green color.

In some embodiments, as described, a negative balance may be indicated as a result of a plurality of credit balances that affect one another. For example, as described, credits of a first type (e.g., standard credits) may be offset by credits of a second type (e.g., loaned credits). Accordingly, in some embodiments, displaying an indication of a negative credit balance may comprise outputting indications of a plurality of credit balances, such as outputting two credit balance meters on a display screen. For example, turning to an illustration of an exemplary gaming device display screen output depicted by FIG. 9, a display screen may comprise two credit balance meters, one which tracks "credits" (standard credits) and one which tracks "loaned credits" (e.g., which count against standard credits in a one-to-one ratio).

In some embodiments, various icons, symbols, graphics or other elements may be utilized in place of or in conjunction with a numeral to indicate a negative balance (or to indicate a balance of a first or second type of credits which must be summed or otherwise compared to determine a net balance). For example, in some embodiments, a credit balance may be depicted as a thermometer, scale, measuring stick, stock chart, bar chart, measuring cup, or any other graphic element that may be used for purposes of measurement. For example, turning to an illustration of exemplary gaming device display screen outputs depicted by FIG. 10, a negative credit balance may be illustrated as a currently negative stock, currently negative thermometer reading, and so on. In some embodiments, such icons, symbols or other graphics may change in size, shape, style or color as a balance amount changes. In some embodiments, a first icon, symbol or graphic may be associated with a credit balance of a first type (e.g., a first icon is associated with a positive balance of credits), whereas a second icon, symbol or graphic may be associated with a credit balance of a second type (e.g., a second icon is associated with a negative amount of credits). Further, it should be noted that, in some embodiments, as will be described further herein, the present invention may comprise tracking or measuring a player's wins, losses, wager amounts, credit balance, and so on (e.g., such that a graphic indicating a player's history, such as the stock chart-like graphic depicted by FIG. 10, may be output).

Alternately or additionally, various visual effects such color, shading, contrast, etc., may be utilized to accompany, emphasize or otherwise illustrate the presentation of a negative credit balance. For example, in some embodiments, a balance of a particular type may appear in association with a particular color (e.g., a negative balance appears in red while a positive balance appears in green; a balance of a first type of credits appears in red while a balance of a second type appears in green; and so on). In another example, a background associated with a display screen may change in color, brightness or contrast in association with a credit balance or credit balance type (e.g., a background is red while a balance is negative and green while a balance is positive, a background gradually loses or gains brightness as a player's balance approaches and/or falls beneath zero, and so on).

In some embodiments, a current credit balance may be positive, and a player may request a wager amount that would result in a negative balance. In one example of such an embodiment, one or more display alterations that would commonly result from a change from a negative to a positive balance (e.g., a change to a credit balance meter, a change associated with an icon or graphic, a change in color or brightness) may be withheld until after one or more game plays have been completed. For example, a player may place a wager that would result in a change from a positive to a negative credit balance (e.g., a player has three coins and wagers five, thereby resulting in a balance of −2 coins), though one or more display alterations that would normally ensue when a balance changes from a positive to a negative state may be withheld until the result of the wager is determined. For example, a player of the above example may win 20 coins, and therefore, a change in color associated with a display screen may never occur (e.g., as the player had a balance of −2 for only a brief period of time until the game play concluded, yielding him 20 coins and a positive balance of 18). In other words, in some embodiments, a gaming device may determine not to alter one or more display properties associated with a change in credit balance until after a game play has been resolved in its entirety.

In some embodiments, displaying an indication of a negative credit balance to a player may comprise displaying auxiliary information to a player regarding the negative credit balance. For example, in some embodiments, a message or other indication may be output to a player, such as (i) a "warning" message that a credit balance is currently negative, is negative beyond a certain threshold, has been negative for a certain period of time, and so on; (ii) an indication of a number of credits of a particular type which must be won in order to reach a particular credit balance (e.g., "For every single-coin wager, you must win at least 10 credits to finish this session with a positive balance"); (iii) an indication of a number of credits a player has wagered since a credit balance has been zero or negative (e.g., "You've wagered 217 credits of the house's money"); (iv) offers which a player may accept to reduce or eliminate a negative credit balance (e.g., offers to accept promotions from a casino or third-party or perform various value-added activities as described herein); and so on.

Additional Description of Various Embodiments Involving a Negative Credit Balance Provided below is an additional description of various embodiments involving the implementation, tracking and/or management of a negative credit balance as it relates to a wagering game of a gaming device.

Negative balances and cashout procedures: In some embodiments, various actions may be performed in association with a cashout, cashout request, conclusion or termination of a session, and so on.

In some embodiments, it may be desirable to disable various functionality associated with a gaming device should a current credit balance be a negative credit balance (e.g., any negative credit balance, a negative credit balance below a particular threshold, and so on). For example, if a player possesses a negative balance of credits, a positive balance of "loaned" credits or debits, or a net balance of credits that is negative once credits of two different types are summed or otherwise compared, functionality that would normally allow a player to cashout may be disabled. For example, a player may have a balance of −27 credits, and therefore, upon the player's request to cashout (e.g., performed by actuating an input device such as a cashout button), one or more mechanisms may be disabled. For example, in one embodiment, a player in such a situation may not be provided with a cashless gaming ticket (e.g., a ticket printer is disabled or prevented from printing out a cashless gaming ticket). Further, in some embodiments, should a player with a negative credit balance request a cashout, a gaming device may be configured to output a message to a player, the message perhaps informing the player that (i) the player has no credits of cash value to redeem for currency, (ii) the player "owes" a certain amount of credits (e.g., which may be "paid off" in a manner described below), (iii) the player needs a certain amount of credits before he will have any credits of cash value to redeem (e.g., if a player's balance is −11, the gaming device may output a prompt indicating "You need 12 more credits before you can cash out"), and so on.

In other embodiments, upon the player's request to receive a cashout and/or upon the termination of a session (e.g., a pre-paid 100-spin gaming session concludes), if a current credit balance is negative, a player may receive a voucher, ticket, card or other medium indicating the current negative balance. For example, in one embodiment, a player may be provided with a cashless gaming ticket indicating a negative amount of credits. In some embodiments, such tickets may be characterized by various indicia, markings or other alterations. In some embodiments, such indicia may encode data, such as an identifier or code (e.g., such that a database record may be accessed based on the identifier to determine a negative credit balance, player identity, and so on), or a negative credit balance amount (e.g., a barcode encodes a negative balance amount of −17 coins). In other embodiments, such indicia, markings or other alterations may serve to distinguish such from conventional cashless gaming tickets featuring positive credit balances. For example, such "negative" cashless gaming tickets may comprise a large icon that when viewed would quickly illustrate that the ticket comprises a negative credit balance, may comprise text indicating that the ticket comprises a negative credit balance, may comprise a different color or shading, may be printed on using material (e.g., a different color paper substrate), and so on.

In some embodiments, various benefits may be provided to players possessing one or more such cashless gaming tickets or vouchers indicating negative credit balances (e.g., refunds, comp points, goods, services, buffet passes, and so on). In some embodiments, the value associated with such benefits may be based on the value associated with such tickets (e.g., larger or smaller benefits for larger or smaller negative credit balances).

In some embodiments, as described, a gaming device may comprise a plurality of balances of credits (e.g., a balance of a first type and balance of a second, perhaps offsetting type). Accordingly, in some embodiments, a cashless gaming ticket may indicate a plurality of credit balances. For example, a cashless gaming ticket may indicate a balance of a first type of credits (e.g., 19 standard game credits) and a balance of a second type of credits (e.g., 13 loaned game credits). In some embodiments, if a first credit balance type affects a second credit balance type, a net credit balance may alternately or additionally be depicted by such a cashless gaming ticket or voucher (e.g., a ticket depicts 19 standard game credits, 13 loaned game credits, and a "Cashout Balance" of six credits).

In some embodiments, an electronic indication of a negative credit balance may be stored by a gaming device, server, smart card, and so on. For example, periodically, upon the conclusion of a game play, upon the conclusion of a session and/or upon receiving a cashout request from a player, a negative credit balance amount may be stored (e.g., by a gaming device, by a server acting as a game controller, by a server that facilitates the issuance and redemption of cashless gaming tickets, and so on). Thus, for example, a player may terminate play of a gaming device, and remove a player tracking card. Should the player then insert the player tracking card (or otherwise identify himself in any other manner described herein) into a different gaming device (or the same gaming device thereafter), a negative credit balance may then be determined in association with the player (e.g., a player database or similar database stores indications of negative credit balances in association with players). In some embodiments, the player may then be prompted to perform a reconciliation or "pay off" process, as described below, before further play is permitted.

Reconciliation of debts: In some embodiments, a balance of negative credits (or positive balance of "loaned" credits or debits) associated with a player and/or gaming device may be eliminated by means of a reconciliation or "pay off" process.

Such a process may be executed (e.g., by a gaming device) at various times and/or in response to various triggering conditions, including but not limited to:

upon receiving a player's request to execute a reconciliation (e.g., a player actuates an input device, such as a button labeled "Convert credits," "Pay off credits/debt," "Reconcile," and so on);

upon receiving a signal from a separate device (e.g., a controller)

upon the resolution of a game play (e.g., after each game play, after certain game plays such as losing or winning game plays, and so on);

upon cashout (e.g., a player actuates a "Cash Out" button);

upon the conclusion of a session, upon achieving a particular credit balance (e.g., once a player reaches a balance of −100 credits, a reconciliation process is triggered), periodically (e.g., every minute); and/or continually (e.g., each time a credit balance changes).

In some embodiments, as described, a player may be responsible for repaying a negative balance of credits. For example, in various embodiments, a player may be responsible for repaying a negative balance of credits before further game play and/or wagering is allowed, before a session concludes, before a certain time/date, before the occurrence of a particular event, and so on. In other embodiments, a player may not be responsible for repaying all or a portion of a negative credit balance (or a positive balance of "loaned" credits or debits). For example, in one embodiment, if a player has pre-paid a fixed price for a session, and the session concludes with a negative credit balance (e.g., any negative credit balance, a negative credit balance above a certain threshold, and so on), the player may not be responsible for repayment (e.g., such that all a player "pays" for the session is the fixed price). In another example, a player may not be responsible for repaying all or a portion of a negative credit balance if the player is of a certain status, has been playing for a certain amount of time, etc. Generally, in other words, any of the conditions for which a negative credit balance may be allowed (step 1320) may be applied to a determination of whether or not a player must repay a portion or all of a negative credit balance (or positive balance of "loaned" credits or debits).

In some embodiments, if repayment is required (in portion or in full), a player may repay during a reconciliation process. During such a process, a balance of negative credits (or positive balance of "loaned" credits or debits) may be reconciled or "paid off" such that a player may no longer be obligated to repay. In some embodiments, a player may repay any credits owed by providing further payment via a gaming device payment accepting mechanism (e.g., a player inserts a cashless gaming ticket, inserts cash, inserts coins, draws funds from an electronic account, and so on, such that an amount of credits owed may be repaid using the newly-provided funds). Alternately or additionally, a player may reconcile an amount owed by exchanging one type of credits for another. For example, a player may possess 20 loaned credits and 30 standard credits. The player may then "pay off" the loaned credits using the standard credits (e.g., in a one-to-one ratio), such that the player may no longer owe any loaned credits (e.g., an thereby possess only 10 standard credits). Alternately or additionally, a player may reconcile an amount owed in a variety of other manners.

For example, in one embodiment, a player may repay an amount of credits by agreeing to purchase or purchasing a session. In another embodiment, a play may provide comp points as repayment. In yet another embodiment, a player may only repay an amount owed using a particular type of credits or particular type of currency (e.g., using only winnings earned while a credit balance is positive). Still further, in exchange for a repayment of credits owed, a player may agree to accept an altered game rule such as a disadvantageous change to a probability or payout in association with a future game play, purchase goods or services from or otherwise fulfill an obligation with a third party, partake in a survey or perform some other value-added activity, and so on. In a still further embodiment, a player may be withheld from further gambling until reconciliation is (partially or wholly) complete (e.g., an identified player may be prevented from playing a slot machine).

In some embodiments, a gaming device may be configured to output one or more display or menu screens designed to facilitate such reconciliation. For example, turning to an exemplary illustration of a gaming device display screen output depicted by FIG. 11, in one embodiment, a player may utilize a touch-screen to select any or all of a method of repayment (e.g., "game credits" or "comp points"), an amount to be repaid in association with a method, and so on. It should of course be appreciated that the functionality exhibited by such a singular screen may be spread throughout a plurality of such screens (e.g., players are stepped through a series of screens), and that further such screens may be necessary to complete a reconciliation process (e.g., after selecting an "add funds" option, a separate screen displays an indication of funds added as a player inserts cash, coins, and so on).

In some embodiments, various players may receive an advantage during a reconciliation process. For example, based on a variety of factors such as player data (e.g., various previously-described statistics associated with a player's gaming history, such as rewards club status level, theoretical win generated, etc.), a measured rate of play and/or length of time playing, session considerations (e.g., a number of sessions a player has bought, a length or cost associated with a particular session), time/date considerations, utilization or capacity considerations, and so on, various parameters of a reconciliation process may be adjusted. For example, a payoff amount or amount owed may be reduced (e.g., if a player meets certain criteria, such as by maintaining a certain rate of play, and so on). In another example, a rate at which a player may exchange a first type of credits for a second type of credits may be altered (e.g., for certain players, each standard game credit pays off two loaned game credits). In yet another example, a time or event before which a player must repay an amount of credits owed may be altered (e.g., a time is extended for certain players).

Sessions beginning with negative balances: As described, in some embodiments, a gaming device may be operable to execute a plurality of game plays in exchange for a single, fixed payment (e.g., 100 spins for $10).

Thus, it should be noted that in some embodiments, a negative credit balance may be arrived at in various manners (e.g., a manner other than a result of placing a wager). For example, in one embodiment, a session-based game may begin with a negative credit balance, such that a credit balance may not initially be positive. For example, a player may play a gaming session (e.g., purchase a flat-rate block of a plurality of game plays) that begins with a negative credit balance, whereby the player may win a prize or payout at the end of the session (perhaps as well as winning various payouts throughout the session) based on the player's ability (through achieving winning game results) to reduce the negative credit balance, eliminate the negative credit balance and/or turn the negative credit balance into a positive balance (e.g., a game begins at −1,000 credits, and if a player is able to gain a positive balance by the end of the session, the player wins a jackpot). In one embodiment, an initial negative credit balance (i.e., the negative credit balance at which the session begins) may be based on a fixed price and/or one or more other parameters associated with a session (e.g., the greater the fixed price the lesser the initial negative credit balance; the longer the session the greater the initial negative credit balance; and so on).

Tracking negative play: As described, in some embodiments, various parameters may be tracked or measured in association with play of a gaming device. For example, a gaming device and/or controller may track or measure various statistics regarding "negative play" occurring on the gaming device (e.g., wagering which has occurred while a credit balance is zero and/or a negative number).

For example, in some embodiments, a gaming device and/or controller may track an amount of play (e.g., an amount of time, a number of game plays, an amount wagered, and so on) spent while negative (e.g., with any balance equal to and/or less than zero). Thus, in some embodiments, a process may comprise determining whether a wager amount will result in a negative credit balance (e.g., any negative credit balance, a negative credit balance below a particular threshold, etc.), and if so, incrementing a value indicating (i) an amount of time elapsed while a credit balance is negative (e.g., so long as a credit balance remains negative, such a value may continually increment, though the value may cease to increment while a balance is positive), (ii) a number of game plays executed while a starting credit balance is negative, and/or (iii) an amount wagered while a credit balance is negative. Thus, in some embodiments, such values may be measured, tracked and/or stored. For example, in some embodiments, such values may be stored in a database similar in structure to an exemplary negative play database depicted by FIG. 7.

In some embodiments, such data may then be output by a device, such as a gaming device, kiosk, casino personnel device, and so on. For example, in one embodiment, such data may be continually or periodically displayed to a player of a gaming device (e.g., a corner of a display screen depicts "15:02 spent in negative this session"). In another embodiment, a player may request such data (e.g., a player presses a button labeled "About my session") via a gaming device or kiosk, such that the data may be accessed (e.g., based on a received player identifier) and output. In yet another embodiment, such data may be output via a cashless gaming ticket or other substrate output via a gaming device, kiosk or any other device. In yet another embodiment, a player may utilize a device such as a personal computer, cellular phone, PDA, interactive television set, in a manner such that such data may be accessed (e.g., via a network, such as the Internet) and viewed using the device. In various embodiments, any or all of such data may be output, and may be organized or labeled in a variety of manners (e.g., a total amount wagered while negative may appear labeled as "Total Played with House's Money," "Total Free Play," "Total Amount Owed," and so on, perhaps depending on various reconciliation parameters associated with a gaming device and/or player). Further, in some embodiments, a variety of other data may be similarly measured, stored and/or output, including but not limited to (i) an amount of credits won while negative, (ii) a number of game indicia accumulated while negative (e.g., slot machine reel symbols, cards, and so on), (iii) a number of "points" of a loyalty or rewards program earned while negative, (iv) a length of time in between game plays while negative, and so on.

It should also be noted that such data may also be measured, stored and/or output in association with a positive credit balance or credit balance of any other distinguishable type (e.g., an amount of time a player has spent with a positive balance may similarly be tracked). Thus, a player (or other interested party, such as a casino operator, gaming device manufacturer, gaming regulator, tax authority, and so on) may view statistics associated with gaming while credit balances are negative or positive. For example, utilizing data such as (i) a total amount won while positive, (ii) a total amount wagered while positive, (iii) a total amount won while negative, and/or (iv) a total amount wagered while negative, various conclusions can be drawn (e.g., a player typically wagers more while a balance is positive, a player typically takes longer breaks in between game plays when a balance is negative, and so on). Further, it may be useful to track such data related to negative and positive credit balances separately for accounting purposes. For example, only wagers placed while a credit balance is positive may be counted as revenue or "coin-in," perhaps until a player reconciles an amount owed. In another example, only payouts achieved while a credit balance is positive may count as historic winnings associated with a player. Thus, tracking such data may be useful for a variety of reasons.

Altering payouts, probabilities or other parameters when credit balance is negative. In some embodiments, various parameters may be altered when a gaming device credit balance is in a negative state (as opposed to a positive state). For example, in some embodiments, a process may comprise (i) determining whether a current credit balance is in a negative or positive state, (ii) executing a game play, (iii) determining whether the current credit balance has changed state as a result of the game play, and if so (iv) adjusting a gaming device parameter. In other words, a gaming device may be operable in a negative or positive "state" or "mode," in which various attributes or parameters may change.

For example, if a current gaming device balance is negative (as opposed to positive), a variety of parameters may be altered, including but not limited to:

a payout associated with one or more game results (e.g., "Cherry-Cherry-Cherry" pays 10 credits while in a positive state, but 12 credits while in a negative state);

a probability associated with achieving one or more game results (e.g., a player is more likely to achieved "Cherry-Cherry-Cherry" when negative than when positive);

a rate at which points of a rewards or loyalty program are earned (e.g., a player earns fewer or no "comp" points per game play when a credit balance is negative);

a display property, such as a color, light, brightness level, contrast level, icon type, graphic type, font type, and so on (e.g., as described, a display screen background turns red when a credit balance is negative);

a rate at which various collectable game elements may be accumulated (e.g., a player may collect/save a greater number of "cherry" symbols or other element for which the player may eventually earn a payout or other benefit); and a standard, maximum and/or minimum allowable wager per game play (e.g., a player is allowed to wager a larger or smaller amount per game play while a credit balance is negative).

Thus, a gaming device operating in a negative "mode" (as opposed to a positive "mode") may be characterized by a different look, feel, play style and so on. For example, in one or more embodiments, as described, payouts and/or probabilities associated with game play may be altered while a gaming device is in such a mode or state. For example, a particular type of payout may only be available when a gaming device is in such a mode or state (e.g., a "super jackpot" becomes active only when a player's balance is negative). In another example, a player may be more likely to achieve a particular outcome while a credit balance is negative (e.g., a probability associated with the outcome "Bell-Bell-Bell" increases). In yet another example, a player may receive a larger payout for an outcome if a credit balance is negative (e.g., a video poker outcome of "Full House" pays a 20-coin bonus when a balance is negative).

In another embodiment, a magnitude of a change in probability or payout may be based on a player's credit balance. For example, in one embodiment, as a player's credit balance becomes more and more negative, one or more payouts (according to a predetermined pay schedule) may increase in size (e.g., a payout for "Bar-Bar-Bar" pays 15 credits when a balance is positive, but pays 20 credits when a balance is between −20 and −30, 30 credits when a balance is between −30 and −40, and so on). In one embodiment, a payout for achieving one or more particular game results may be equal to an amount of coins that, when added to a currently negative credit balance, will result in a balance of zero credits or a positive credit balance. For example, a payout for the slot machine outcome "Snapback-Snapback-Snapback" may be a positive amount of credits equal to a currently negative credit balance, and the outcome may only be attainable when a credit balance is currently negative. For example, if a player with a balance of −5 credits achieves "Snapback-Snapback-Snapback," the player may earn five credits, whereas a player with a balance of −117 credits achieving "Snapback-Snapback-Snapback" may win 117 credits, perhaps up to a certain limit (e.g., the maximum potential payout for the outcome is 200 coins).

In another example, a payout achieved may be based on an amount of time, amount wagered and/or number of game plays executed during which a player's credit balance is negative. For example, a player having executed 100 game plays while a credit balance is negative may receive a larger payout for a particular outcome than a player who has only executed 50 game plays while a credit balance is negative.

In another example, an outcome achieved while a credit balance is a certain negative number (e.g., −17) may pay an amount of credits such that a positive number that is of equal distance from a balance of zero credits may be achieved (e.g., 17). Thus, for example, an outcome such as "Positive Swap-Positive Swap-Positive Swap" may pay 34 credits when a balance is −17 (e.g., resulting in a positive balance of 17 credits), 30 credits when a balance is −15 (e.g., resulting in a positive balance of 15 credits), and so on.

Session Balance vs. Machine Balance: In some embodiments, as described, a gaming device may be operable to support sessions for a fixed price. For example, a player may insert funds, purchase a session, complete the session, purchase a second session, and so on.

Accordingly, in some embodiments, a gaming device may separately store an (i) amount of credits associated with a session, as well as (ii) an amount of credits stored on a machine which may be applied to a plurality of such sessions or to transactional play (play in which a player pays on a per-game-play basis). For example, a player may deposit $50 of currency into a gaming device. The player may then purchase a one-hour session for a flat price of $20, thus reducing the "machine balance" to $30. The player may then be given an amount of session or game credits for play during the hour-long session (e.g., $20 may buy 80 credits of 25¢ in value, or may buy some separate value of game credits, such that a prize may be determined at the end of the session based on the game credits accumulated). Thus, in some embodiments, a balance of session credits may be negative (e.g., during a session, a balance of credits is a negative number), though a balance of machine credits may still be positive (e.g., the player still has $30 with which to purchase further game play).

Figure 14:
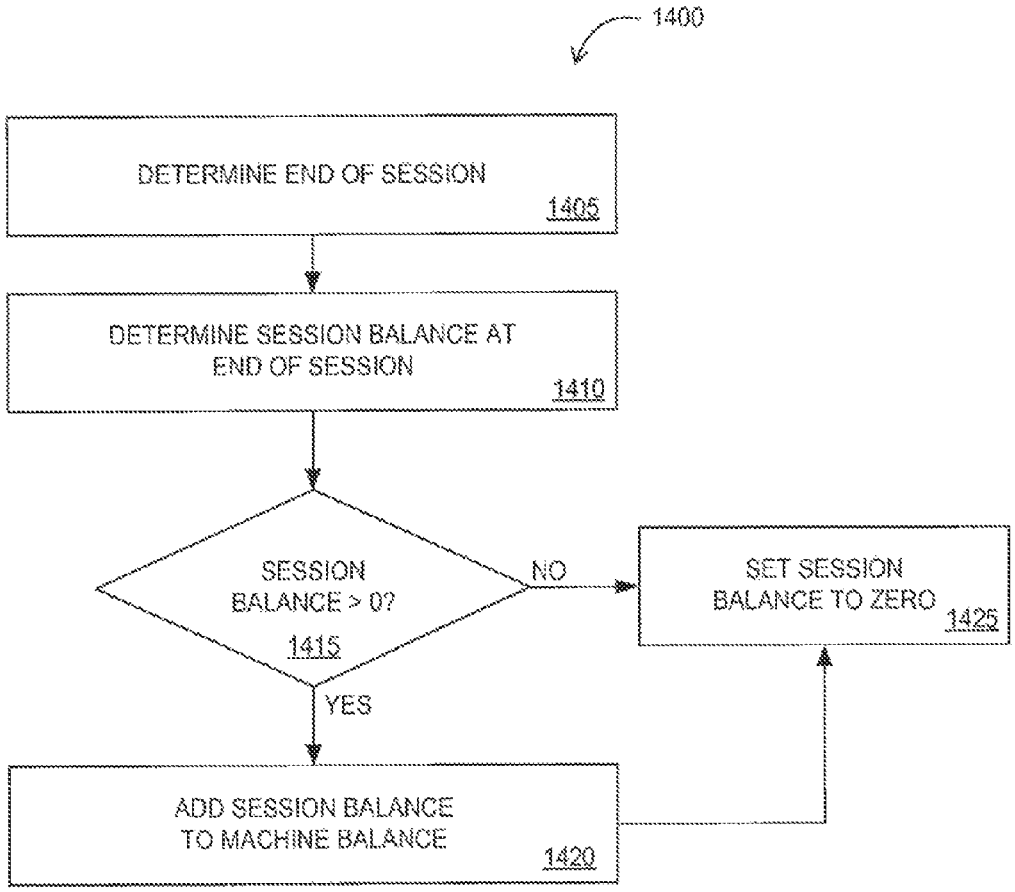
FIG. 14 is a flow chart illustrating a process for managing a session balance and a machine balance at the end of a session.

Referring now to FIG. 14, illustrated therein is a flow chart of an example process 1400 that is consistent with one or more embodiments described herein. The process 1400 is related to cashout request in a scenario involving both a session balance and a machine balance.

In step 1405 an end of a session is determined. For example, it may be determined that a maximum duration of the session (whether it be measured in number of game plays or time) has been reached or that a player associated with the session has requested to end the session.

In step 1410, a session balance at the end of the session is determined. In other words, the ending session balance is determined.

In step 1415 it is determined whether the ending session balance is greater than zero (i.e., is the ending session balance positive). If so, the process 1400 continues to step 1420. Otherwise (i.e., the ending session balance is negative or zero), the process 1400 continues to step 1425, in which step the session balance is set to zero.

In step 1420, the ending session balance that is greater than zero is added to the machine balance. The machine balance may then be utilized by a player to pay for additional sessions, pay for a game play, or be dispensed or otherwise output to the player. For example, coins, bills or tokens may be dispensed into a coin tray, a cashless gaming receipt redeemable for a monetary amount equivalent to the machine balance may be printed and/or the machine balance may be transferred to another device (e.g., another gaming device or controller. In other words, the process 1400 contemplates an embodiment in which the session balance only affects the machine balance, which may be the only balance of the two balances that is available for cashout by the player, if it is greater than zero. Otherwise, it is treated effectively as zero and does not affect the machine balance.

Balance-status paytable: In some embodiments, a gaming device may comprise a paytable viewable by players (e.g., at all times, by accessing a screen through a menu system, and so on), as is known in the art (e.g., a chart correlates outcomes that may be achieved to payouts that will be made if a player achieves an associated outcome).

In one embodiment, such a paytable may illustrate (i) one or more winnings outcomes that may be achieved through play of the gaming device (e.g., "Plum-Plum-Plum," "Bar-Bar-Bar," and so on), (ii) one or more payouts that may be earned for achieving such a winning outcome (e.g., "Bar-Bar-Bar" pays 20 coins), as well as (iii) an indication of a resulting credit balance should an outcome/payout should be achieved (e.g., should a player hit "Bar-Bar-Bar," a resulting balance would be "−42 credits"). For example, a section of a paytable for a game result of "Bar-Bar-Bar" may appear accordingly:

| Outcome | Payout | Resulting Credit Balance |
|---|---|---|
| Bar-Bar-Bar | 20 | −42 |

Thus, it is contemplated that outputting a paytable via a display screen may comprise dynamically updating a paytable based on a current credit balance, such that entries in a "Resulting Credit Balance" column may be continually updated based on a player's current balance (e.g., to calculate such a "new balance" figure, a potential payout amount is added to a current balance amount). FIG. 5 illustrates one embodiment of a payout database that may be used to track, manage and/or store such dynamically updated information to be output via a payout schedule viewable by a player. It should be noted that such an embodiment may be advantageous should a gaming device comprise a credit balance that may be negative, as patrons may not be used to performing calculations with negative numbers (e.g., the paytable illustrates what a player's credit balance would be should he win a payout with a negative credit balance, minimizing the occurrence of discrepancies).

In some embodiments, when a credit balance is negative, various information may be output to a player indicating manners in which the credit balance may be turned positive. In one example, if a player's balance is −78 credits, any single pay combination of a viewable paytable that is greater than or equal to −78 credits may be highlighted or emphasized in some regard (e.g., such that the player knows he needs at least a full house to break out of the negative in one hand). In another example, a player may be informed of other manners in which a negative credit balance may be turned positive (e.g., marketing offers the player may accept, and so on).

"Betting" a negative amount of credits: In some embodiments, a player may be able to wager a negative amount of credits, such that a player may "win" by achieving an outcome that generally would yield no payout. For example, when wagering a negative amount of credits, a paytable may be "reversed" such that outcomes that normally would be considered non-winning outcomes (e.g., Bar-Blank-Lemon) may pay an amount of credits, whereas outcomes that would normally be considered winning outcomes (e.g., "Cherry-Cherry-Cherry") may result in the loss of the "negative" wager amount. For example, a player may "wager"−5 credits, thus signaling the reversal of the paytable in association with a particular game play, such that if a player achieves a "losing" outcome (e.g. Bar-Blank-Lemon), the player may win an amount of credits as indicated by a secondary paytable, whereas if the player achieves a "winning" outcome (e.g., "Cherry-Cherry-Cherry"), the player may lose his wager amount (e.g., the player loses five credits).

Rules of Interpretation

Numerous embodiments have been described, and are presented for illustrative purposes only. The described embodiments are not intended to be limiting in any sense. The invention is widely applicable to numerous embodiments, as is readily apparent from the disclosure herein. These embodiments are described in sufficient detail to enable those skilled in the art to practice the invention, and it is to be understood that other embodiments may be utilized and that structural, logical, software, electrical and other changes may be made without departing from the scope of the present invention. Accordingly, those skilled in the art will recognize that the present invention may be practiced with various modifications and alterations. Although particular features of the present invention may be described with reference to one or more particular embodiments or figures that form a part of the present disclosure, and in which are shown, by way of illustration, specific embodiments of the invention, it should be understood that such features are not limited to usage in the one or more particular embodiments or figures with reference to which they are described. The present disclosure is thus neither a literal description of all embodiments of the invention nor a listing of features of the invention that must be present in all embodiments.

The terms "an embodiment", "embodiment", "embodiments", "the embodiment", "the embodiments", "an embodiment", "some embodiments", "an example embodiment", "at least one embodiment", "one or more embodiments" and "one embodiment" mean "one or more (but not necessarily all) embodiments of the present invention(s)" unless expressly specified otherwise. The terms "including", "comprising" and variations thereof mean "including but not limited to", unless expressly specified otherwise.

The term "consisting of" and variations thereof mean "including and limited to", unless expressly specified otherwise.

The enumerated listing of items does not imply that any or all of the items are mutually exclusive. The enumerated listing of items does not imply that any or all of the items are collectively exhaustive of anything, unless expressly specified otherwise. The enumerated listing of items does not imply that the items are ordered in any manner according to the order in which they are enumerated.

The term "comprising at least one of" followed by a listing of items does not imply that a component or subcomponent from each item in the list is required. Rather, it means that one or more of the items listed may comprise the item specified. For example, if it is said "wherein A comprises at least one of: a, b and c" it is meant that (i) A may comprise a, (ii) A may comprise b, (iii) A may comprise c, (iv) A may comprise a and b, (v) A may comprise a and c, (vi) A may comprise b and c, or (vii) A may comprise a, b and c.

The terms "a", "an" and "the" mean "one or more", unless expressly specified otherwise.

The term "based on" means "based at least on", unless expressly specified otherwise.

The methods described herein (regardless of whether they are referred to as methods, processes, algorithms, calculations, and the like) inherently include one or more steps. Therefore, all references to a "step" or "steps" of such a method have antecedent basis in the mere recitation of the term 'method' or a like term. Accordingly, any reference in a claim to a 'step' or 'steps' of a method is deemed to have sufficient antecedent basis.

Headings of sections provided in this document and the title are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required, or that each of the disclosed components must communicate with every other component. On the contrary a variety of optional components are described to illustrate the wide variety of possible embodiments of the present invention.

Further, although process steps, method steps, algorithms or the like may be described in a sequential order, such processes, methods and algorithms may be configured to work in alternate orders. In other words, any sequence or order of steps that may be described in this document does not, in and of itself, indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

It will be readily apparent that the various methods and algorithms described herein may be implemented by, e.g., appropriately programmed general purpose computers and computing devices. Typically a processor (e.g., a microprocessor or controller device) will receive instructions from a memory or like storage device, and execute those instructions, thereby performing a process defined by those instructions. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments of the present invention need not include the device itself.

The term "computer-readable medium" as used herein refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media may include dynamic random access memory (DRAM), which typically constitutes the main memory. Transmission media may include coaxial cables, copper wire and fiber optics, including the wires or other pathways that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Transmission Control Protocol, Internet Protocol (TCP/IP), Wi-Fi, Bluetooth, TDMA, CDMA, and 3G.

Where databases are described, it will be understood by one of ordinary skill in the art that (i) alternative database structures to those described may be readily employed, and (ii) other memory structures besides databases may be readily employed. Any schematic illustrations and accompanying descriptions of any sample databases presented herein are illustrative arrangements for stored representations of information. Any number of other arrangements may be employed besides those suggested by the tables shown. Similarly, any illustrated entries of the databases represent exemplary information only; those skilled in the art will understand that the number and content of the entries can be different from those illustrated herein. Further, despite any depiction of the databases as tables, other formats (including relational databases, object-based models and/or distributed databases) could be used to store and manipulate the data types described herein. Likewise, object methods or behaviors of a database can be used to implement the processes of the present invention. In addition, the databases may, in a known manner, be stored locally or remotely from a device that accesses data in such a database.

It should also be understood that, to the extent that any term recited in the claims is referred to elsewhere in this document in a manner consistent with a single meaning, that is done for the sake of clarity only, and it is not intended that any such term be so restricted, by implication or otherwise, to that single meaning.

In a claim, a limitation of the claim which includes the phrase "means for" or the phrase "step for" means that 35 U.S.C. §112, paragraph 6, applies to that limitation.

In a claim, a limitation of the claim which does not include the phrase "means for" or the phrase "step for" means that 35 U.S.C. §112, paragraph 6 does not apply to that limitation, regardless of whether that limitation recites a function without recitation of structure, material or acts for performing that function. For example, in a claim, the mere use of the phrase "step of" or the phrase "steps of" in referring to one or more steps of the claim or of another claim does not mean that 35 U.S.C. §112, paragraph 6, applies to that step(s).

With respect to a means or a step for performing a specified function in accordance with 35 U.S.C. §112, paragraph 6, the corresponding structure, material or acts described in the specification, and equivalents thereof, may perform additional functions as well as the specified function.

Computers, processors, computing devices and like products are structures that can perform a wide variety of functions. Such products can be operable to perform a specified function by executing one or more programs, such as a program stored in a memory device of that product or in a memory device which that product accesses. Unless expressly specified otherwise, such a program need not be based on any particular algorithm, such as any particular algorithm that might be disclosed in the present application. It is well known to one of ordinary skill in the art that a specified function may be implemented via different algorithms, and any of a number of different algorithms would be a mere design choice for carrying out the specified function.

Therefore, with respect to a means or a step for performing a specified function in accordance with 35 U.S.C. §112, paragraph 6, structure corresponding to a specified function includes any product programmed to perform the specified function. Such structure includes programmed products which perform the function, regardless of whether such product is programmed with (i) a disclosed algorithm for performing the function, (ii) an algorithm that is similar to a disclosed algorithm, or (iii) a different algorithm for performing the function.

The invention is claimed as follows:

1. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) display a non-numerical indication of a quantity of credits in a credit meter, (b) enable a player to wager one of a plurality of different quantities of credits on a play of a game, and (c) if the player wagers one of the plurality of different quantities of credits on the play of the game:

(i) modify the displayed non-numerical indication of the quantity of credits in the credit meter, said modification being based, at least in part, on the wagered quantity of credits, (ii) generate a game outcome for said play of the game, (iii) display the generated game outcome, (iv) determine if the generated game outcome is associated with a quantity of credits greater than zero, (v) if the generated game outcome is associated with a quantity of credits greater than zero, further modify the displayed non-numerical indication of the quantity of credits in the credit meter, said modification being based, at least in part, on the quantity of credits associated with the generated game outcome, and (vi) if the generated game outcome is not associated with a quantity of credits greater than zero, not further modify the displayed non-numerical indication of the quantity of credits in the credit meter.

2. The gaming system of claim 1, wherein when executed by the at least one processor, the plurality of instructions cause the at least one processor to display the non-numerical indication of the quantity of credits in the credit meter as a graphic selected from the group consisting of: a thermometer, a scale, a measuring stick, a stock chart, a bar chart, and a measuring cup.

3. The gaming system of claim 1, wherein at least one modification of the non-numerical indication of the quantity of credits in the credit meter includes a modification of at least one selected from the group consisting of: a size of an icon, a shape of the icon, a style of the icon, and a color of the icon.

4. The gaming system of claim 1, wherein when executed by the at least one processor, the plurality of instructions cause the at least one processor to:

display the non-numerical indication of the quantity of credits in the credit meter as a first icon if the credit meter includes a negative quantity of credits, and display the non-numerical indication of the quantity of credits in the credit meter as a second, different icon if the credit meter includes a positive quantity of credits.

5. The gaming system of claim 1, wherein at least one of: the quantity of credits in the credit meter, the wagered quantity of credits and the quantity of credits associated with the generated game outcome is selected from the group consisting of: a quantity of monetary credits and a quantity of non-monetary credits.

6. A method of operating a gaming system, said method comprising:

(a) causing at least one display device to display a non-numerical indication of a quantity of credits in a credit meter, (b) enabling a player to wager one of a plurality of different quantities of credits on a play of a game, and (c) if the player wagers one of the plurality of different quantities of credits on the play of the game:

(i) causing at least one processor to execute a plurality of instructions to modify the displayed non-numerical indication of the quantity of credits in the credit meter, said modification being based, at least in part, on the wagered quantity of credits, (ii) causing the at least one processor to execute the plurality of instructions to generate a game outcome for said play of the game, (iii) causing the at least one display device to display the generated game outcome, (iv) causing the at least one processor to execute the plurality of instructions to determine if the generated game outcome is associated with a quantity of credits greater than zero, (v) if the generated game outcome is associated with a quantity of credits greater than zero, causing the at least one processor to execute the plurality of instructions to further modify the displayed non-numerical indication of the quantity of credits in the credit meter, said modification being based, at least in part, on the quantity of credits associated with the generated game outcome, and (vi) if the generated game outcome is not associated with a quantity of credits greater than zero, causing the at least one processor to execute the plurality of instructions to not further modify the displayed non-numerical indication of the quantity of credits in the credit meter.

7. The method of claim 6, which includes causing the at least one display device to display the non-numerical indication of the quantity of credits in the credit meter as a graphic selected from the group consisting of: a thermometer, a scale, a measuring stick, a stock chart, a bar chart, and a measuring cup.

8. The method of claim 6, wherein at least one modification of the non-numerical indication of the quantity of credits in the credit meter includes a modification of at least one selected from the group consisting of: a size of an icon, a shape of the icon, a style of the icon, and a color of the icon.

9. The method of claim 6, which includes:

causing the at least one display device to display the non-numerical indication of the quantity of credits in the credit meter as a first icon if the credit meter includes a negative quantity of credits, and causing the at least one display device to display the non-numerical indication of the quantity of credits in the credit meter as a second, different icon if the credit meter includes a positive quantity of credits.

10. The method of claim 6, wherein at least one of: the quantity of credits in the credit meter, the wagered quantity of credits and the quantity of credits associated with the generated game outcome is selected from the group consisting of: a quantity of monetary credits and a quantity of non-monetary credits.

11. The method of claim 6, which is provided through a data network.

12. The method of claim 11, wherein the data network is an internet.

13. A non-transitory computer readable medium including a plurality of instructions, which when executed by at least one processor, cause the at least one processor to:

(a) cause at least one display device to display a non-numerical indication of a quantity of credits in a credit meter, (b) enable a player to wager one of a plurality of different quantities of credits on a play of a game, and (c) if the player wagers one of the plurality of different quantities of credits on the play of the game:

(i) modify the displayed non-numerical indication of the quantity of credits in the credit meter, said modification being based, at least in part, on the wagered quantity of credits, (ii) generate a game outcome for said play of the game, (iii) cause the at least one display device to display the generated game outcome, (iv) determine if the generated game outcome is associated with a quantity of credits greater than zero, (v) if the generated game outcome is associated with a quantity of credits greater than zero, further modify the displayed non-numerical indication of the quantity of credits in the credit meter, said modification being based, at least in part, on the quantity of credits associated with the generated game outcome, and (vi) if the generated game outcome is not associated with a quantity of credits greater than zero, not further modify the displayed non-numerical indication of the quantity of credits in the credit meter.

14. The non-transitory computer readable medium of claim 13, wherein when executed by the at least one processor, the plurality of instructions cause the at least one processor to cause the at least one display device to display the non-numerical indication of the quantity of credits in the credit meter as a graphic selected from the group consisting of: a thermometer, a scale, a measuring stick, a stock chart, a bar chart, and a measuring cup.

15. The non-transitory computer readable medium of claim 13, wherein at least one modification of the non-numerical indication of the quantity of credits in the credit meter includes a modification of at least one selected from the group consisting of: a size of an icon, a shape of the icon, a style of the icon, and a color of the icon.

16. The non-transitory computer readable medium of claim 13, wherein when executed by the at least one processor, the plurality of instructions cause the at least one processor to:

cause the at least one display device to display the non-numerical indication of the quantity of credits in the credit meter as a first icon if the credit meter includes a negative quantity of credits, and cause the at least one display device to display the non-numerical indication of the quantity of credits in the credit meter as a second, different icon if the credit meter includes a positive quantity of credits.

17. The non-transitory computer readable medium of claim 13, wherein at least one of: the quantity of credits in the credit meter, the wagered quantity of credits and the quantity of credits associated with the generated game outcome is selected from the group consisting of: a quantity of monetary credits and a quantity of non-monetary credits.

* * * * *